US011937717B2

(12) United States Patent
Savenok

(10) Patent No.: US 11,937,717 B2
(45) **Date of Patent: *Mar. 26, 2024**

(54) LOW-PROFILE LIQUID CONTAINER LID ASSEMBLY

(71) Applicant: Pavel Savenok, Wheaton, IL (US)

(72) Inventor: Pavel Savenok, Wheaton, IL (US)

(73) Assignee: Resolute Patents, LLC, Wheaton, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/665,238

(22) Filed: Feb. 4, 2022

(65) Prior Publication Data

US 2022/0151411 A1 May 19, 2022

Related U.S. Application Data

(62) Division of application No. 16/413,546, filed on May 15, 2019, now Pat. No. 11,241,109, which is a (Continued)

(51) Int. Cl.

| | |
|---|---|
| ***B65D 43/02*** | (2006.01) |
| ***A47G 19/22*** | (2006.01) |
| ***B65D 47/04*** | (2006.01) |
| ***B65D 47/26*** | (2006.01) |
| *B65D 41/56* | (2006.01) |

(52) U.S. Cl.

CPC ..... *A47G 19/2272* (2013.01); *A47G 19/2288* (2013.01); *B65D 43/0208* (2013.01); *B65D 47/043* (2013.01); *B65D 47/265* (2013.01); *B65D 41/56* (2013.01); *B65D 2543/00046* (2013.01); *B65D 2543/00092* (2013.01); *B65D 2543/00296* (2013.01); *B65D 2543/0062* (2013.01)

(58) Field of Classification Search

CPC ..... G01F 11/262; B65D 2543/00046; B65D 43/0208; B65D 43/0212; B65D 47/265; A47G 19/2272

See application file for complete search history.

(56) References Cited

U.S. PATENT DOCUMENTS 5,036,993 A 8/1991 Ramsey
5,873,493 A 2/1999 Robinson
(Continued)

*Primary Examiner* — Mollie Impink
(74) *Attorney, Agent, or Firm* — Christopher J. Scott

(57) ABSTRACT

A preferred low-profile liquid container lid assembly enables a user to outfit particularized liquid containers for enabling lid-based liquid-pooling or compartmentalization and heat transfer from lid-pooled or lid-compartmentalized liquid prior to liquid egression from a lid-outfitted liquid container prior to liquid consumption. All embodiments provide liquid re-directing or damming structures that operate to control the delivery of hot liquid for promoting heat loss from re-directed liquid flows. Certain structures cooperate with existing art to minimize leakage problems associated therewith. Other structures operate to particularly shape parceled liquid volumes for effecting rapid heat transfers therefrom. Still other structures harness material-philic properties of liquids for further effecting rapid heat transfers and liquid directional control mechanisms. Combinations of the various structural features here noted are also contemplated throughout the following specifications.

13 Claims, 60 Drawing Sheets

Related U.S. Application Data division of application No. 15/044,282, filed on Feb. 16, 2016, now Pat. No. 10,292,512.

(56) References Cited

U.S. PATENT DOCUMENTS

| | | | | |
|---|---|---|---|---|
| 6,176,390 | B1 | 1/2001 | Kemp | |
| 6,488,173 | B2 | 12/2002 | Milan | |
| 6,571,973 | B1 | 6/2003 | Tripsianes | |
| 6,732,875 | B2 | 5/2004 | Smith et al. | |
| 6,732,895 | B2 | 5/2004 | Poliquin et al. | |
| 7,448,510 | B2 | 11/2008 | Pavlopoulos | |
| 8,528,768 | B2 | 9/2013 | D'Amato | |
| 9,114,917 | B1 | 8/2015 | Salem | |
| 9,238,529 | B1 | 1/2016 | Newman | |
| 2002/0074337 | A1 | 6/2002 | Melton | |
| 2003/0089713 | A1 | 5/2003 | Belt et al. | |
| 2006/0113313 | A1 | 6/2006 | Maravich et al. | |
| 2006/0124645 | A1 | 6/2006 | Peitersen | |
| 2006/0180028 | A1 | 8/2006 | Burchard | |
| 2007/0062943 | A1 | 3/2007 | Bosworth | |
| 2009/0108006 | A1 | 4/2009 | Milan | |
| 2010/0264150 | A1 | 10/2010 | Leon et al. | |
| 2010/0320220 | A1 | 12/2010 | Hussey et al. | |
| 2011/0248033 | A1 | 6/2011 | Leach | |
| 2012/0080441 | A1 | 4/2012 | Lin | |
| 2013/0256394 | A1 | 10/2013 | Moutty | |
| 2014/0231419 | A1 | 8/2014 | Vadlamani et al. | |
| 2016/0157646 | A1* | 6/2016 | Savenok ..... | B65D 47/043 220/592.17 |

* cited by examiner

LOW-PROFILE LIQUID CONTAINER LID ASSEMBLY

PRIOR HISTORY

This application is a divisional patent application of pending U.S. patent application Ser. No. 16/413,546 filed in the United States Patent and Trademark Office on 15 May 2019, the specifications and drawings of which are hereby incorporated by reference thereto.

BACKGROUND OF THE INVENTION

Field of the Invention

The present invention relates generally to liquid-cooling lid constructions or container orifice structures for outfitting hot liquid or hot consumable containers. More particularly, the present invention relates to container lid or orifice constructions for outfitting a hot consumable containers for enabling lid-based liquid pooling or compartmentalization and heat transfer from lid-pooled or lid-compartmentalized liquid prior to liquid egression.

Brief Description of the Prior Art

The broad field of lids for hot beverage or liquid consumable containers and hot beverage or consumable container assemblies inclusive of lids is exceedingly well-developed. The art relating to means for cooling hot beverages prior to consumption by way of a lid construction or assembly is a bit more limited. It is difficult to pinpoint with precision the most pertinent art relevant to the present invention given the wide swath of art swept by beverage container constructions and developments in the field of art generally. Nevertheless, some of the more pertinent prior is believed to be briefly described hereinafter.

U.S. Pat. No. 5,873,493 ('493 Patent), issued to Robinson, for example, discloses an Integrally Molded Measurer Dispenser. The '493 Patent describes a closure providing a side wall having first and second distal ends, an inner surface and an outer perimeter. A cone-shaped divider projects inwardly and upwardly from a lower perimeter of the side wall and includes a drain-back orifice therethrough. The cone-shaped divider further includes an apex having an opening therethrough. The closure further provides a lid pivotally attached at an outer diameter thereof to the outer perimeter of the side wall first distal end by an integral hinge. The lid includes a shaped substantially conforming to the side wall perimeter.

U.S. Pat. No. 6,176,390 ('390 Patent), issued to Kemp, discloses a Container Lid with Cooling Reservoir. The '390 Patent describes a container lid with a cooling reservoir for releasably covering a disposable cup containing a hot beverage. The cooling reservoir includes a side wall with a small opening to allow a small volume of the hot beverage to pass into the cooling reservoir in which the beverage sufficiently cools down to enable the consumer to sip the beverage.

U.S. Pat. No. 6,488,173 ('173 Patent), issued to Milan, discloses a Beverage container lid having baffle arrangement for liquid cooling. The '173 Patent describes a removable beverage container lid wherein the lid has a substantially enclosed space defined between an exterior cover and an interior cover. At least one inlet opening is formed in the interior cover directing a hot beverage to flow into the substantially enclosed space.

Attached to the interior cover at the forward edge of the inlet opening is a partition or wall assembly having a height extending to be located substantially against the exterior cover and a length at least equal to the length of the inlet aperture. Between the partition or wall assembly and the peripheral edge of the exterior cover is located a gap area. Connected with the gap area is a dispensing opening formed in the exterior cover. Hot beverage is required to flow around the partition or wall assembly and into the gap area prior to flowing through the dispensing opening exteriorly of a beverage container.

U.S. Pat. No. 6,732,875 ('875 Patent), issued to Smith et al., discloses a Reclosable Container Lid. The '875 Patent describes a reclosable lid for a beverage container comprising a first piece or cover, and a movable second piece or disk. The cover has a top wall, a side wall and a mounting portion for connecting the lid on the container. The cover has an opening adapted to permit the flow of the substance through the lid. The cover further includes a slot located in the top wall. The disk has at least one aperture, a post, and a projection.

The aperture and the projection are each cooperatively dimensioned with the opening. The post is adapted to be received by the slot in the cover. The disk is movable between a first position wherein at least a portion of the projection is received in the opening in the first position, and a second position wherein the aperture is aligned with the opening in the second position. A support ledge and a support edge on an inner surface of the cover are adapted to provide rotatable support to the disk.

U.S. Pat. No. 7,448,510 ('510 Patent), issued to Pavlopoulos, discloses a Cup Assembly having a Cooling Compartment. The '510 Patent describes a cup assembly comprising a cup and a lid to define therebetween a first passage and a second passage to allow a liquid cooling compartment between the lid and the cup to be filled with liquid contained in the cup when the first passage is clear and the second passage is blocked and the liquid in the liquid cooling compartment is able to flow out of an outlet in communication with the liquid cooling compartment when the second passage is clear and the first passage is blocked.

U.S. Pat. No. 8,528,768 ('768 Patent), issued to D'Amato, discloses a Reclosable Lid for a Container. The '768 Patent describes a lid for a paper cup type container. The lid is detachably mountable onto the edge of an opening of the container. The lid comprises a lower lid part with an inner outlet opening, and an upper lid part with an outer outlet opening. In an assembled position, the upper lid part is mounted rotatable relative to the lower lid part between at least two positions, such that the outlet openings are mutually aligned in one position and are without any overlap in the other position. The lower lid part has a circumferential mounting flange for overlapping the opening edge of the container, and the upper lid part has a circumferential mounting flange for overlapping the mounting flange of the lower lid part.

US Patent Application Publication No. 2007/0062943, authored by Bosworth, Sr., describes a container lid for a cup-type beverage which includes within the lid a disc-shaped media in which the lid is adapted to be releasably affixed to the beverage container and where the lid is protected from the beverage within the container and wherein the disc may be removed from the lid and utilized for entertainment purposes.

US Patent Application Publication No. 2010/0264150, authored by Leon et al., describes a disposable beverage cup a disposable beverage cup that comprises a ledge between the cup's rim and the grasping portion of the cup that is commonly held in the user's hand. The ledge, which comprises a curb, a horizontal plane, and one or more indentations, acts as a barrier between the user's hand and other objects, preventing a lid that has been press fit onto the cup's rim from being dislodged. In order to remove the lid, the user must insert a finger and/or thumb into the indentation(s) and press upward on the lid. The cup has a contour between the ledge and the grasping portion with ergonomic features to increase the user's comfort in handling the cup.

US Patent Application Publication No. 2010/0320220, which was authored by Hussey et al., describes a plastic lid for a drink container, for example, a coffee cup. The plastic lid is provided with an ancillary access facility in the form of an opening or a part of the lid easily removable to form an opening. The ancillary access facility allows a person to drink from the container without removal of the lid. After the ancillary access facility has been cleaned or de-contaminated it is protected by the application of a protective cover.

The protective cover may have a variety of shapes, for example, it may cover the entire lid or it may cover only a selected part of the lid, for example, only the area of the lid involving the ancillary access facility. The protective cover protects the ancillary access facility from the inadvertent transfer of germs to the drinking area by the person dispensing the drinks as they push the lid down with their hands to seal the lid to the container top. The protective covers are arranged to be easily stripped from the lid by the application of mere finger pressure.

US Patent Application Publication No. 2011/0127267, authored by Leach, describes a reusable, flexible beverage lid designed to fit various beverage containers. The beverage lid includes a drink through cover portion having a generally circular periphery and a flexible sidewall with a profile enabling sealing against varying dimensioned beverage containers. The shape of the sidewall profile allows the lid to reliably seal and be easily assembled against various beverage containers and is generally consistent circumferentially. The lid design is such that it can be scaled radially to fit a further amount of beverage containers. The import of the Leach application is a flexible/expandable seal for accommodating container rims of differing sizes.

US Patent Application Publication No. 2013/0256394, authored by Moutty, describes a paper cup comprising a sidewall member having an upper edge, a lower edge, a pair of opposite side edges, a front surface and a back surface. Each of the side edges and the upper edge define upper corners. The side edges are overlapped and are sealed together along an overlapping side seam. A bottom member comprises a peripheral lip sealed to the lower edge of the sidewall member. The Moutty paper cup construction is remarkable in that it further comprises at least one rigid or semi-rigid rim structure attached to the upper edge of the side wall member and in that the paper weight of the bottom member is greater than the paper weight of the sidewall member.

US Patent Application Publication No. 2014/0231419, authored by Vadlamani et al. describes certain food product embodiments comprising both a consumable container and/or a microwavable food container in combination with a food composition. The containers may include a bottom wall and a side wall, which bottom wall may include a microwave reflector, while the side wall may include a material that is substantially transparent to microwaves. The microwave reflector can cover at least about 80 percent of the surface area of the bottom wall.

From a consideration of the foregoing, it will be noted that the prior art perceives a need for low cost container lid constructions usable in combination with so-called soup on the go type containers, as well as other relatively generic liquid containers for enabling users to compartmentalize liquid within lid-based compartments for effecting heat transfers from lid-compartmentalized liquid prior to liquid egression from a primary liquid outlet. More particularly, the prior art perceives a need for a series of lid constructions defining a liquid container orifice assembly, various liquid container lid assemblies, and at least one unibody lid construction as summarized in more detail hereinafter.

SUMMARY OF THE INVENTION

The primary objective of this invention is the provision of a number liquid container lid constructions for enabling lid-based liquid pooling or compartmentalization and heat transfer from lid-pooled or lid-compartmentalized liquid prior to liquid egression from a lid-outfitted liquid container. To achieve this and other readily identifiable objectives, the present invention provides a number of different embodiments of container lid constructions for variously effecting heat transfers from lid-compartmentalized liquid prior to liquid egression from an outfitted container for safer liquid consumption.

To achieve these and other readily apparent objectives, the basic inventions may be said to essentially teach or disclose a liquid container orifice assembly usable in combination with a liquid container or a combination liquid container assembly inclusive of the orifice assembly. The liquid container usable in combination with the orifice assembly may preferably and essentially comprise a container wall, an upper container ridge, and an inwardly extending peripheral flange seat. The inwardly extending peripheral flange seat preferably extends radially inwardly from the container wall in inferior adjacency to the upper container ridge, and the container wall inherently comprises outer wall surfacing.

The liquid container orifice assembly may be said to preferably comprise at least a container lid, which container lid may be said to further preferably and essentially comprise certain lid-to-container fastening means and a primary liquid outlet. The lid-to-container fastening means essentially function to removably fasten the container lid to the liquid container such that portions of said lid-to-container fastening means simultaneously engage the inwardly extending peripheral flange seat and the outer wall surfacing.

The lid-to-container fastening means thus function to seal the container lid to the liquid container at (a) a first, flange seal site, which seal site is essentially a horizontal, annular seal; and (b) a second, wall seal site, which seal site is essentially a vertical, annular seal. The dual action of the first and second seal sites provides optimal lid-to-container fastening means.

The liquid container orifice assembly according to the present invention may be said to further comprise in combination a damming insert for enabling liquid pooling and heat transfer from lid-pooled liquid prior to liquid egression. The damming insert is receivable intermediate the liquid container and the container lid and preferably and essentially comprises a liquid-pooling central portion; a liquid-letting inlet; and an outwardly extending peripheral seat flange.

The outwardly extending peripheral seat flange is seatable upon the inwardly extending peripheral flange seat for selectively positioning the liquid-letting inlet in inferior adjacency to the container lid. The damming insert thereby forms an upper liquid-cooling compartment, and a lower liquid-containing compartment and is operable to direct liquid into the liquid-pooling central portion via the liquid-letting inlet for enabling heat transfer therefrom prior to outletting through the primary liquid outlet of the container lid.

The container lid according to the present invention may be said to further preferably and essentially comprise an upper lid plane, and the inwardly extending peripheral flange seat preferably extends in a first seat plane. The outwardly extending peripheral seat flange preferably extends in a second seat plane, which second seat plane is preferably parallel to and intermediate the first seat plane and the upper lid plane.

Further, the primary liquid outlet may preferably extend in an outlet plane, which outlet plane is preferably parallel to and intermediate the upper lid plane and the first seat plane, while the second seat plane is preferably parallel to and intermediate the first seat plane and the outlet plane. The outwardly extending peripheral seat flange may be either continuous or discontinuous. The liquid-letting inlet preferably extends downwardly form the discontinuous, outwardly extending peripheral seat flange, or in inferior adjacency to the continuous, outwardly extending peripheral seat flange.

The liquid-pooling central portion comprises a vertically arcuate transverse cross-section for directing and pooling liquid prior to outletting through the primary liquid outlet. The vertically arcuate transverse cross-section is preferably downwardly bowed or concave relative to the container lid for directing and pooling liquid centrally. The damming insert may further preferably comprise at least one air-letting inlet, which air-letting inlet is preferably formed opposite the liquid-letting inlet for enabling pressure equalization via the damming insert between the upper liquid-cooling compartment and the lower liquid-containing compartment.

The upper container ridge and the container lid may preferably comprise differing material constructions, which differing material constructions each having unique thermal expansion properties. In this regard, the lid-to-container fastening means of the container lid are operable to removably fasten the container lid to the liquid container such that portions of said fastening means resiliently and simultaneously engage the upper container ridge radially inwardly and radially outwardly for maintaining engagement with the upper container ridge during thermal expansion events.

It is contemplated that the foregoing basically embraces or encapsulates the concepts disclosed in connection with what are referred to as "soup on the go" embodiment(s) whereby a key improvement is a lid construction that cooperates with the state of the art liquid container for minimizing leakage during liquid consumption events. The lid construction is further usable in combination with the damming insert element, which insert is seatable upon the flange seat for enabling liquid pooling within the ensemble.

It is further contemplated that an alternative orifice assembly may be provided that combines structural features of a "soup-on-the-go" type container and a damming insert construction for attachment to a more generic liquid container. In this regard, it is contemplated that the liquid container orifice structure according to the present invention primarily enables liquid pooling and heat transfer from lid-pooled liquid prior to liquid egression.

The liquid container orifice structure is receivable intermediate a liquid container and a container lid and preferably comprises a liquid-pooling central portion, a liquid-letting inlet, and a peripheral rim-engaging structure as exemplified, in part, by a rim-receiving annular (aluminum) ring element and an annular or O-ring section or portion. The peripheral rim-engaging structure is engageable with an upper container rim of the liquid container for selectively positioning the liquid-letting inlet in inferior adjacency to the container lid.

The liquid container orifice structure thereby forms an upper liquid-cooling compartment and a lower liquid-containing compartment and is operable to direct liquid into the liquid-pooling central portion via the liquid-letting inlet for enabling heat transfer from the pooled liquid prior to outletting or egressing through a primary liquid outlet of the container lid.

The peripheral rim-engaging structure may preferably comprise an upper-outer peripheral ring element and a lower-inner peripheral flange seat. The upper-outer peripheral ring element may preferably extend in a ring plane, while the lower-inner peripheral flange seat preferably extends in a first seat plane. Noting that the primary liquid outlet extends in an outlet plane parallel to the first seat plane, the ring plane is preferably parallel to and intermediate the first seat plane and the outlet plane.

The alternative liquid container orifice structure is usable in combination with the container lid such that the upper-outer peripheral ring element and the container lid may preferably comprise differing material constructions, which differing material constructions each have unique thermal expansion properties. The container lid preferably comprises certain lid-to-container fastening means operable to removably fasten the container lid to the liquid container such that portions of said lid-to-container fastening means resiliently engage the upper-outer peripheral ring element radially inwardly and radially outwardly for maintaining engagement with the upper-outer peripheral ring element during thermal expansion events as previously discussed.

The lid-to-container fastening means may removably fasten the container lid to the liquid container such that portions of said lid-to-container fastening means further simultaneously engage the lower-inner peripheral flange seat for forming a flange seal site. Further, the lid-to-container fastening means may removably fasten the container lid to the liquid container such that portions of said lid-to-container fastening means further simultaneously engage outer wall surfacing of the liquid container for forming a wall seal site.

In certain other alternative embodiments, the basic invention may be said to essentially teach or disclose a liquid container lid assembly for enabling liquid pooling and heat transfer from lid-pooled liquid prior to liquid egression. Certain alternative lid assemblies may be said to essentially and preferably comprise a lower lid construction and an upper lid construction. The lower lid constructions may preferably comprise certain lid-to-container fastening means as exemplified by a state of the art rim-receiving groove; a centralized, liquid-collecting or liquid-pooling pan portion as variously exemplified; and at least one (liquid- and/or air-) letting aperture as various exemplified.

The lid-to-container fastening means essentially function to removably fasten the lower lid construction to a generic liquid container. The centralized, liquid-collecting portions preferably comprise upper portion surfacing. The upper lid construction(s) are nestable or receivable atop the lower lid construction(s) and preferably comprise a centralized, liquid-opposing or pan-opposing portion and a primary liquid outlet. The liquid-opposing or pan-opposing portion(s) comprise lower portion surfacing. The upper and lower portion surfacing of the lower and upper lid constructions compartmentalize, or receive and shape a liquid volume received therebetween.

In certain alternative embodiments, the liquid container lid assemblies may comprise upper and lower portion surfacing that mimic one another. In other words, each of the upper and lower portion surfaces may comprise surfacing-mimicking contours for similarly and simultaneously shaping the liquid volume in both upward and downward directions. More particularly, the upper and lower surfacing may be preferably spaced from one another such that liquid adherence to both the upper and lower surfacing is evidenced during liquid pooling events, which liquid adherence enhances heat transfer from the liquid volume. The vertical transverse cross-sections of the surface-mimicking contours may be either (a) vertically arcuate or more particularly downwardly bowed for providing a concavely shaped liquid volume relative to the upper lid constructions or (b) vertically planar.

The upper lid construction(s) are preferably rotatably nestable or receivable atop the lower lid construction(s) for enabling a user to rotate the upper lid constructions about lid axes of rotation relative to the lower lid construction(s) for selectively orienting the primary lid outlet(s) in superior adjacency to at least one liquid-letting aperture, preferably formed at edging of the liquid-collecting portion(s). The upper lid constructions may optionally comprise a transparent material for enabling a user to visually perceive the liquid volume collected at the centralized, liquid-collecting portion and thereby enhancing a user's ability to control liquid flows into the cavities.

The lower lid constructions may preferably comprise edge-receiving grooves or radial grooves and the upper lid construction may preferably comprises outer edging, which outer edging is rotatably received in the edge-receiving groove(s) for rotatably attaching the upper lid construction(s) to the lower lid construction(s). Certain manually engageable protrusions knob-like structures may aid the user in manual rotation of the upper lid construction(s) relative to the lower lid construction(s).

Certain upper lid construction(s) may preferably comprise a volume-forming or volume-shaping portion, which volume-forming portions provide a liquid-receiving cavity in inferior adjacency to the lower portion surfacing. The liquid-receiving cavities are preferably in communication with the primary lid outlet(s) for outletting portions of the liquid volume from the liquid-receiving cavities. In certain alternative embodiments, the lower lid constructions may preferably comprise an annular support seat while the upper lid constructions may preferably comprise an annular support portion. The annular support portions are preferably seatable atop the annular support seats. The volume-forming portion and liquid-receiving cavity formed thereby may preferably traverse the upper lid construction intermediate opposed portions of the annular support portion.

Certain alternative embodiment further provide upper lid constructions having an upper vertical offset while the lower lid constructions comprise a lower vertical offset. The upper vertical offsets may preferably extend orthogonally from the annular support portions and the lower vertical offsets may preferably extend orthogonally from the annular support seats. The upper and lower vertical offsets are preferably dimensioned for frictionally engaging one another and enhancing fitted relationship between the upper and lower lid constructions. The upper and lower vertical offsets may optionally comprise differently shaped geometries for frictionally and selectively engaging one another thereby enhancing the fitted relationship between the upper and lower lid constructions.

A select lid construction as selected from the group consisting of the upper lid construction and the lower lid construction may preferably comprise laterally-opposed, cavity-defining conformation sections. When formed as part of the upper lid construction, the laterally-opposed, cavity-defining conformation sections are, for example, "upper-to-lower" conformation sections for conforming to the upper portion surfacing of the lower lid constructions for eliminating space between the upper and lower lid constructions and directing the liquid volume into the liquid-receiving cavity.

Stated another way, the alternative liquid container lid assemblies according to the present invention basically function to enable liquid pooling and heat transfer from lid-pooled liquid prior to liquid egression. To achieve these primary objectives, the various alternative lid assemblies may be said to preferably and essentially comprise a lower lid construction as variously exemplified and an upper lid construction as various exemplified.

The lower lid constructions may all be said to comprise certain lid-to-container fastening means and a liquid-collecting pan portion, which liquid-collecting pan portions each preferably further comprise at least one liquid-letting aperture as various exemplified. The lid-to-container fastening means removably fasten the lower lid constructions to upper container rims of liquid containers. The upper container rims extend in rim planes, and the liquid-collecting pan portions variously comprise upper portion surfacing.

The upper lid constructions are nestable atop and within the lower lid constructions and each preferably comprise a liquid-opposing or pan-opposing portion and a primary liquid outlet. The liquid-opposing or pan-opposing portions comprise variously exemplified lower portion surfacing. The upper and lower portion surfacing together defining a liquid-receiving cavity or compartment when the upper lid constructions are nested or received atop and within the lower lid constructions. The liquid-receiving cavities receive and shape a liquid volume receivable therein via the at least one liquid-letting apertures. The primary lid outlets are orientable in superior adjacency the lower lid construction for outletting portions of the liquid volume via the primary liquid outlets.

The upper and lower surfacing are spaced from one another such that liquid adherence to both the upper and lower surfacing is evidenced during liquid pooling events, the liquid adherence for enhancing heat transfer from the liquid volume. The lid-to-container fastening means, may, in certain embodiments, be preferably situated in superior adjacency to the liquid-collecting pan portion. The liquid container lid assemblies thereby define certain upper lid-to-container fastening means juxtaposed in superior adjacency to a lower liquid-collecting pan portion.

In certain embodiments, the lid-to-container fastening means and the upper container rim are substantially coplanar in the rim plane. The upper lid constructions of such embodiments may each preferably comprise an upper extent extending in an upper extent plane such that the upper extent plane is substantially parallel and inferior to the container rim plane. The lower liquid-collecting pan portion may preferably comprise a downwardly extending pan wall and the liquid container may preferably comprise a container wall.

The variously exemplified pan walls and the container walls may preferably be spaced from one another such that liquid adherence to both the container wall and pan wall is evidenced during liquid directing events. This liquid adherence enhances heat transfer and liquid direction into the liquid-receiving cavities. In this last regard, the pan wall and the container wall extend in opposing planes such that the angle therebetween are critically ±15° from one another and preferably substantially parallel for enhancing liquid adherence properties therebetween.

The lid-to-container fastening means may radially and uniformly extend about a first lid axis, and the pan construction may radially and uniformly extend about a second lid axis. The second lid axis preferably extends parallel to and anterior to the first lid axis thereby defining a pan axis of rotation for enabling the user to rotatably open and close the liquid container lid assembly.

In certain alternative embodiments, the lid-to-container fastening means as exemplified by a state of the art rim-receiving groove may preferably be situated in inferior adjacency to the liquid-collecting pan portion(s). The liquid container lid assemblies thereby define lower lid-to-container fastening means relative to upper liquid-collecting pan portions. This is the case in all domed embodiments.

Building upon these concepts, the liquid container lid construction enables liquid compartmentalization and heat transfer from lid-compartmentalized liquid prior to liquid egression. The lid construction may be said to preferably and essentially comprise certain lid-to-container fastening means; a pocket-defining façade structure; and at least one, but preferably a series of circumferentially spaced, compartment-to-pocket liquid-letting portal.

The lid-to-container fastening means may be exemplified by a state of the art rim-receiving groove for removably fastening the lid construction to an upper container rim of a liquid container for forming a primary liquid-containing compartment. The radially-inner, pocket-defining façade structure extends from the lid-to-container fastening means and engages a container wall for forming a secondary liquid-containing pocket. The pocket-defining façade structure preferably comprises a primary liquid outlet.

Each compartment-to-pocket liquid-letting portal communicates the primary liquid-containing compartment and the secondary liquid-containing pocket for letting liquid into the secondary liquid-containing pocket from the primary liquid-containing compartment. The pocket-defining façade structure is preferably spaced from the container wall for enabling liquid adherence to both the façade structure and the container wall. The liquid adherence enhances heat transfer prior to liquid egression via the primary liquid outlet for consumption.

Other secondary objects of the present invention, as well as particular features, elements, and advantages thereof, will be elucidated or become apparent from, the following brief descriptions of the drawings and the accompanying drawing figures.

BRIEF DESCRIPTIONS OF THE DRAWINGS

Other features and objectives of my invention will become more evident from a consideration of the following brief descriptions of patent drawings.

Figure 14:
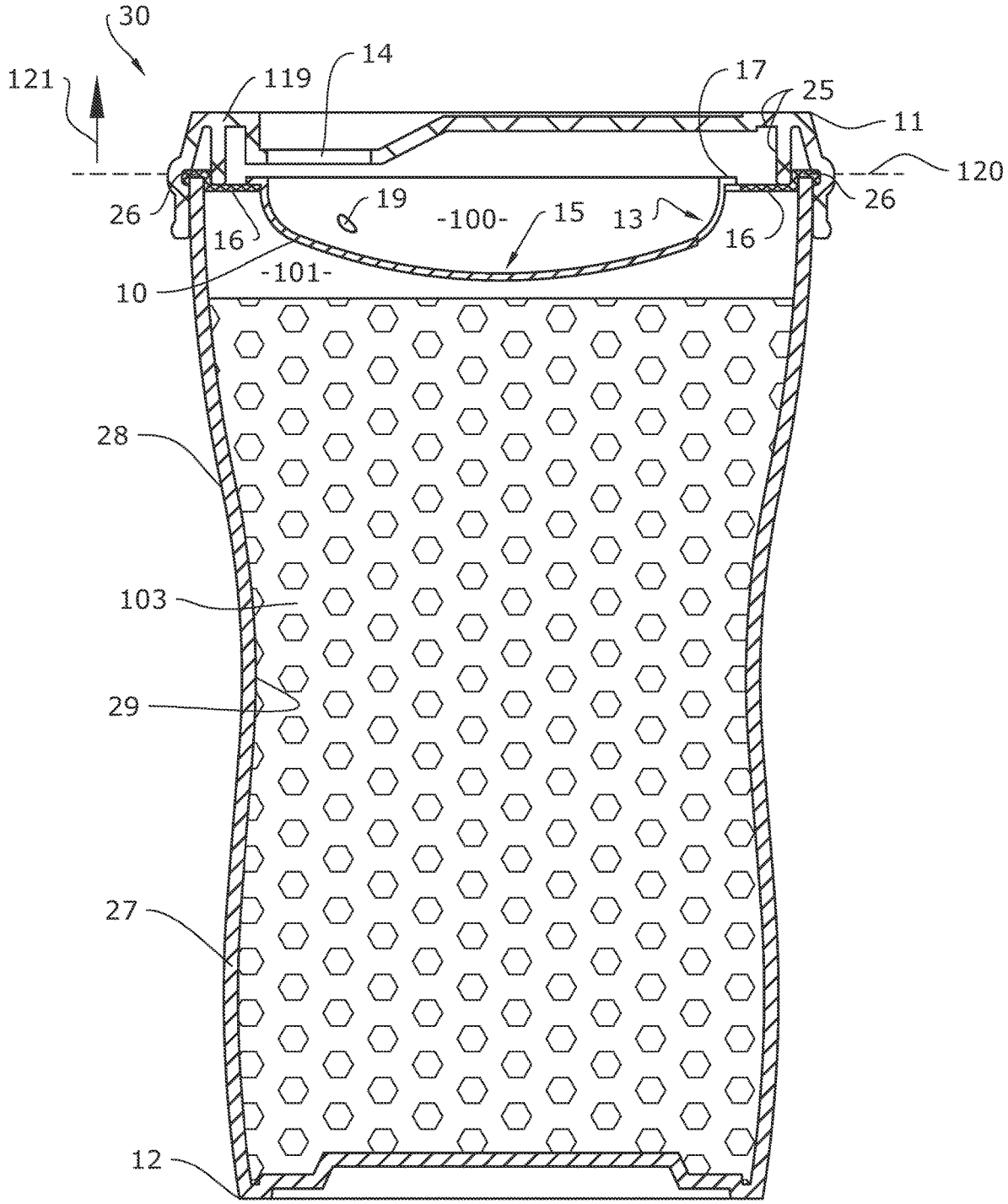

FIG. 14 is a first sequential view of an enlarged longitudinal cross-sectional vertical view of the first alternative container assembly according to the present invention depicted in assembled relation with the upper container lid, the lower liquid container and the damming insert received intermediate the upper container lid and lower liquid container thereby providing an upper, liquid-cooling compartment and a lower, liquid-containing compartment in the first, liquid-cooling position of use.

Figure 15:
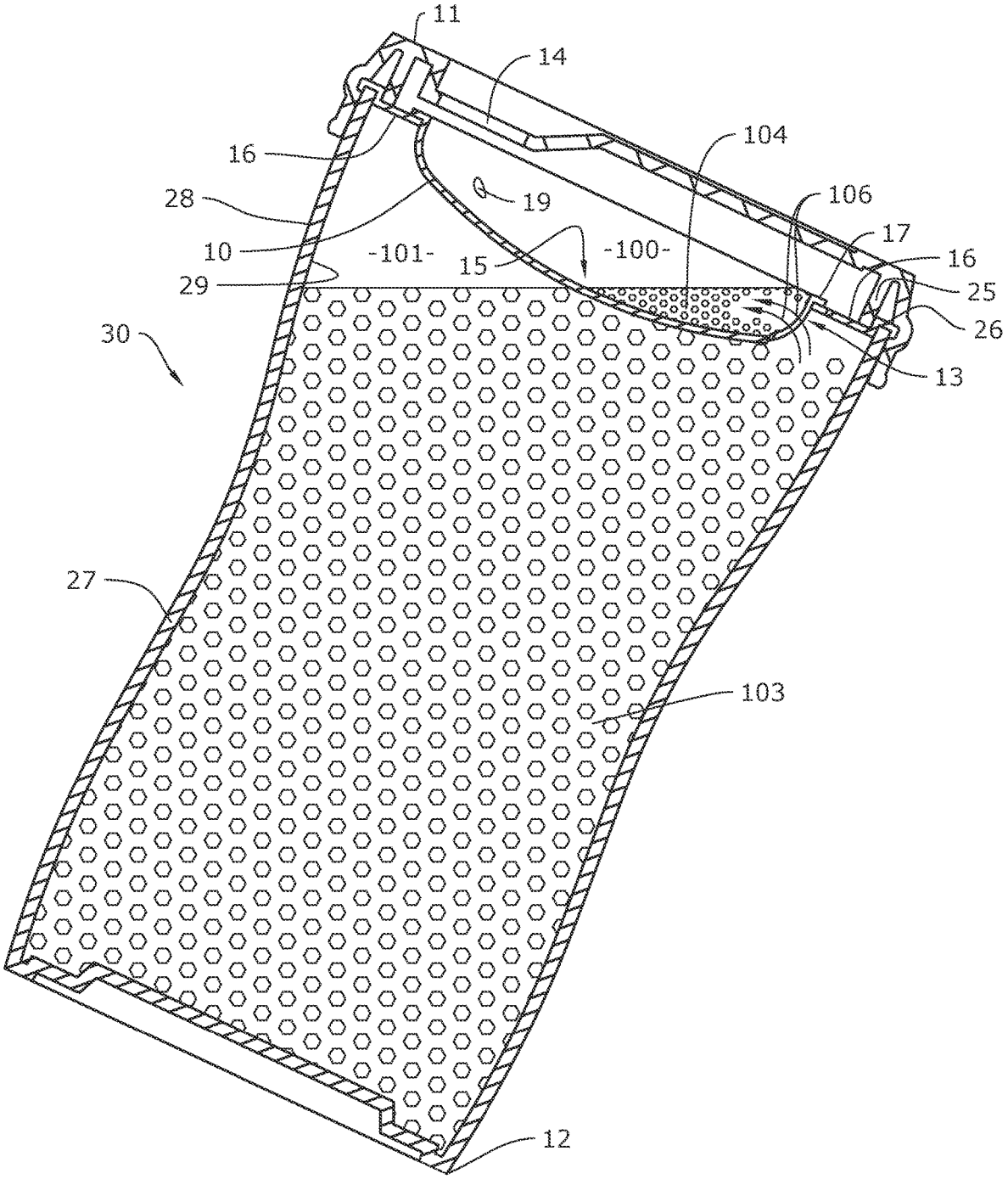

FIG. 15 is a second sequential view of an enlarged longitudinal cross-sectional "angled-to-the-right" view of the first alternative container assembly according to the present invention depicted in assembled relation with the upper container lid, the lower liquid container and the damming insert received intermediate the upper container lid and lower liquid container in the first, liquid-cooling position of use with a liquid volume being directed from the lower, liquid-containing compartment into the upper, liquid-cooling compartment.

Figure 16:
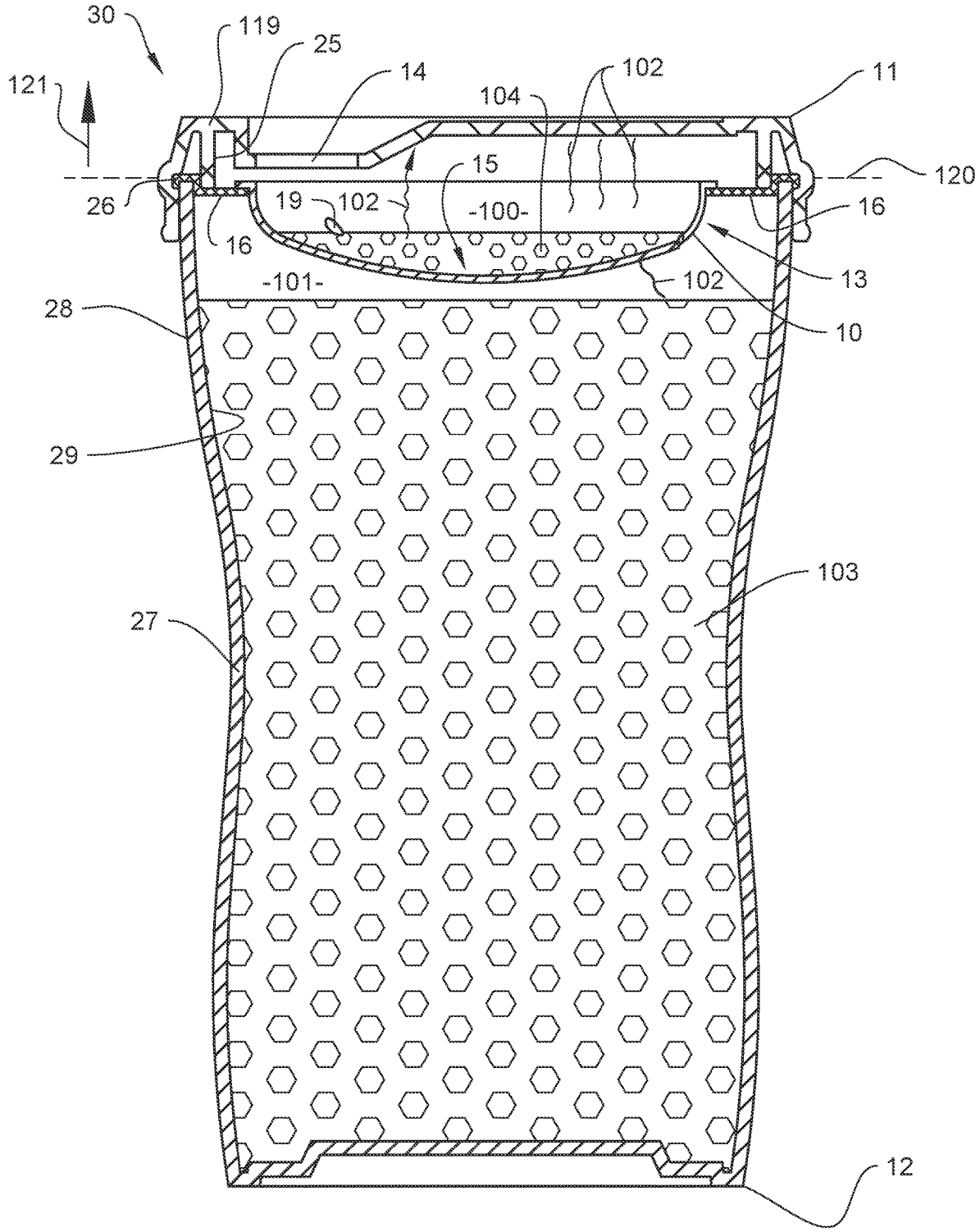

FIG. 16 is a third sequential view of an enlarged longitudinal cross-sectional vertical view of the first alternative container assembly according to the present invention depicted in assembled relation with the upper container lid, the lower liquid container and the damming insert received intermediate the upper container lid and lower liquid container in the first, liquid-cooling position of use with a liquid volume received in the upper, liquid-cooling compartment.

Figure 17:
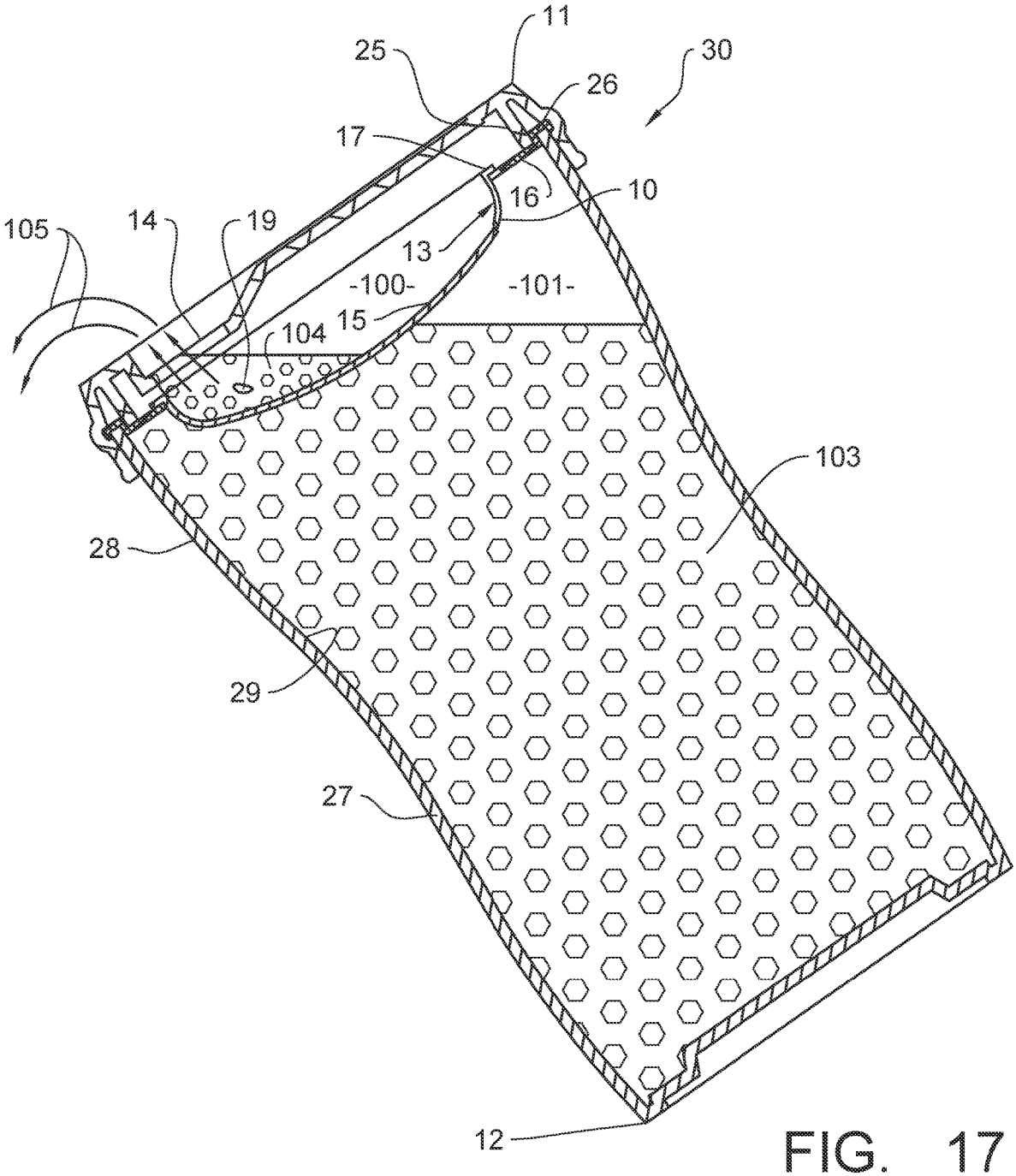

FIG. 17 is a fourth sequential view of an enlarged longitudinal cross-sectional "angled-to-the-left" view of the first alternative container assembly according to the present invention depicted in assembled relation with the upper container lid, the lower liquid container and the damming insert received intermediate the upper container lid and lower liquid container in the first, liquid-cooling position of use with a liquid volume being directed from the upper, liquid-cooling compartment via a primary liquid outlet of the container lid for consumption.

Figure 18:
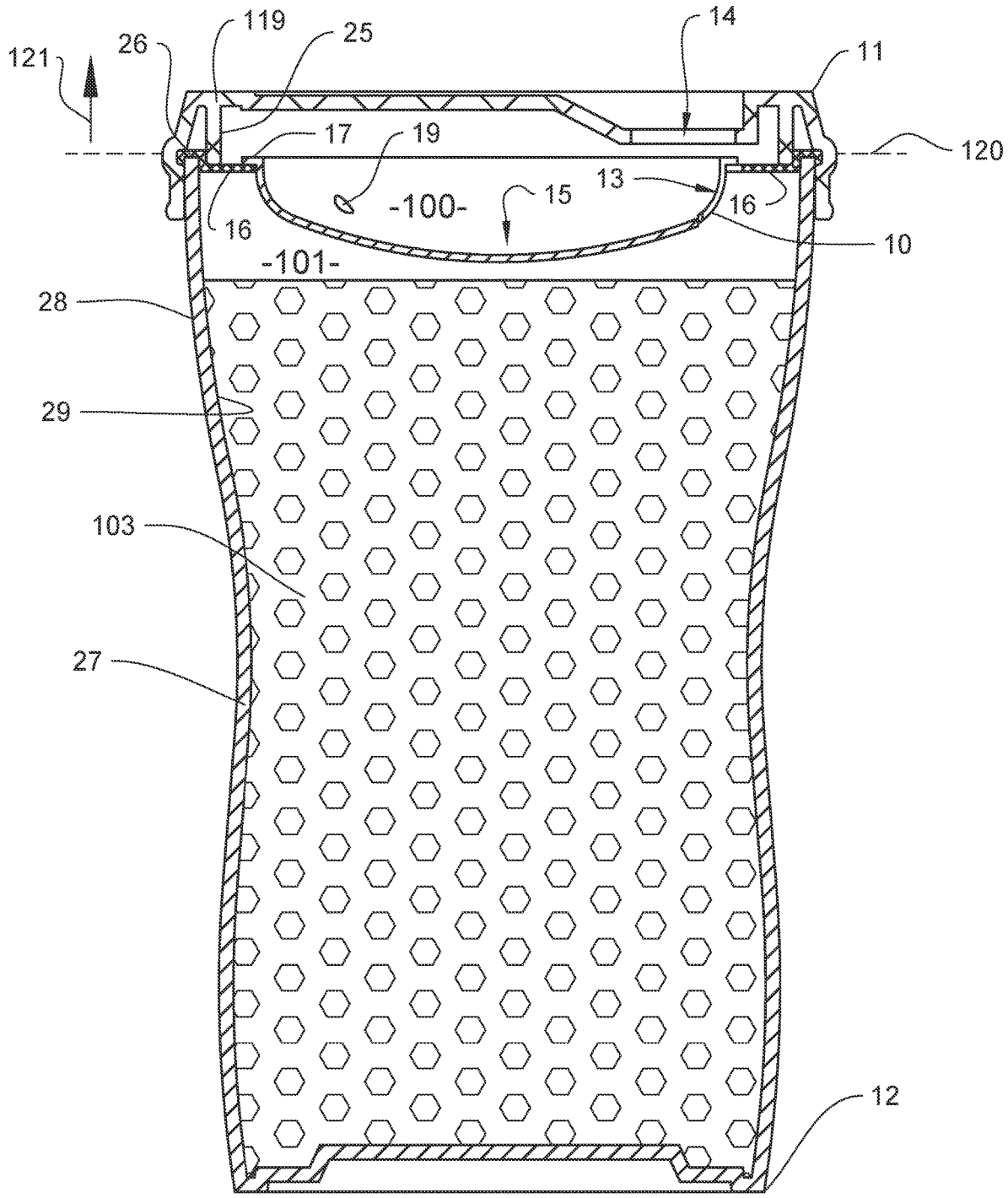

FIG. 18 is a first sequential view of an enlarged longitudinal cross-sectional vertical view of the first alternative container assembly according to the present invention depicted in assembled relation with the upper container lid, the lower liquid container and the damming insert received intermediate the upper container lid and lower liquid container thereby providing an upper, liquid-cooling compartment and a lower, liquid-containing compartment in the second, "direct access" position of use.

Figure 19:
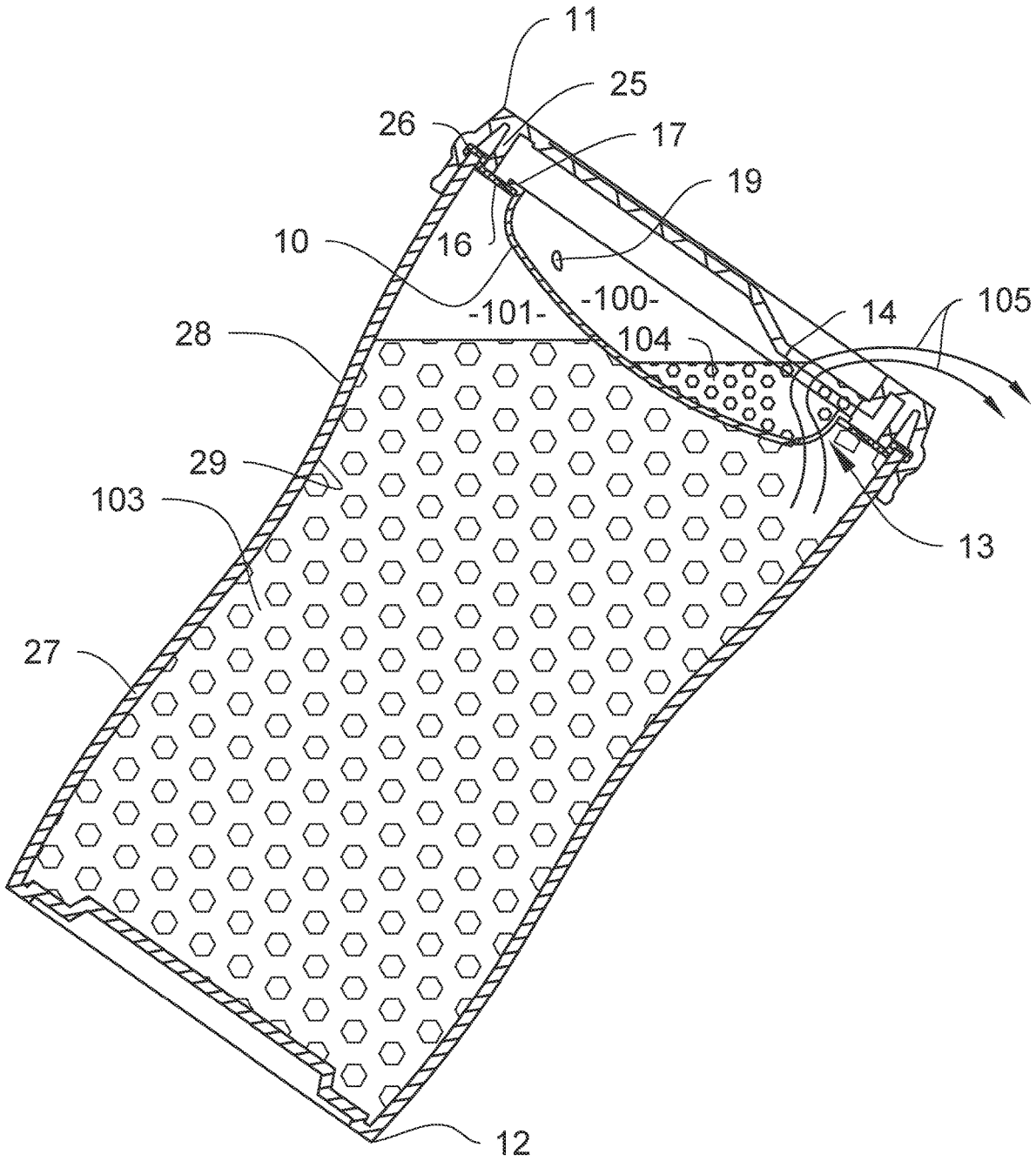

FIG. 19 is a second sequential view of an enlarged longitudinal cross-sectional "angled-to-the-right" view of the first alternative container assembly according to the present invention depicted in assembled relation with the upper container lid, the lower liquid container and the damming insert received intermediate the upper container lid and lower liquid container in the second, "direct access" position of use with a liquid volume being directed from the lower, liquid-containing compartment through the upper, liquid-cooling compartment and directly out the primary liquid outlet.

Figure 20B:
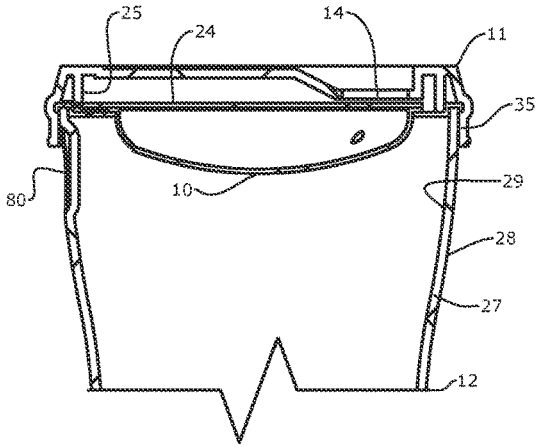
Figure 20A:
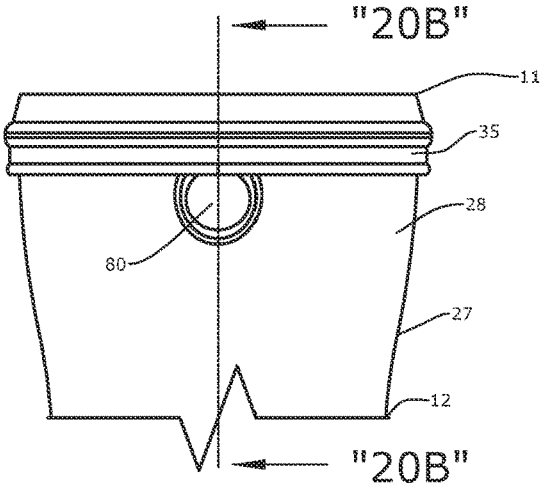
Figure 20:
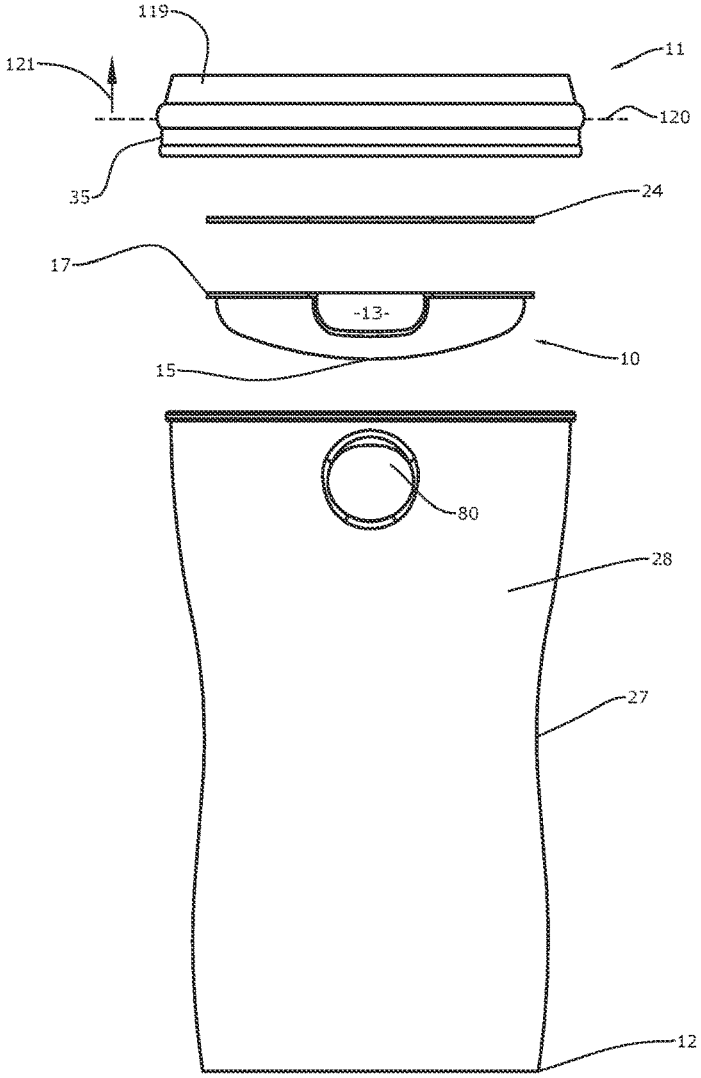

FIG. 20 is an exploded side view of the first alternative container assembly according to the present invention showing from top to bottom, an upper container lid, an optional insert cover or seal element, a damming insert, and a lower liquid container with optional indentation.

FIG. 20A is an assembled anterior view of the first alternative container assembly according to the present invention showing the upper container lid assembled with a fragmentary upper portion of the lower liquid container with optional indentation.

FIG. 20B is a medial longitudinal cross-sectional view of the first alternative container assembly according to the present invention as sectioned from FIG. 20A to show from top to bottom the upper container lid, optional insert cover or seal element, damming insert, and lower liquid container with optional indentation in assembled relation to one another.

Figure 21:
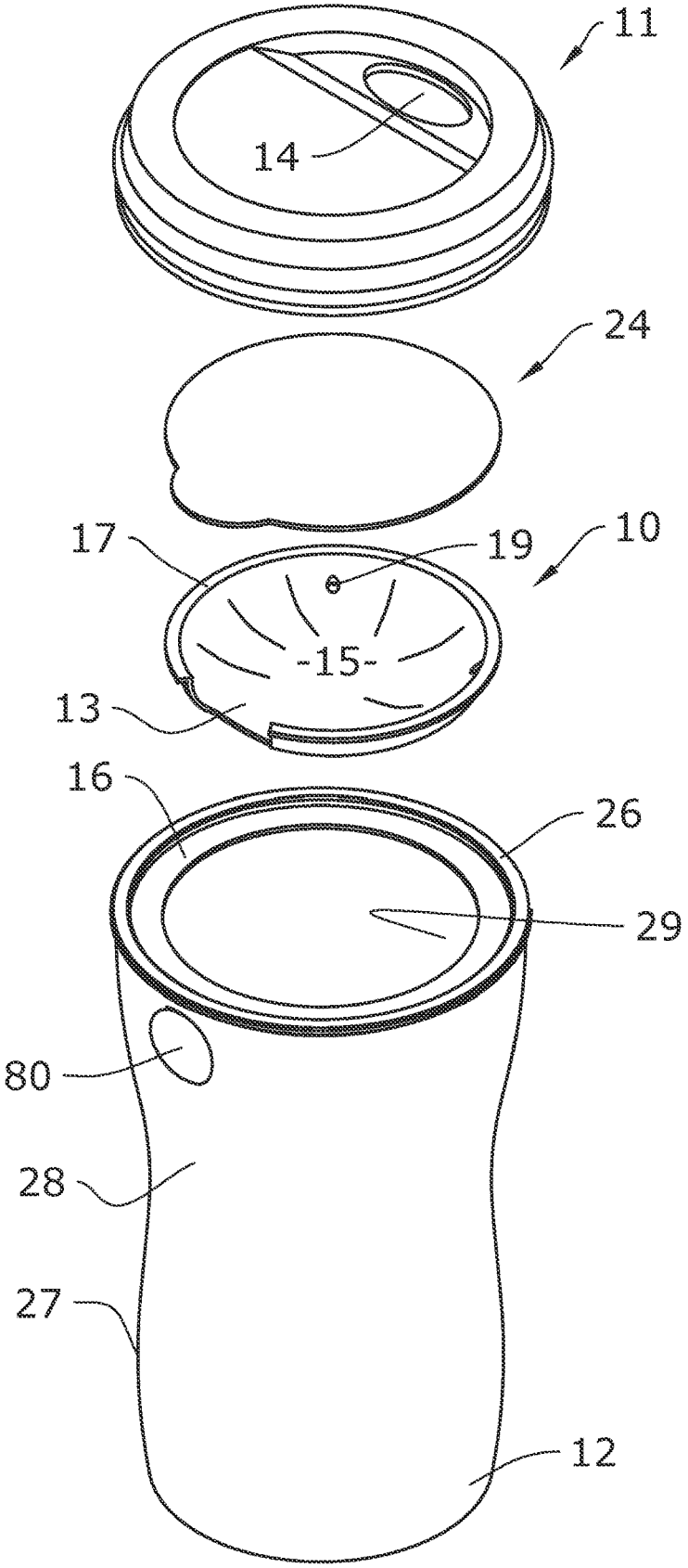

FIG. 21 is an exploded top perspective view of the first alternative container assembly according to the present invention showing from top to bottom, the upper container lid, the optional insert cover or seal element, the damming insert, and the lower liquid container with optional indentation in the first, liquid-cooling position of use.

Figure 22:
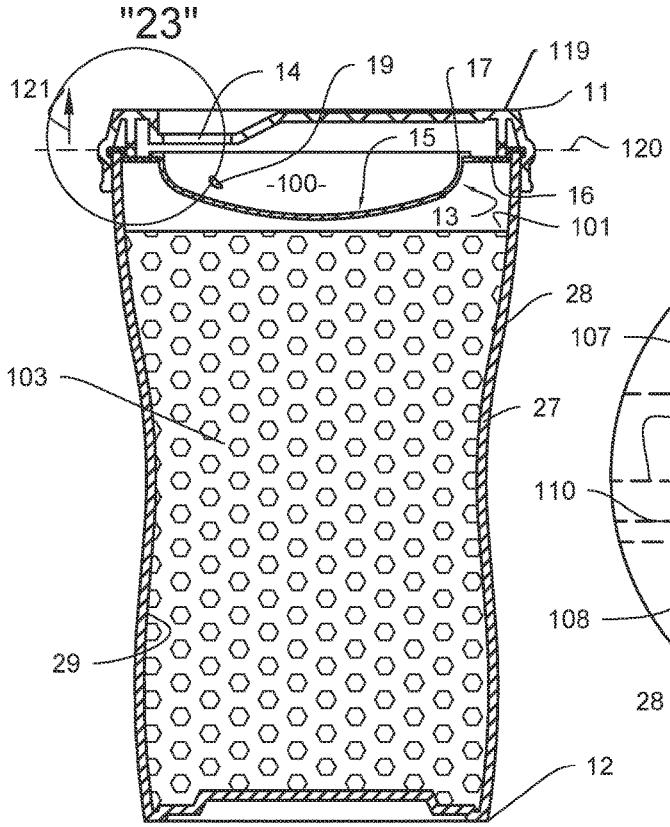

FIG. 22 is a longitudinal cross-sectional vertical view of the first alternative container assembly according to the present invention in the first, liquid-cooling position of use.

Figure 23:
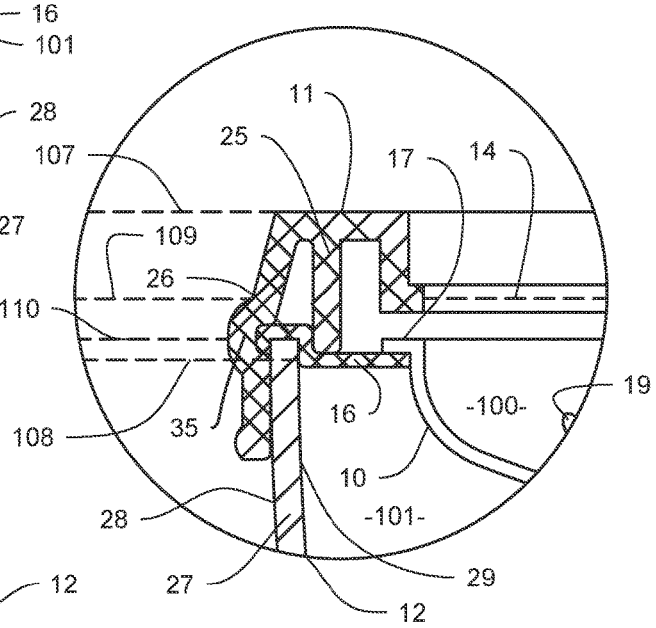

FIG. 23 is an enlarged, fragmentary sectional view as sectioned from the upper left portions the first alternative container assembly according to the present invention otherwise depicted in FIG. 22 to show in greater detail features of the junction site of the upper container lid, lower liquid container and intermediate damming insert.

Figure 24:
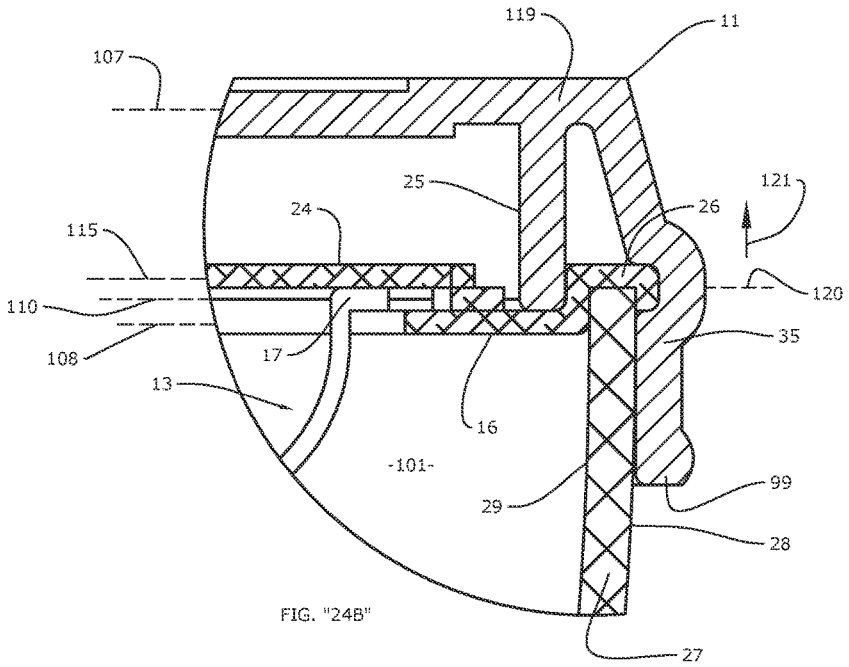
Figure 24:
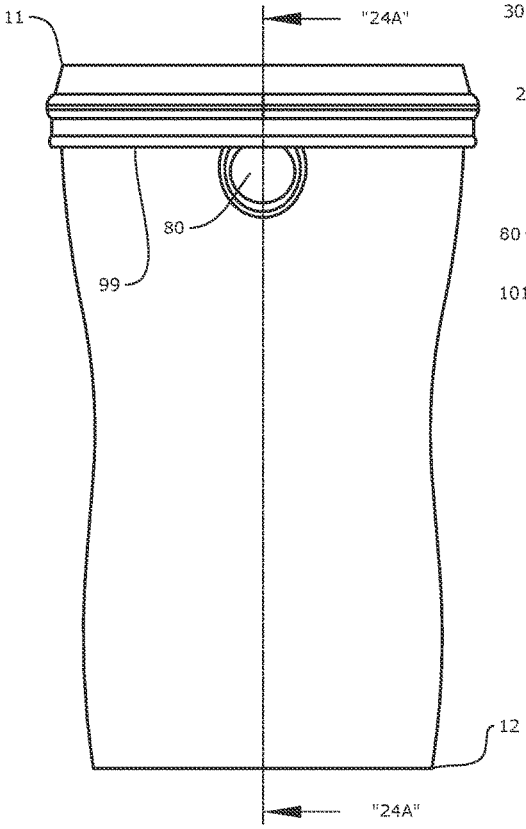

FIG. 24 is an elevational anterior view of the first alternative container assembly according to the present invention with optional container-based indentation at the lid-to-container junction layer for enabling a user to manually engage the container lid from lower lid shroud end of the container lid.

Figure 24A:
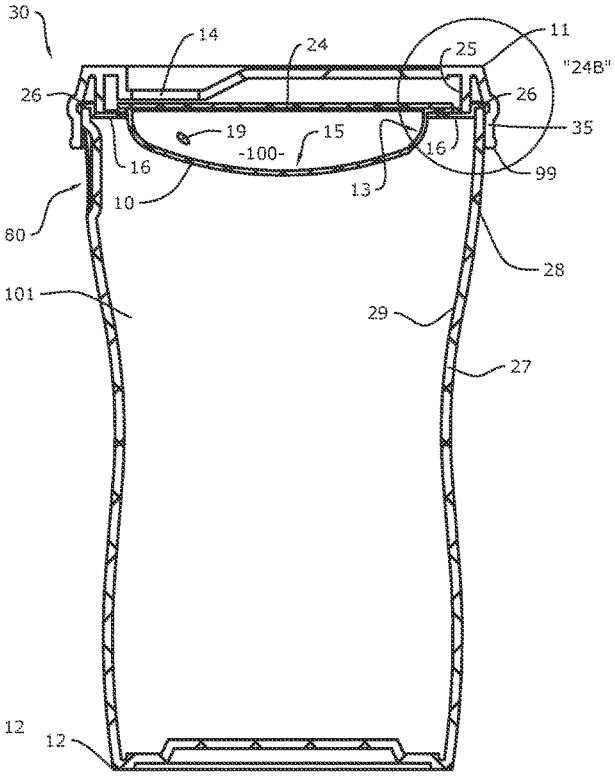

FIG. 24A is a medial longitudinal sectional view of the first alternative container assembly according to the present invention as sectioned through the optional container-based indentation otherwise depicted in FIG. 24.

FIG. 24B is an enlarged, fragmentary sectional view of the upper right portions of the first alternative container assembly according to the present invention as sectioned from FIG. 24A to show in greater detail features of the junction site at the upper container lid, the lower liquid container, the intermediate damming insert, and insert cover or seal element.

Figure 24E:
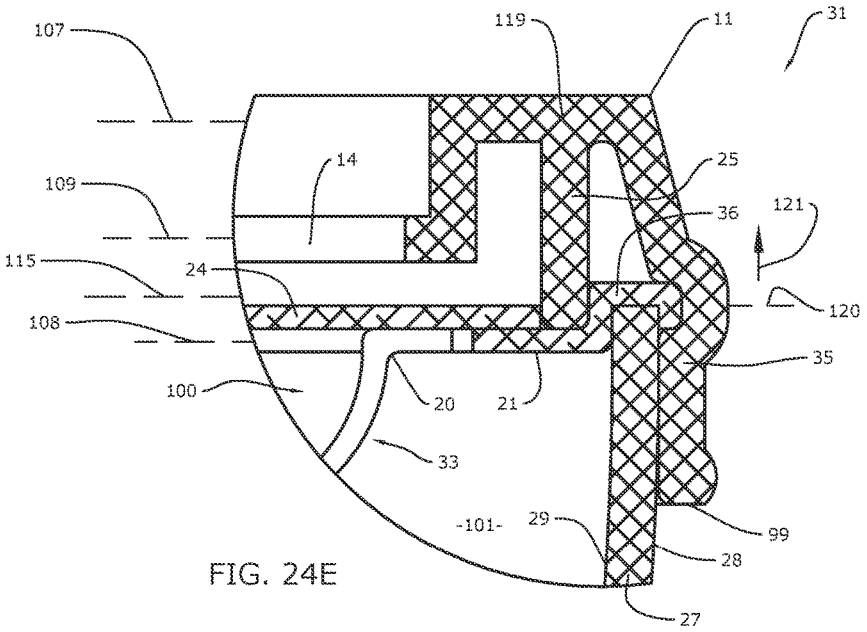
Figure 24C:
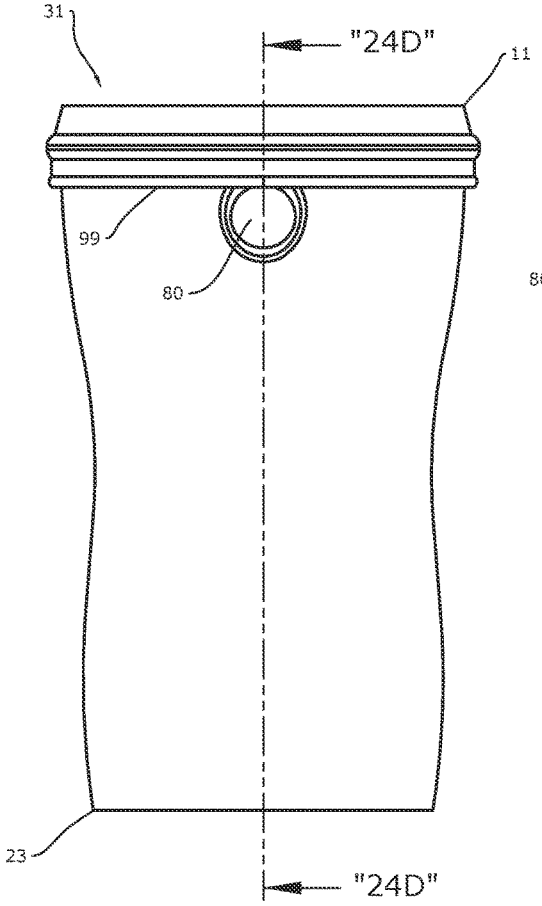

FIG. 24C is an elevational anterior view of the second alternative container assembly according to the present invention with optional container-based indentation at the lid-to-container junction layer for enabling a user to manually engage the container lid from lower lid shroud end of the container lid.

Figure 24D:
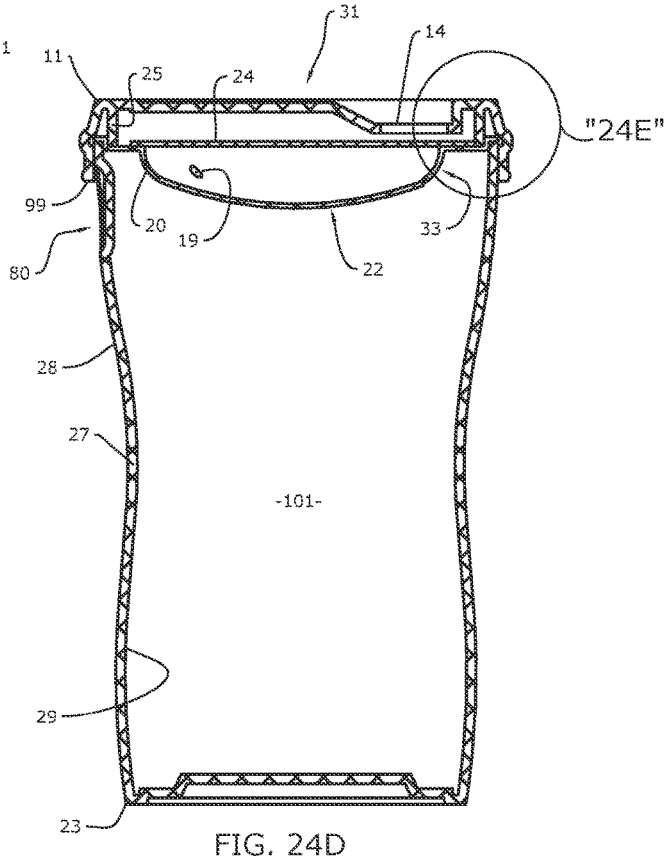

FIG. 24D is a medial longitudinal sectional view of the second alternative container assembly according to the present invention as sectioned through the optional container-based indentation otherwise depicted in FIG. 24C.

FIG. 24E is an enlarged, fragmentary sectional view of the upper right portions of the second alternative container assembly according to the present invention as sectioned from FIG. 24D to show in greater detail features of the junction site at the upper container lid, the lower liquid container, the intermediate orifice structure, and orifice structure cover.

Figure 25:
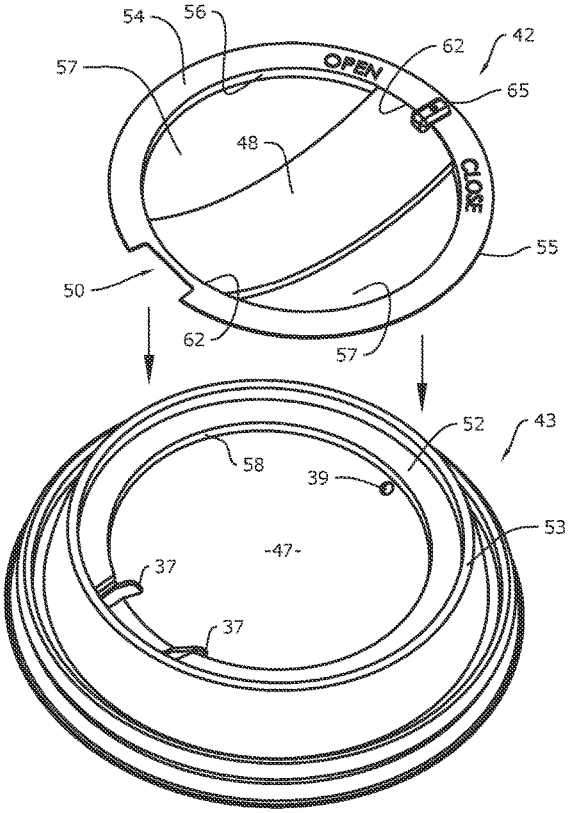

FIG. 25 is an exploded top perspective view of a first alternative lid assembly according to the present invention showing from top to bottom an upper lid construction and a lower lid construction in a first open position of use.

Figure 26:
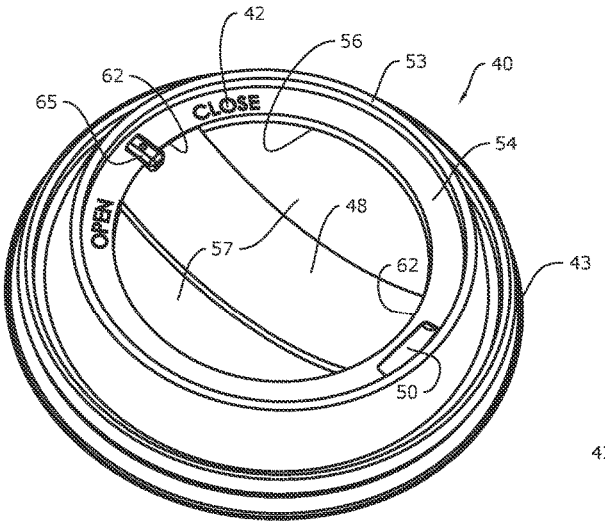

FIG. 26 is a top perspective view of the first alternative lid assembly according to the present invention in the first open position of use.

Figure 27:
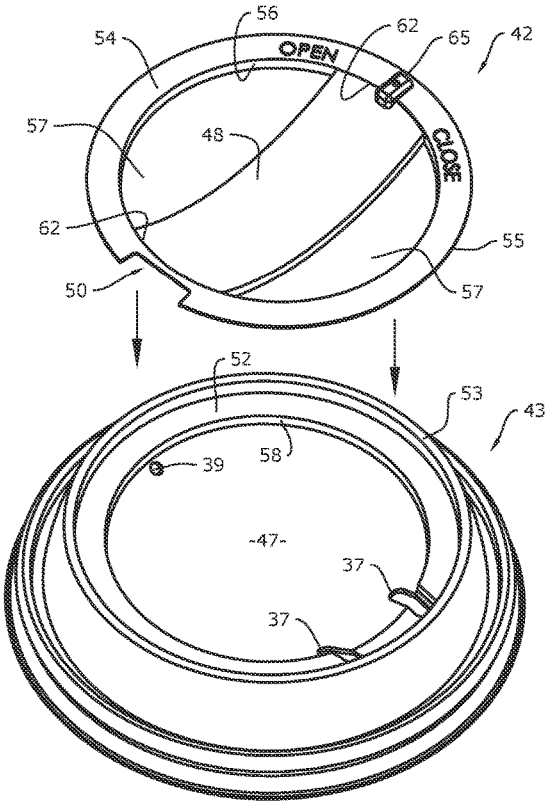

FIG. 27 is an exploded top perspective view of the first alternative lid assembly according to the present invention showing from top to bottom the upper lid construction and the lower lid construction in a closed position of use.

Figure 28:
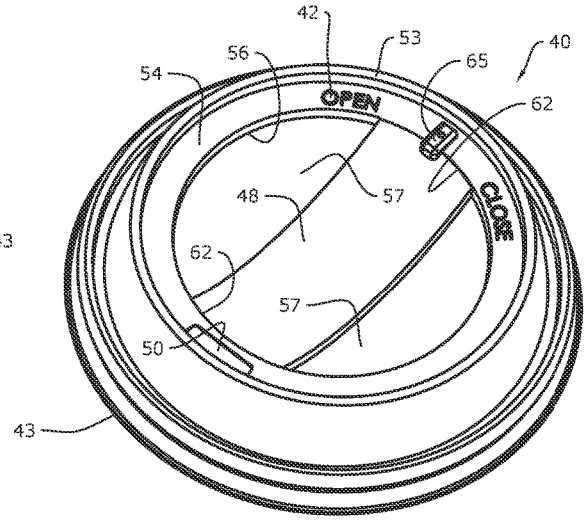

FIG. 28 is a top perspective view of the first alternative lid assembly according to the present invention in the closed position of use.

Figure 29:
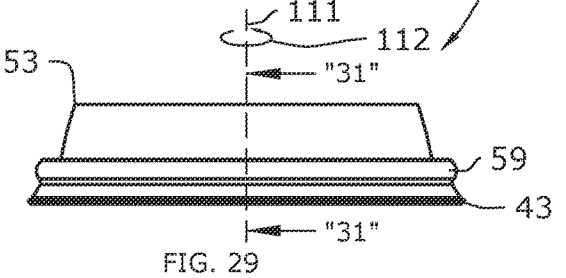

FIG. 29 is a reduced lateral edge elevational view of the first alternative lid assembly according to the present invention.

Figure 30:
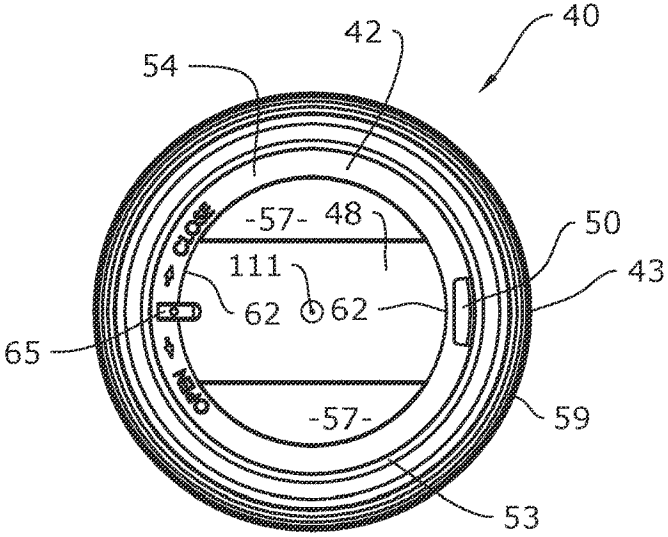

FIG. 30 is a reduced top plan view of the first alternative lid assembly according to the present invention in the first open position use as otherwise depicted in FIG. 29.

Figure 31:
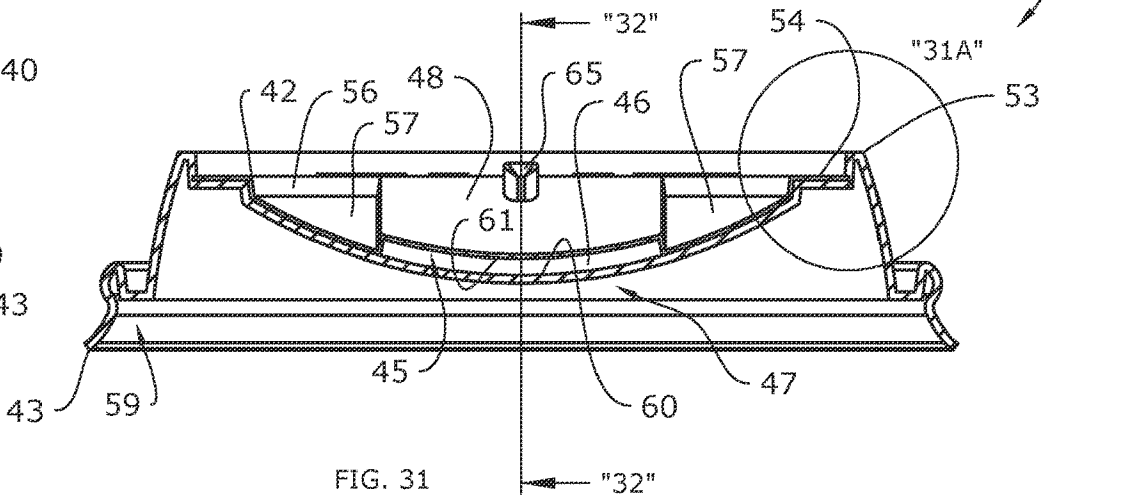

FIG. 31 is a frontal longitudinal sectional view of the first alternative lid assembly according to the present invention as sectioned from FIG. 29.

Figure 32:
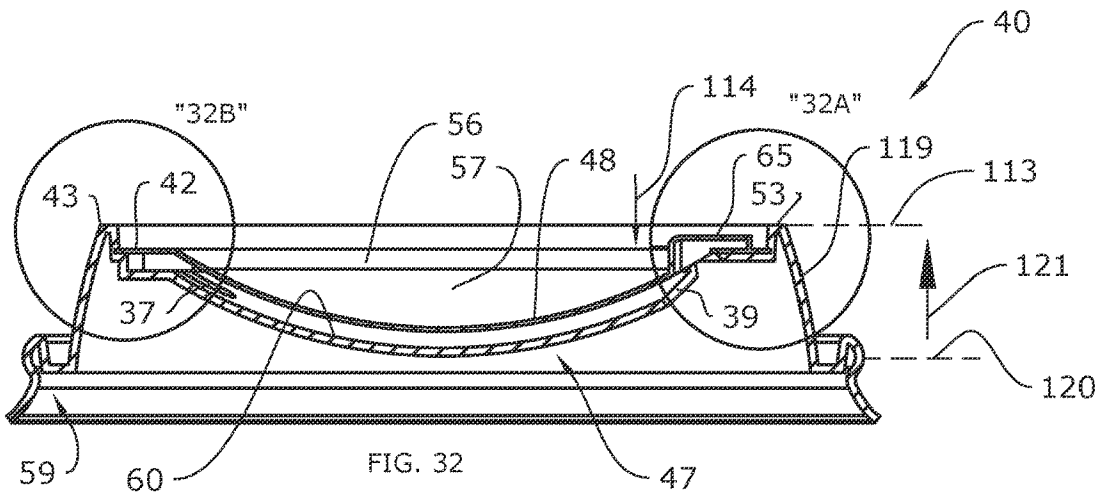

FIG. 32 is a medial longitudinal sectional view of the first alternative lid assembly according to the present invention.

Figure 31A:
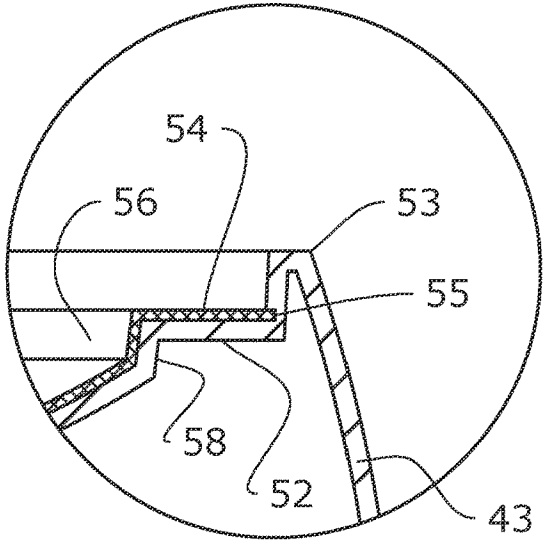

FIG. 31A is an enlarged, fragmentary sectional view of the upper right structures of the first alternative lid assembly as sectioned from FIG. 31.

Figure 32B:
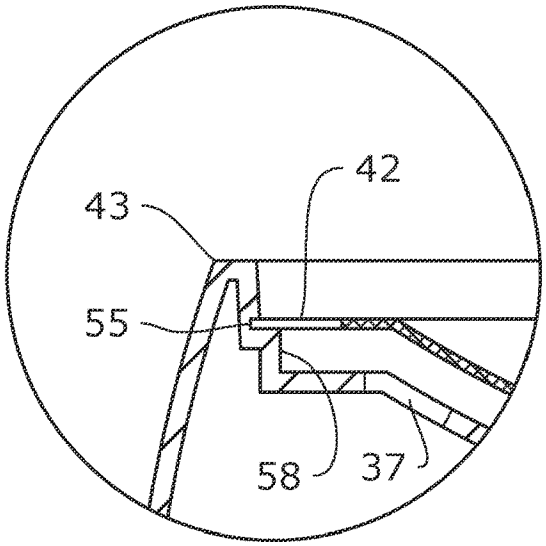
Figure 32A:
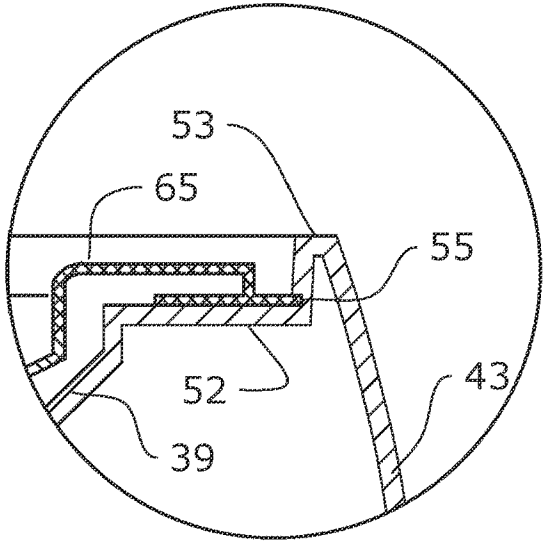

FIG. 32A is an enlarged, fragmentary sectional view of the upper right structures of the first alternative lid assembly as sectioned from FIG. 32.

FIG. 32B is an enlarged, fragmentary sectional view of the upper left structures of the first alternative lid assembly as sectioned from FIG. 32.

Figures 33, 34, 35:
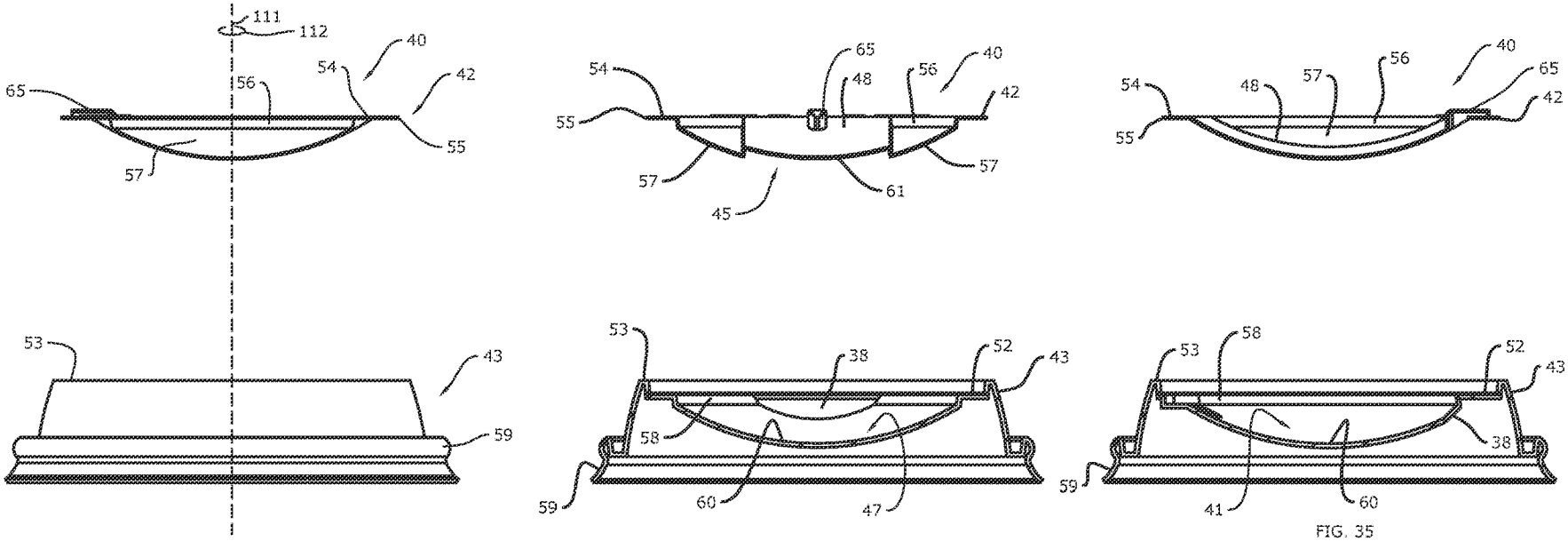

FIG. 33 is an exploded lateral view of the first alternative lid assembly according to the present invention showing from top to bottom the upper lid construction and the first lower lid construction.

FIG. 34 is an exploded frontal longitudinal cross-sectional view of the first alternative lid assembly according to the present invention as sectioned from FIG. 33.

FIG. 35 is an exploded medial longitudinal cross-sectional view of the first alternative lid assembly according to the present invention.

Figure 36:
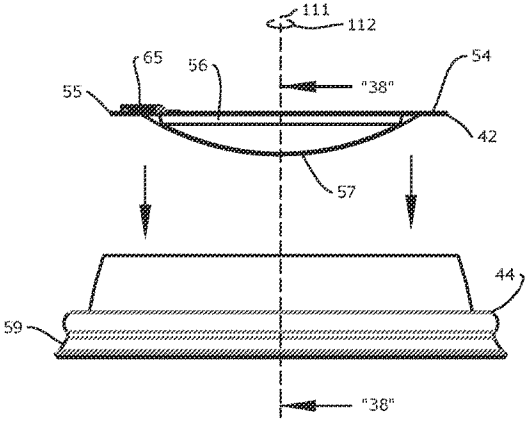

FIG. 36 is a reduced exploded lateral view of a second alternative lid assembly according to the present invention showing from top to bottom an upper lid construction and a lower lid construction.

Figure 37:
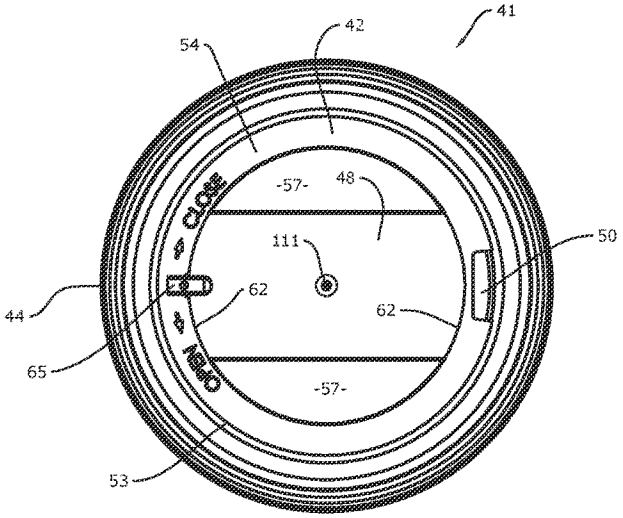

FIG. 37 is a reduced top view of the second alternative lid assembly according to the present invention in a first open position of use as otherwise depicted in FIG. 36.

Figure 38A:
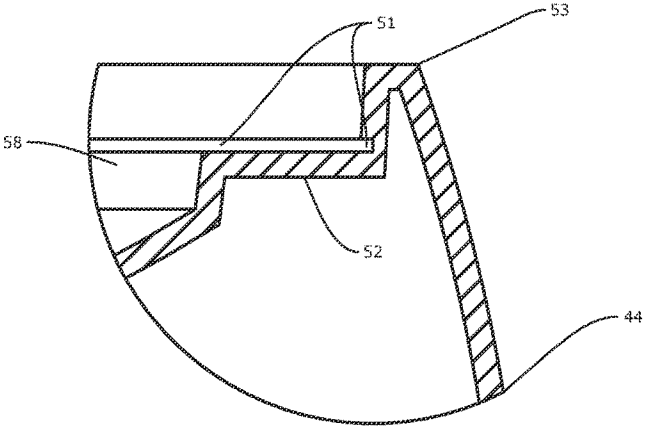
Figure 38:
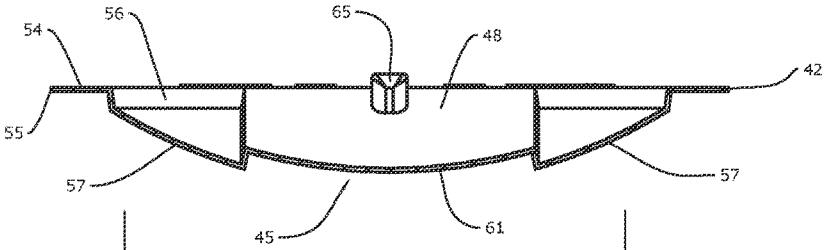
Figure 38:
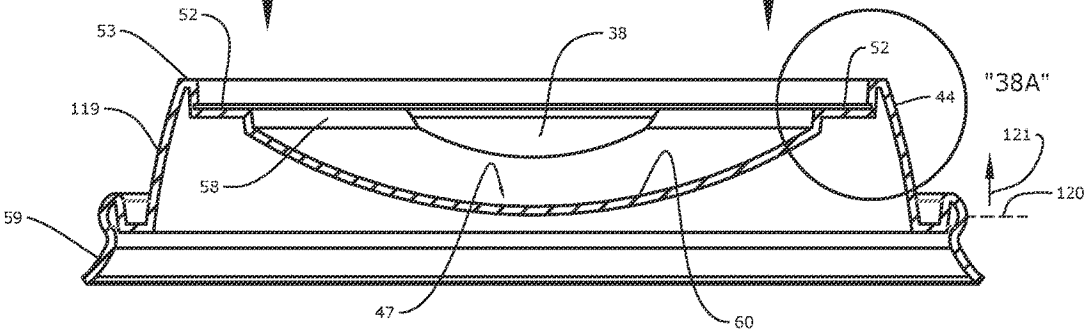

FIG. 38 is an enlarged exploded frontal longitudinal cross-sectional view of the second alternative lid assembly according to the present invention as sectioned from FIG. 36.

FIG. 38A is an enlarged, fragmentary sectional view of the upper right structures of the second alternative lid assembly as sectioned from FIG. 38.

Figure 39:
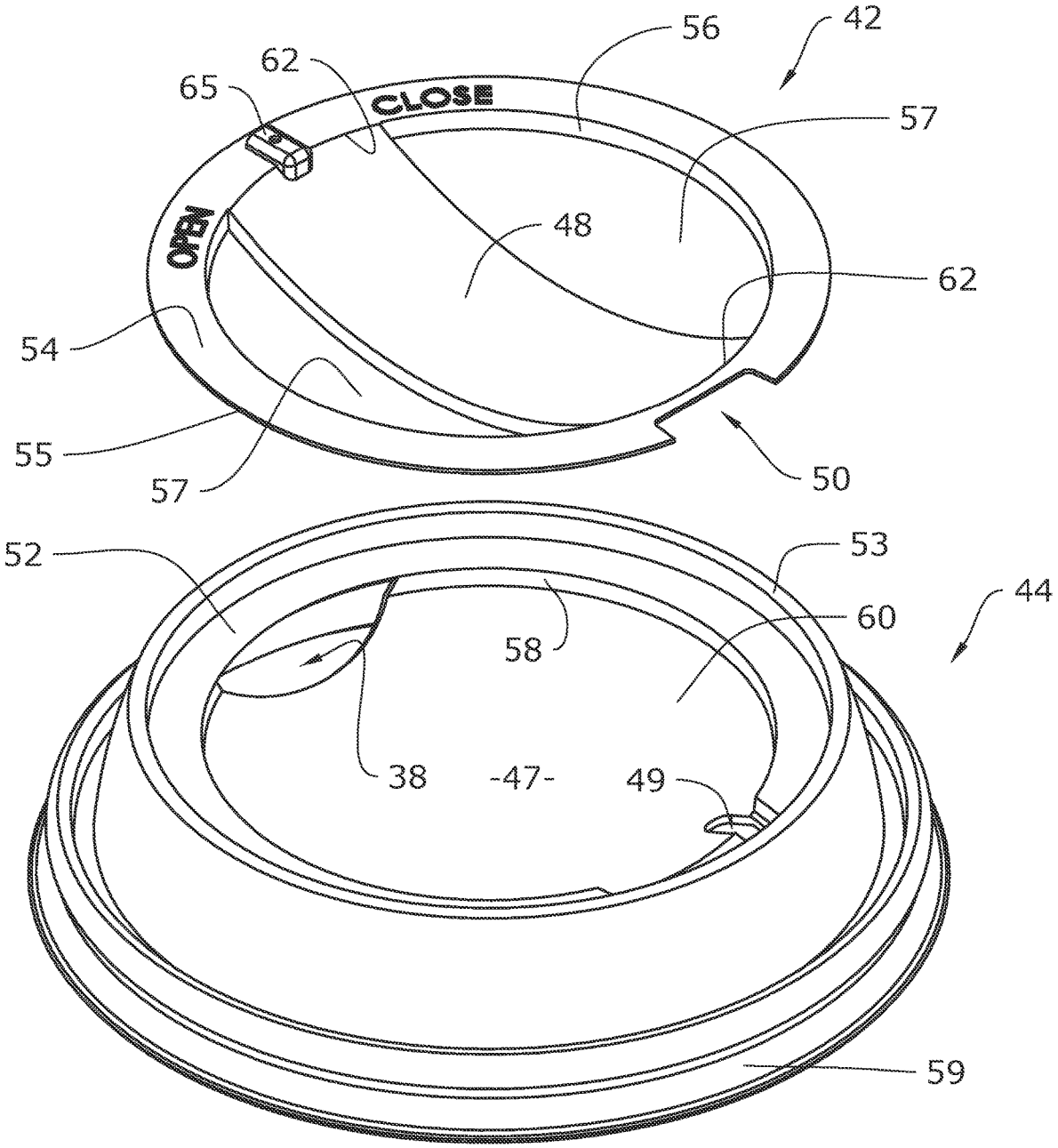

FIG. 39 is an enlarged exploded top perspective view of the second alternative lid assembly according to the present invention showing the upper lid construction positioned in a first open position of use relative to the lower lid construction.

Figure 40:
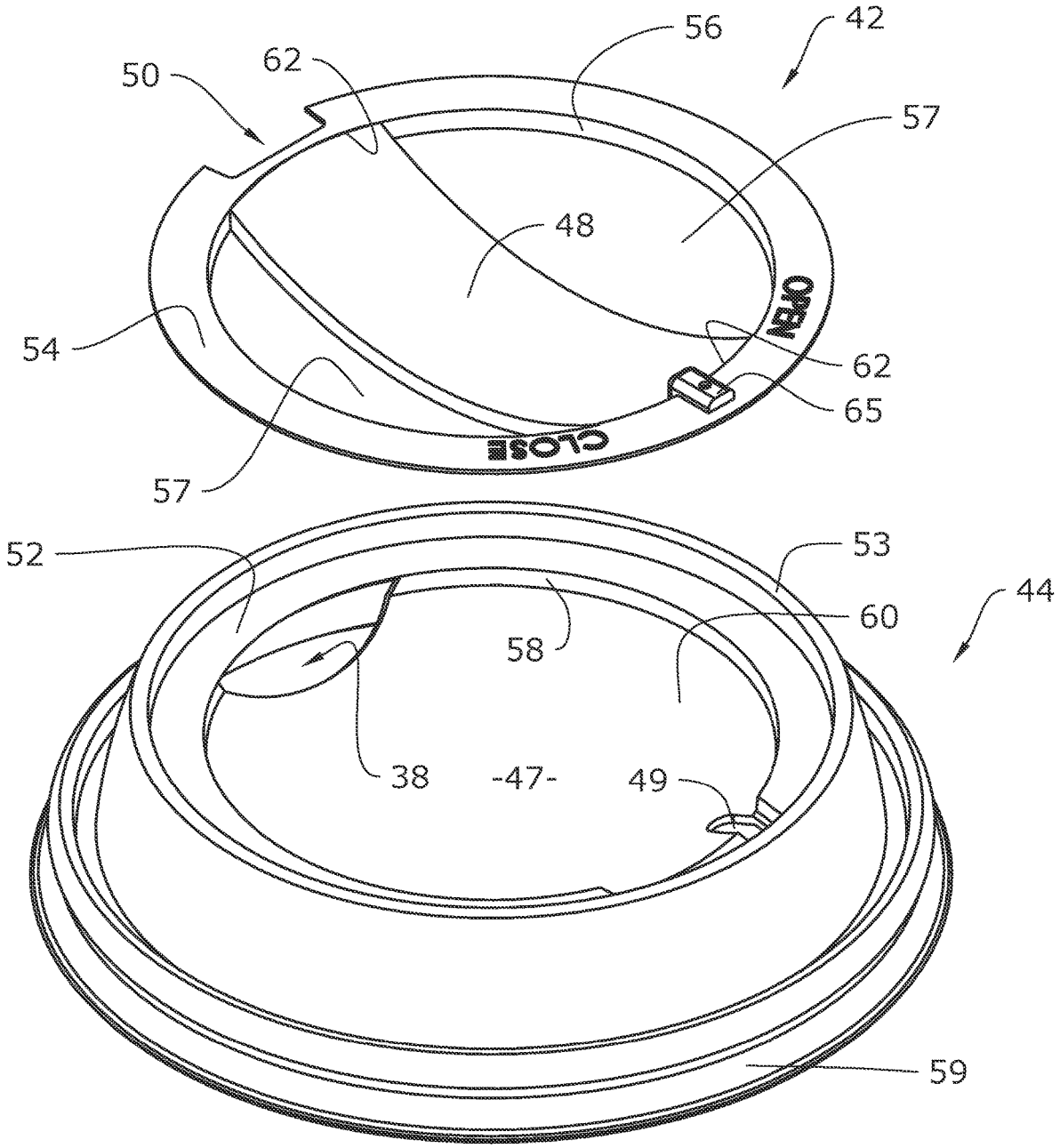

FIG. 40 is an enlarged exploded top perspective view of the second alternative lid assembly according to the present invention showing the upper lid construction positioned in a second open position of use relative to the lower lid construction.

Figure 41:
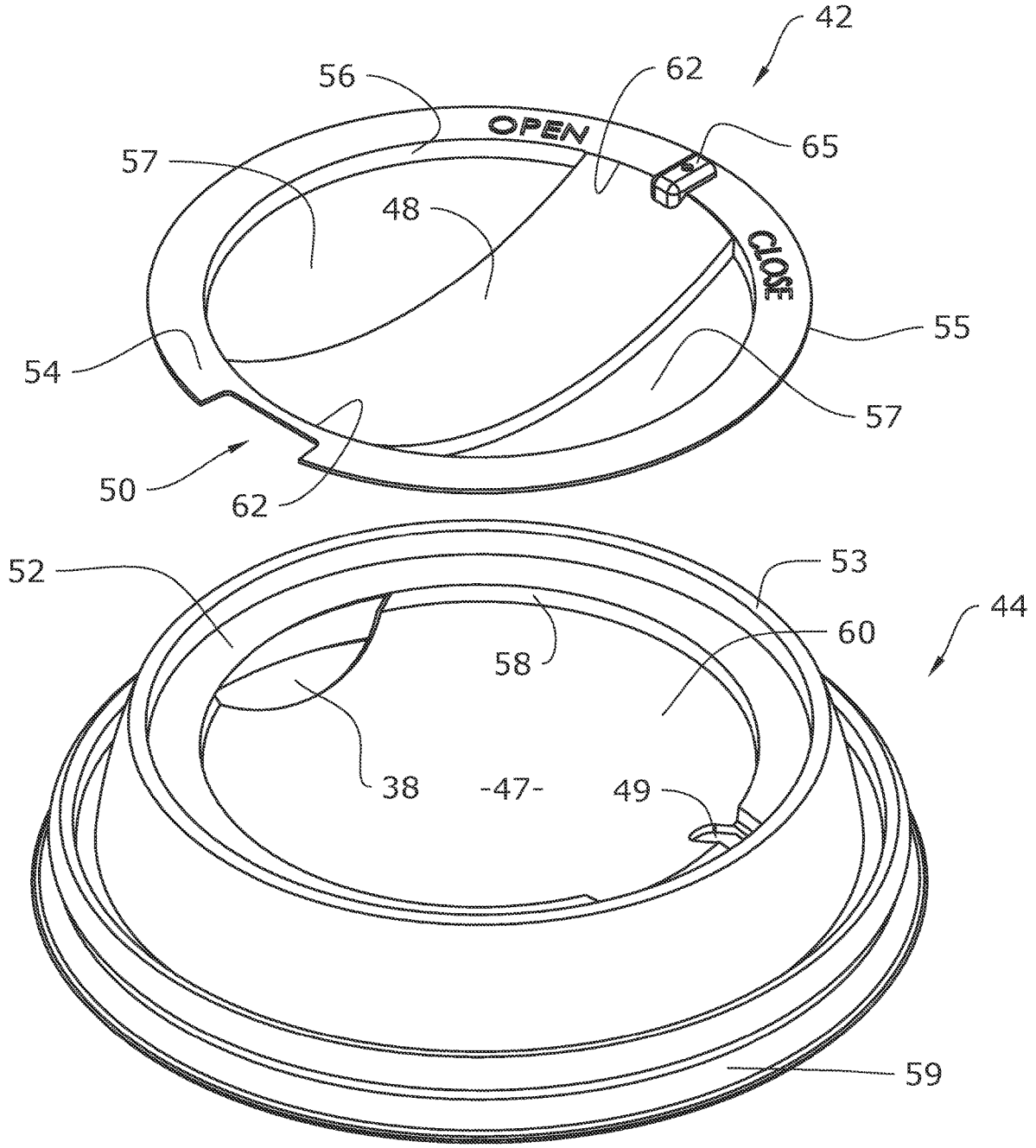

FIG. 41 is an enlarged exploded top perspective view of the second alternative lid assembly according to the present invention showing the upper lid construction positioned in a closed position of use relative to the lower lid construction.

Figure 42:
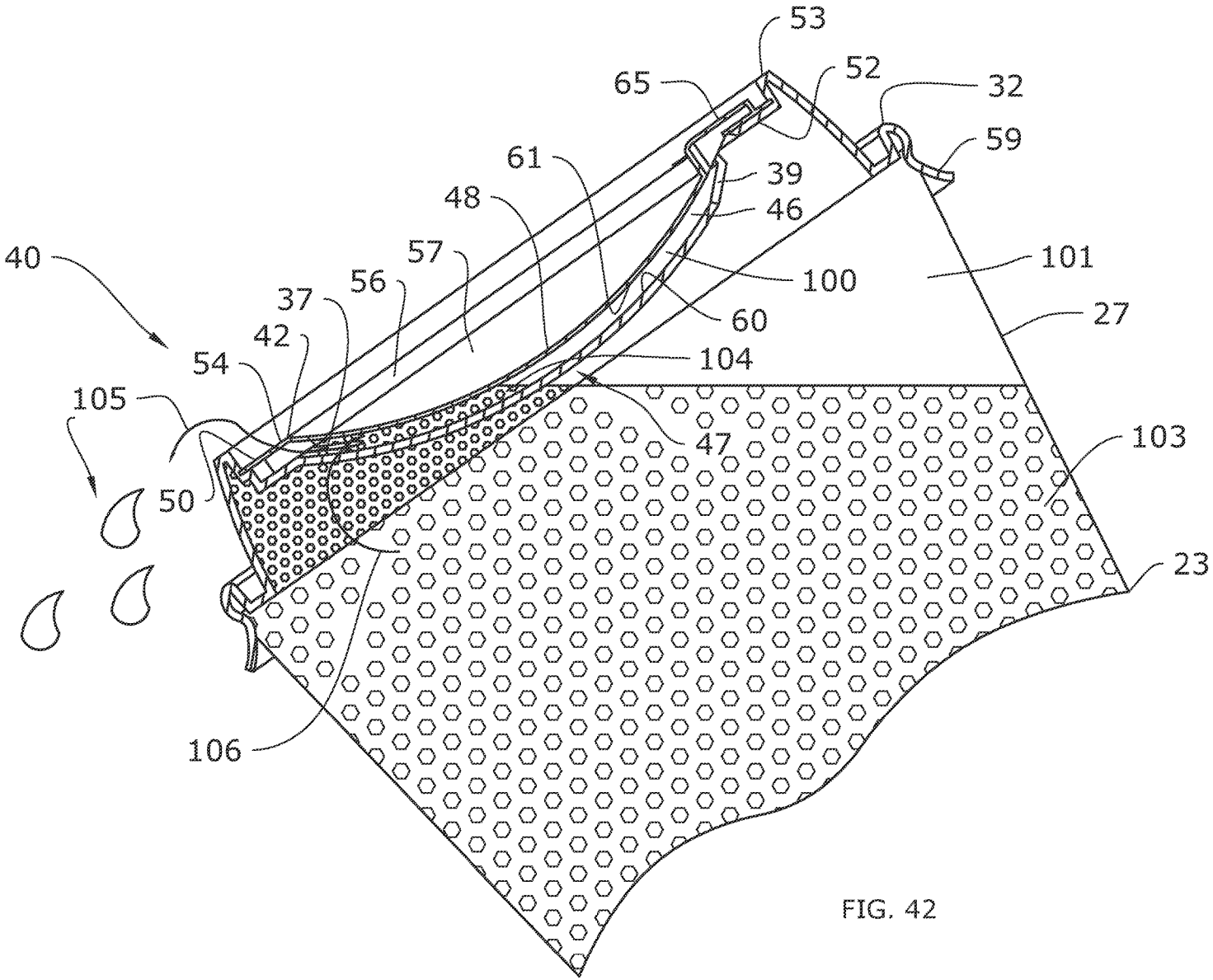

FIG. 42 is a first sequential view of a medial longitudinal cross-sectional "angled-to-the-left" view of the first alternative lid assembly according to the present invention depicted in assembled relation with the upper lid construction and the lower lid construction in a first open position of use in assembled relation with a fragmentary upper portion of a liquid container to primarily depict a liquid volume being directed into a liquid-receiving cavity defined intermediate the upper lid construction and the lower lid construction.

Figure 43:
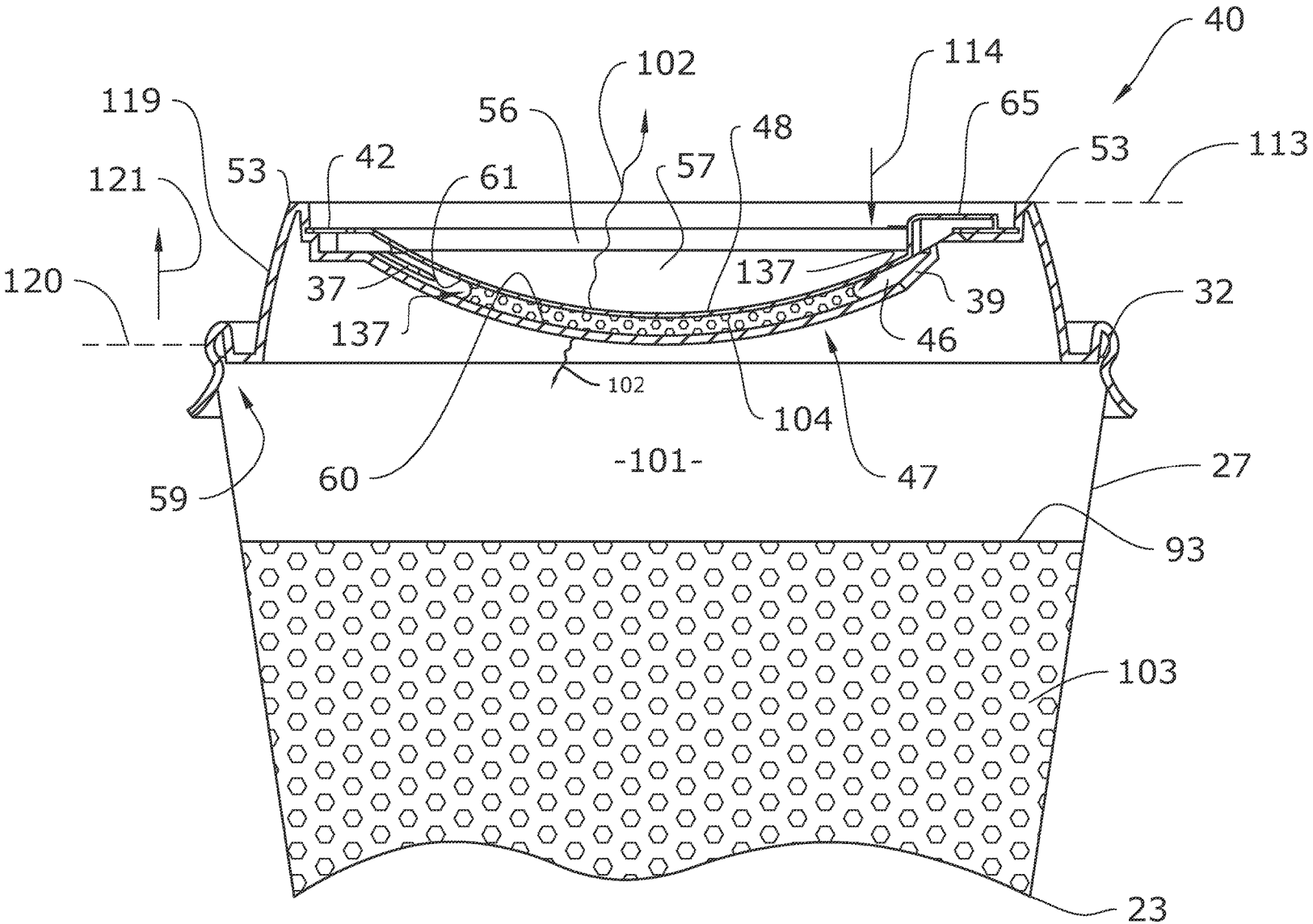

FIG. 43 is a second sequential view of a medial longitudinal cross-sectional vertical view of the first alternative lid assembly according to the present invention depicted in assembled relation with the upper lid construction and the lower lid construction in the first open position of use in assembled relation with the fragmentary upper portion of the liquid container to primarily depict the liquid volume being directed centrally within a liquid volume-shaping cavity defined intermediate the upper lid construction and the lower lid construction.

Figure 44:
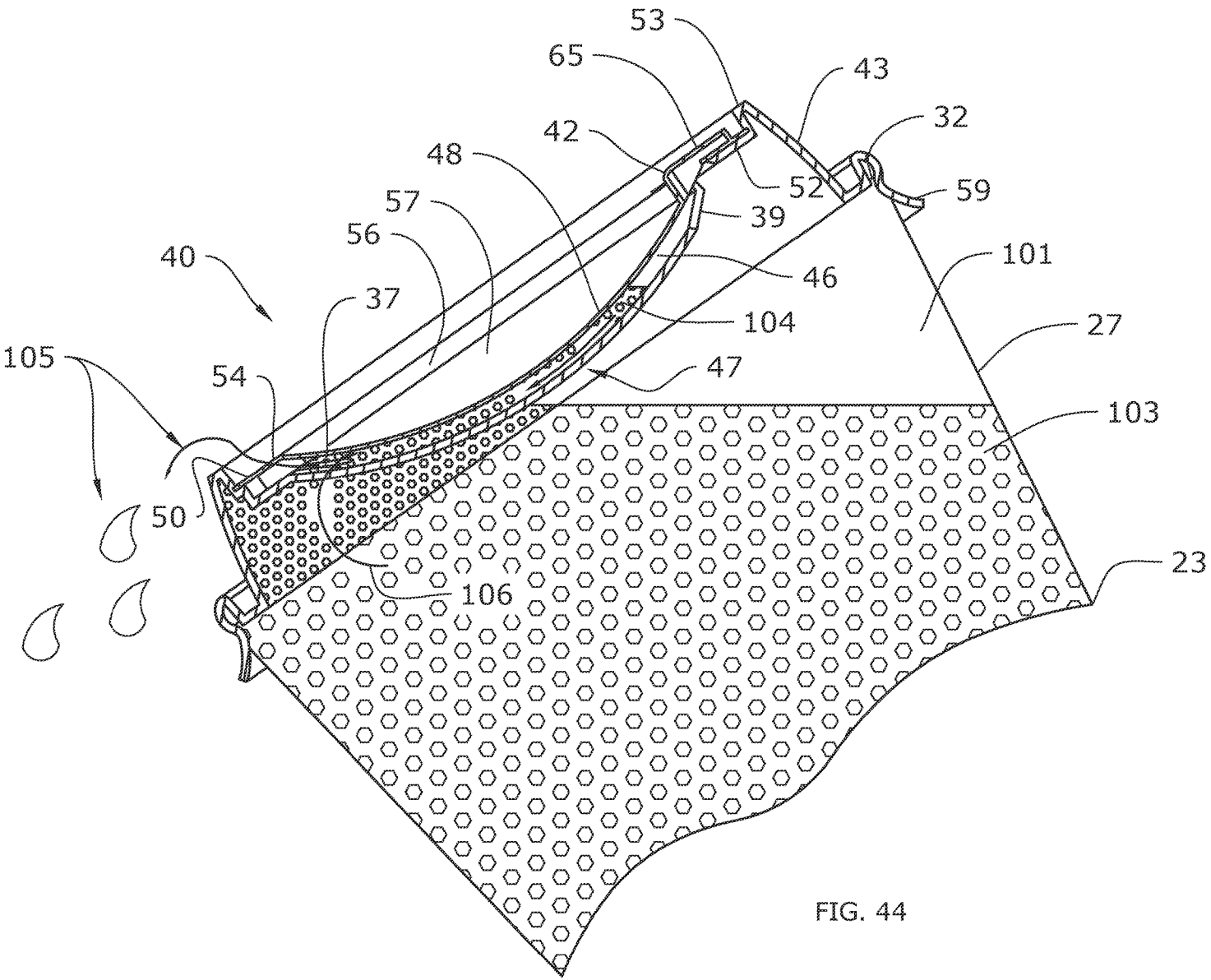

FIG. 44 is a third sequential view of a medial longitudinal cross-sectional "angled-to-the-left" view of the first alternative lid assembly according to the present invention depicted in assembled relation with the upper lid construction and the lower lid construction in the first open position of use in assembled relation with a fragmentary upper portion of a liquid container to primarily depict the cavity-shaped liquid volume being directed out of the ensemble via a primary liquid outlet while simultaneously mixing with a second liquid volume being directed into the liquid-receiving cavity defined intermediate the upper lid construction and the lower lid construction.

Figure 45:
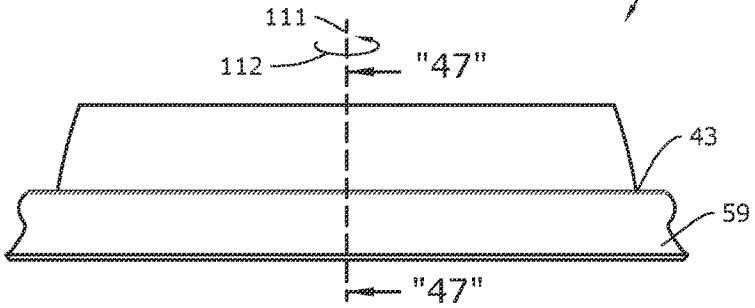

FIG. 45 is a lateral view of a third alternative lid assembly according to the present invention.

Figure 46:
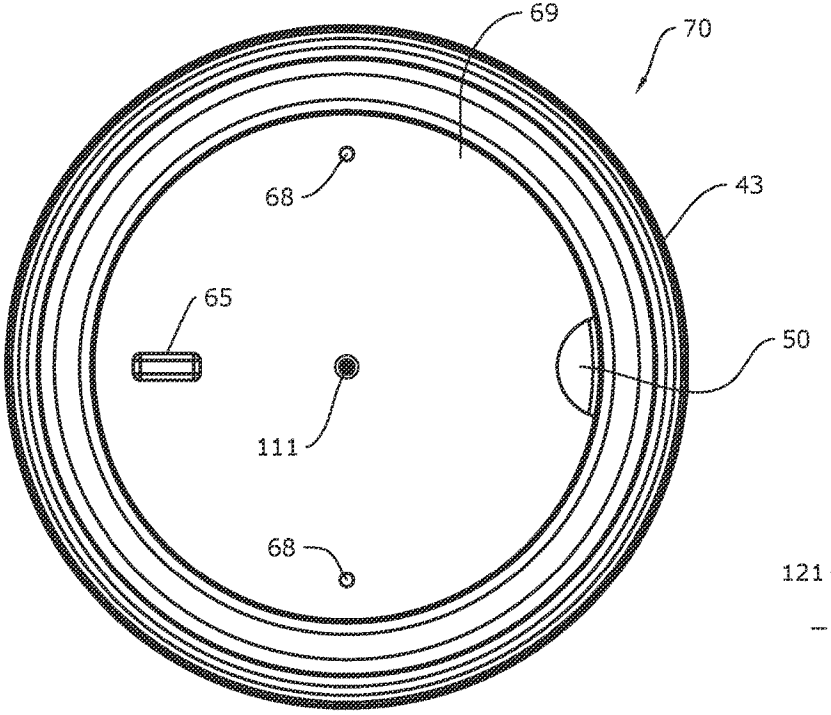

FIG. 46 is a top plan view of the third alternative lid assembly according to the present invention in a first open position of use as otherwise depicted in FIG. 45.

Figure 47A:
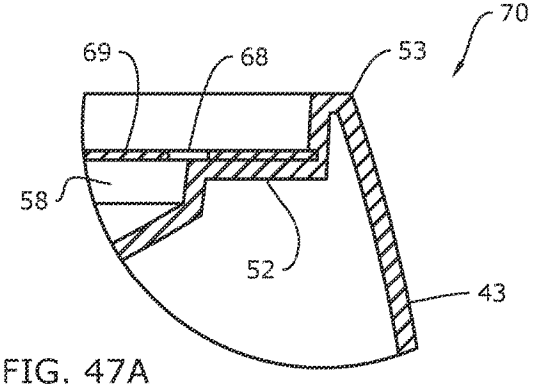
Figure 47:
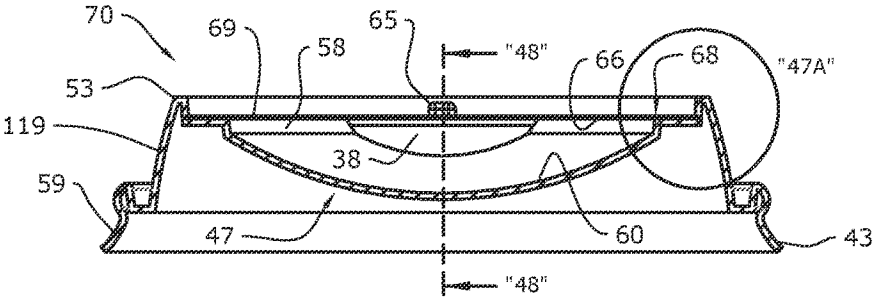

FIG. 47 is a frontal longitudinal cross-sectional view of the third alternative lid assembly according to the present invention as sectioned from FIG. 45.

FIG. 47A is an enlarged, fragmentary sectional view of the upper right structures of the third alternative lid assembly as sectioned from FIG. 47.

Figure 48:
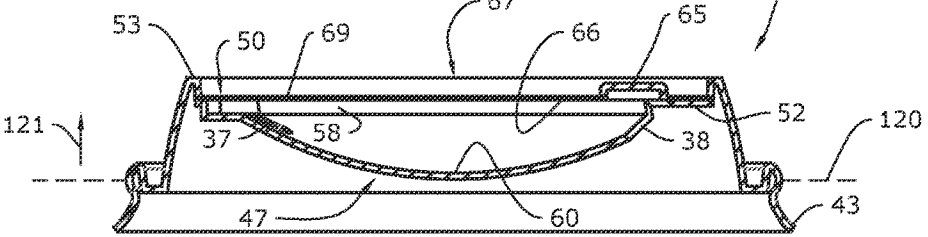

FIG. 48 is a medial longitudinal cross-sectional view of the third alternative lid assembly according to the present invention as sectioned from FIG. 46.

Figure 49:
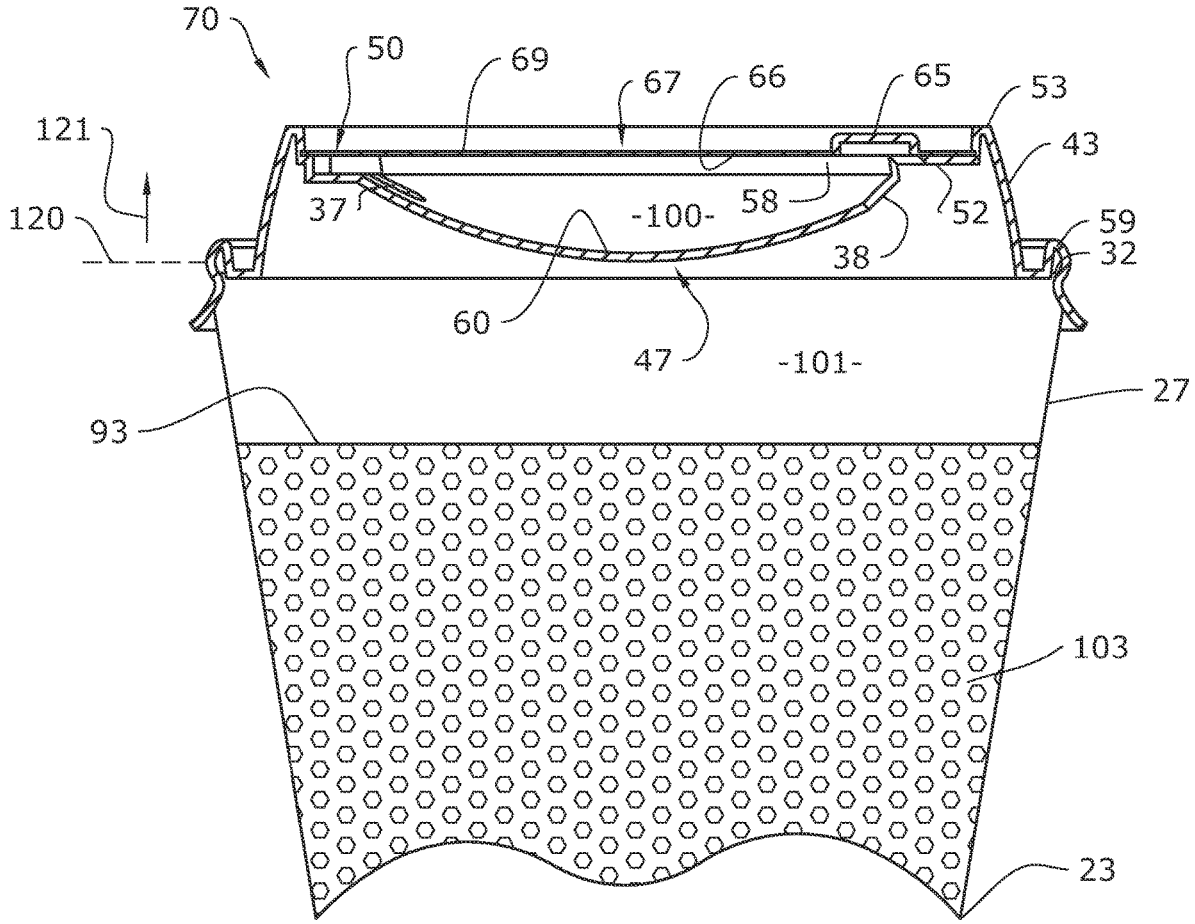

FIG. 49 is a first sequential view of a medial longitudinal cross-sectional vertical view of the third alternative lid assembly according to the present invention depicted in assembled relation with the upper lid construction and the lower lid construction in a first open position of use in assembled relation with a fragmentary upper portion of a liquid container to primarily depict a relatively large liquid volume received in a lower liquid-containing compartment before directed into an upper liquid-cooling compartment defined intermediate the upper lid construction and the lower lid construction.

Figure 50:
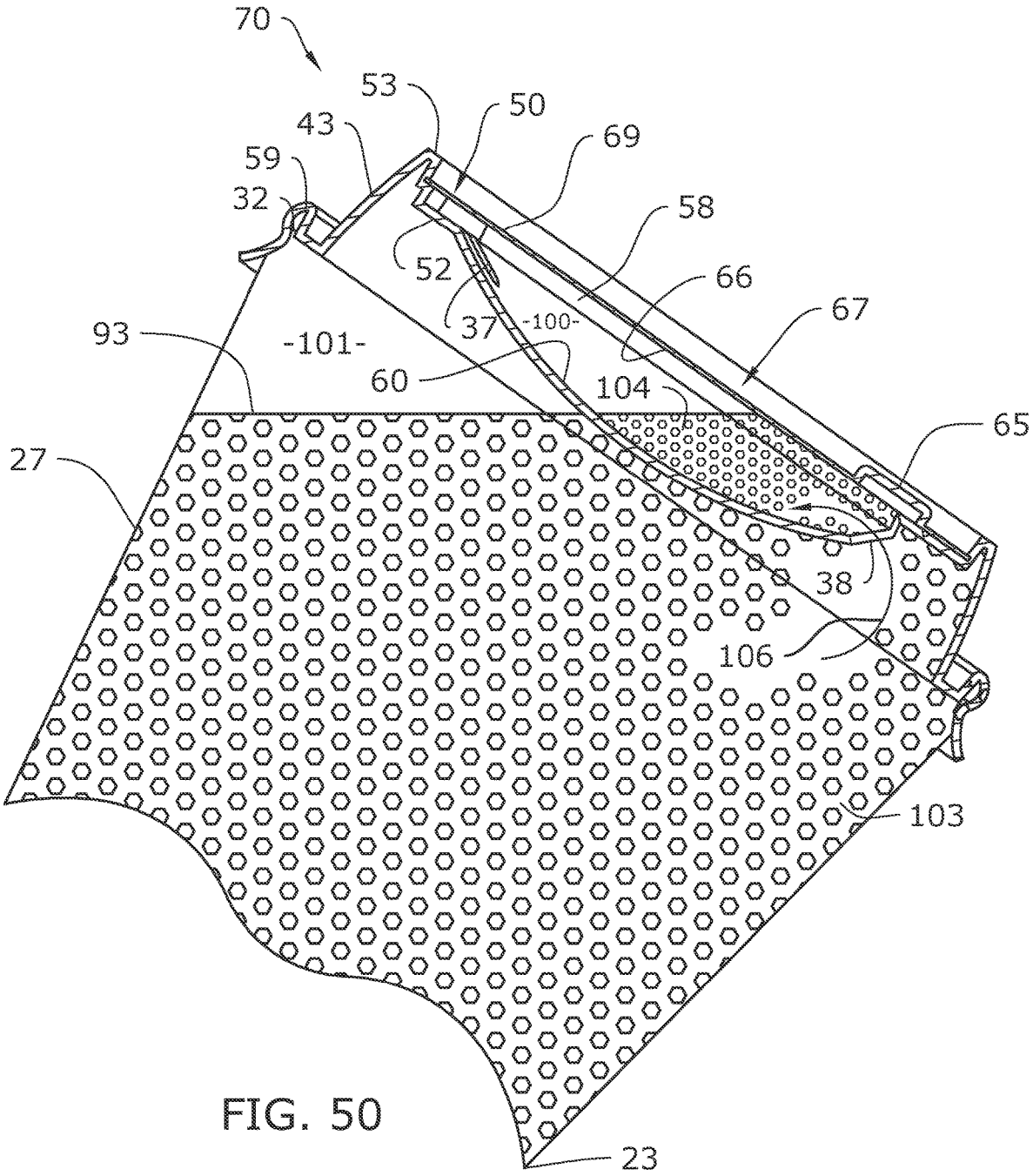

FIG. 50 is a second sequential view of a medial longitudinal cross-sectional "angled-to-the-right" view of the third alternative lid assembly according to the present invention depicted in assembled relation with the upper lid construction and the lower lid construction in the first open position of use in assembled relation with a fragmentary upper portion of a liquid container to primarily depict a relatively small liquid volume being directed into the upper liquid-cooling compartment via a first type of letting aperture defined in the lower lid construction.

Figure 51:
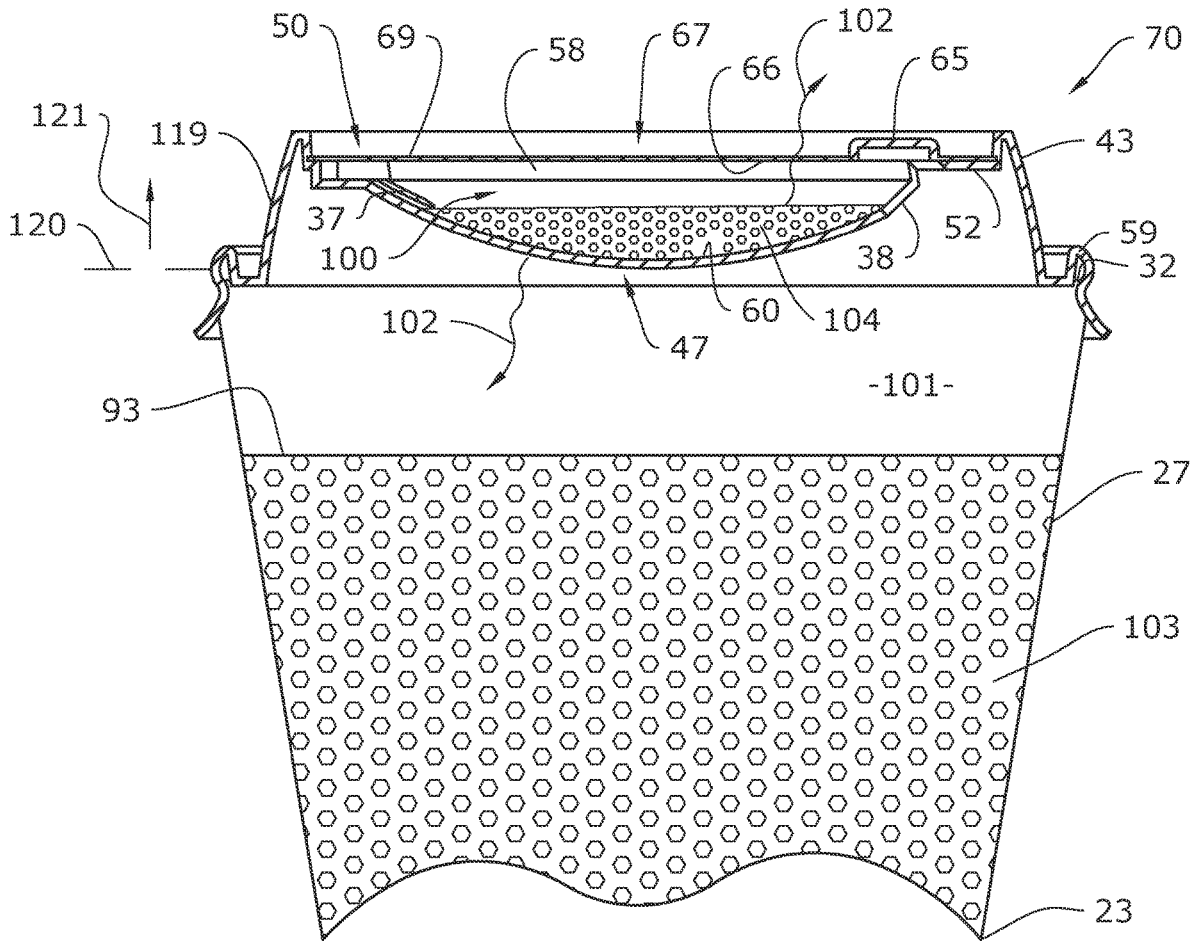

FIG. 51 is a third sequential view of a medial longitudinal cross-sectional vertical view of the third alternative lid assembly according to the present invention depicted in assembled relation with the upper lid construction and the lower lid construction in the first open position of use in assembled relation with a fragmentary upper portion of a liquid container to primarily depict the relatively small liquid volume being centrally pooled atop a central liquid-pooling portion of the lower lid construction within the upper liquid-cooling compartment.

Figure 52:
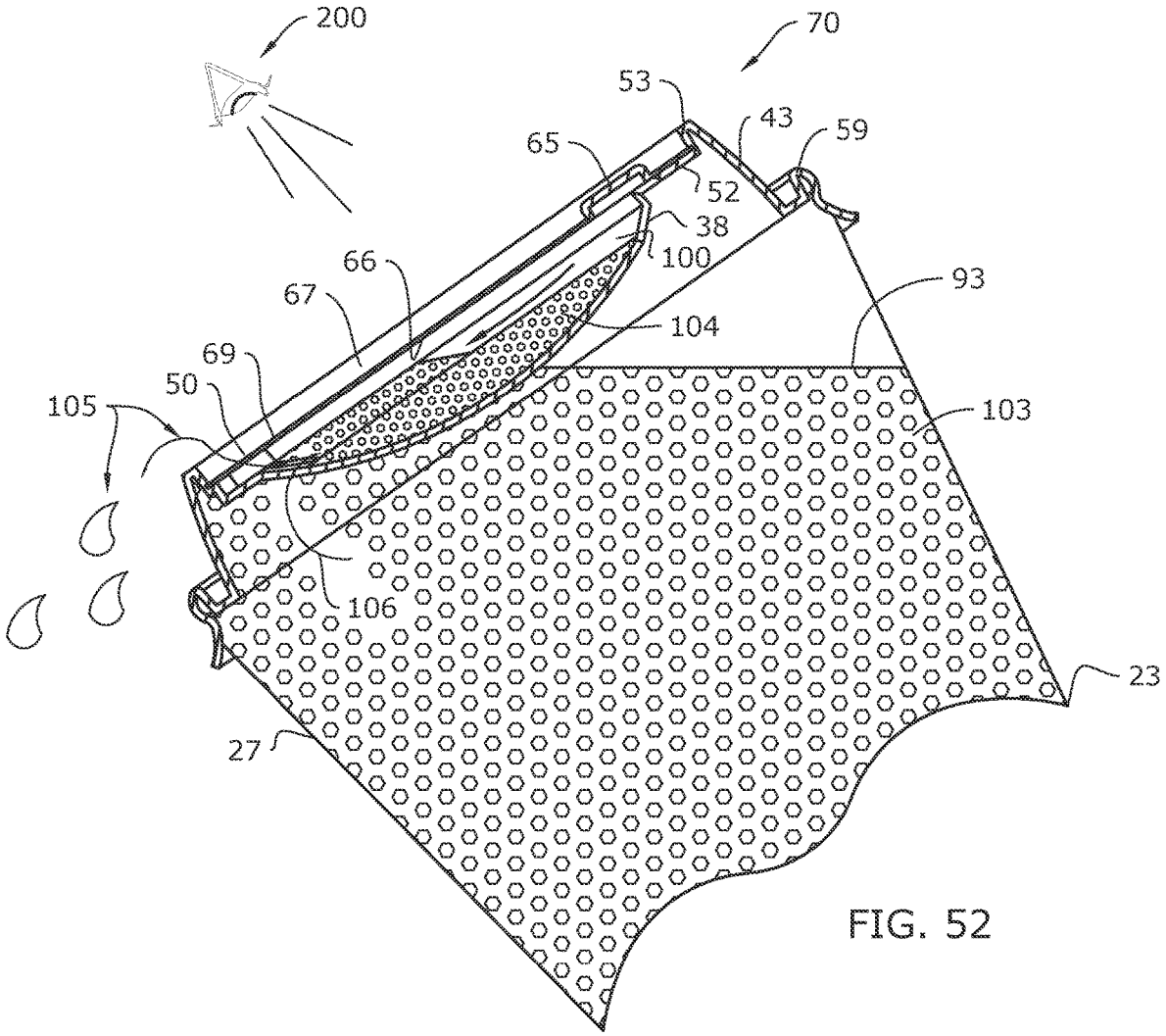

FIG. 52 is a fourth sequential view of a medial longitudinal cross-sectional "angled-to-the-left" view of the third alternative lid assembly according to the present invention depicted in assembled relation with the upper lid construction and the lower lid construction in the first open position of use in assembled relation with a fragmentary upper portion of a liquid container to primarily depict the relatively small liquid volume being directed out of the ensemble via a primary liquid outlet formed in the upper lid construction while simultaneously mixing with a second liquid volume being directed into the upper liquid-cooling compartment via a second type of letting aperture defined in the lower lid construction.

Figure 53A:
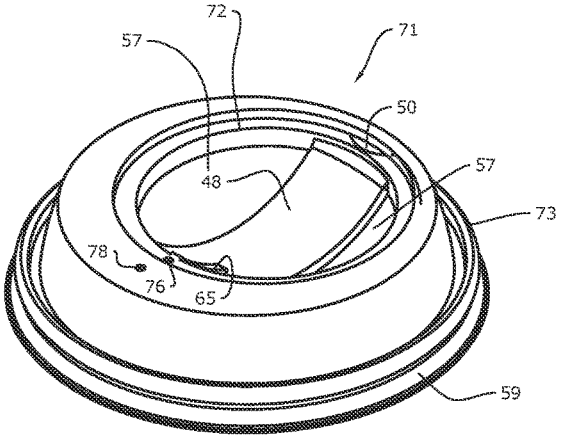
Figure 53:
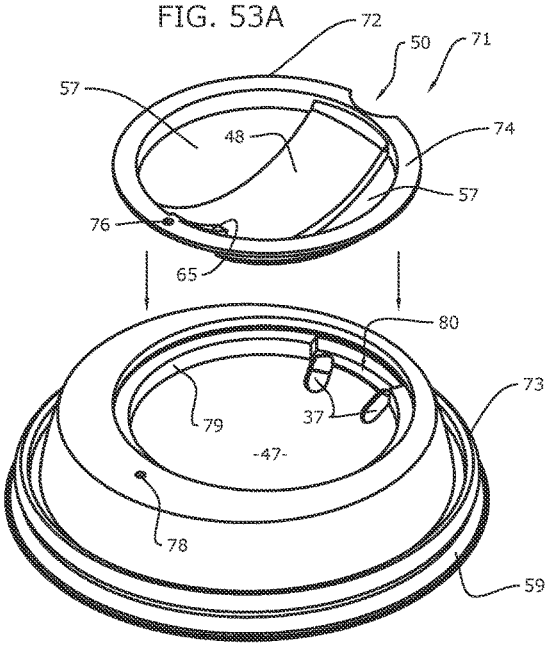

FIG. 53 is an exploded top perspective view of a fourth alternative lid assembly according to the present invention showing from top to bottom an upper lid construction and a lower lid construction in an open position of use.

FIG. 53A is a top perspective view of the fourth alternative lid assembly according to the present invention in the open position of use.

Figure 54A:
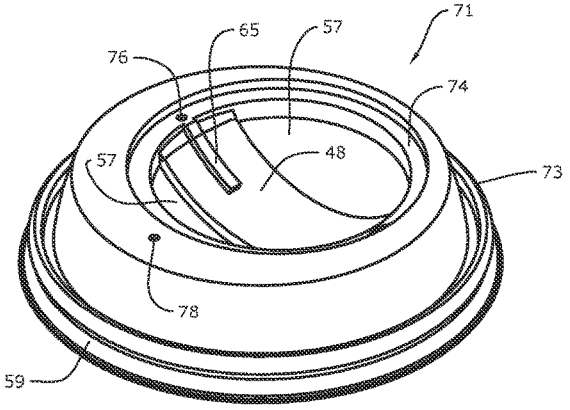
Figure 54:
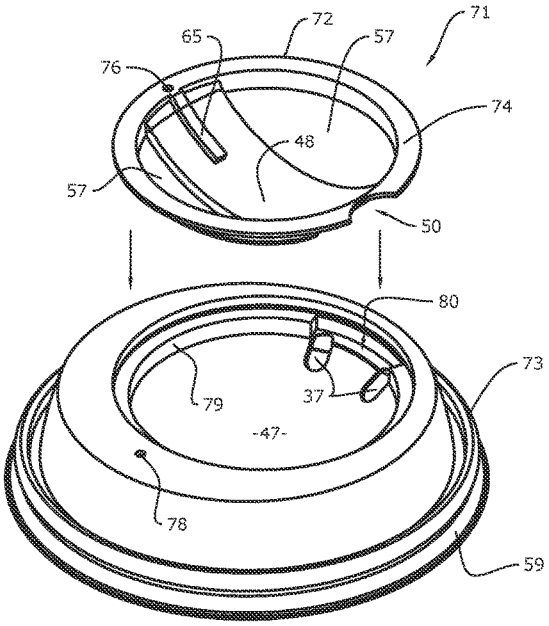

FIG. 54 is an exploded top perspective view of the fourth alternative lid assembly according to the present invention showing from top to bottom the upper lid construction and the lower lid construction in a closed position of use.

FIG. 54A is a top perspective view of the fourth alternative lid assembly according to the present invention in the closed position of use.

Figure 55A:
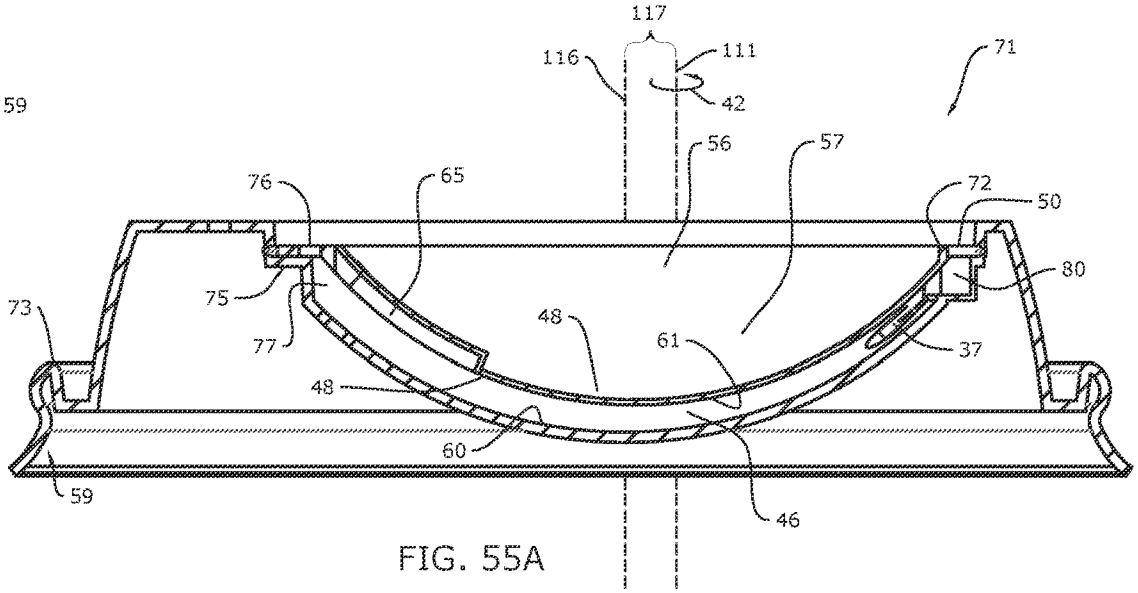
Figure 55:
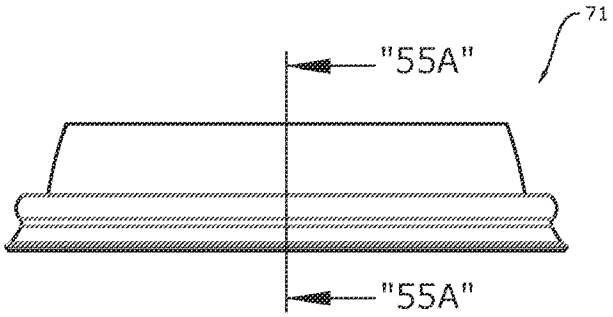

FIG. 55 is a posterior elevational view of the fourth alternative lid assembly according to the present invention.

FIG. 55A is a medial longitudinal cross-sectional view of the fourth alternative lid assembly according to the present invention.

Figure 56:
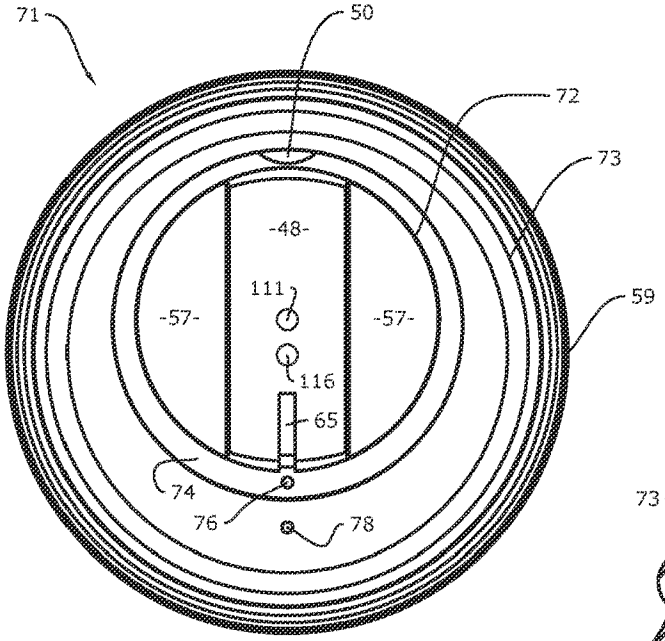

FIG. 56 is a top plan view of the fourth alternative lid assembly according to the present invention in the open position of use.

Figure 57:
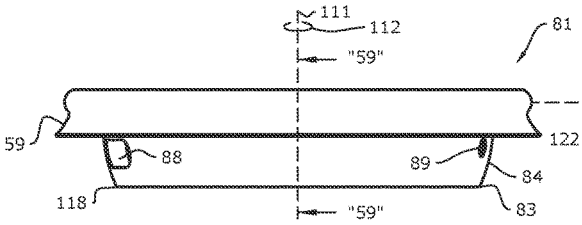

FIG. 57 is a first lateral elevational view of a fifth alternative lid assembly according to the present invention.

Figure 58:
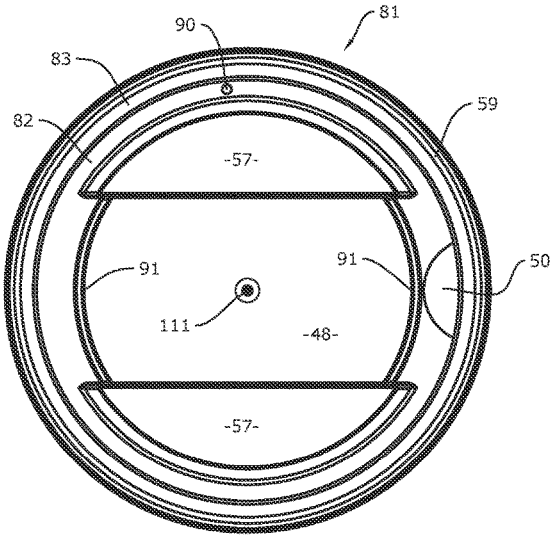

FIG. 58 is a top plan view of the fifth alternative lid assembly according to the present invention in a first open position of use.

Figure 59:
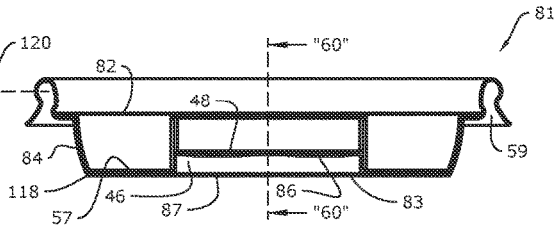

FIG. 59 is a frontal longitudinal cross-sectional view of the fifth alternative lid assembly according to the present invention showing a liquid-shaping cavity respectively formed by lower and upper surfacing of an upper lid construction nestably received atop/within a lower lid construction.

Figure 60:
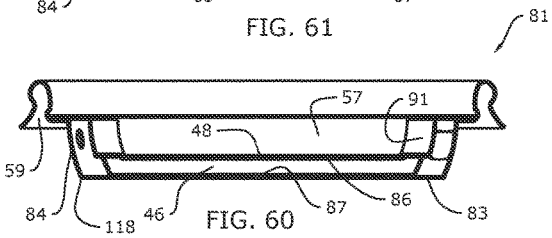

FIG. 60 is a medial longitudinal cross-sectional view of the fifth alternative lid assembly according to the present invention showing the liquid-shaping cavity respectively formed by lower and upper surfacing of the upper lid construction nestably received atop/within the lower lid construction.

Figure 61:
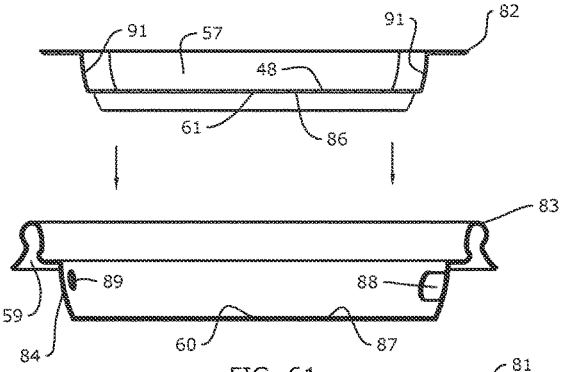

FIG. 61 is an exploded medial longitudinal cross-sectional view of the fifth alternative lid assembly according to the present invention shown in exploded relation to more clearly depict the upper lid construction and the lower lid construction.

Figure 61A:
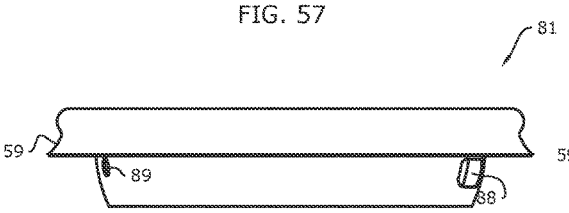

FIG. 61A is a second lateral elevational view of a fifth alternative lid assembly according to the present invention opposite the first lateral elevational view otherwise depicted in FIG. 57.

Figure 61B:
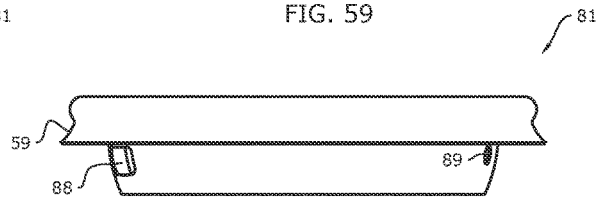

FIG. 61B is a third lateral elevational view of a fifth alternative lid assembly according to the present invention opposite the second lateral elevational view otherwise depicted in FIG. 61A and presented for side-by-side comparison purposes.

Figure 62:
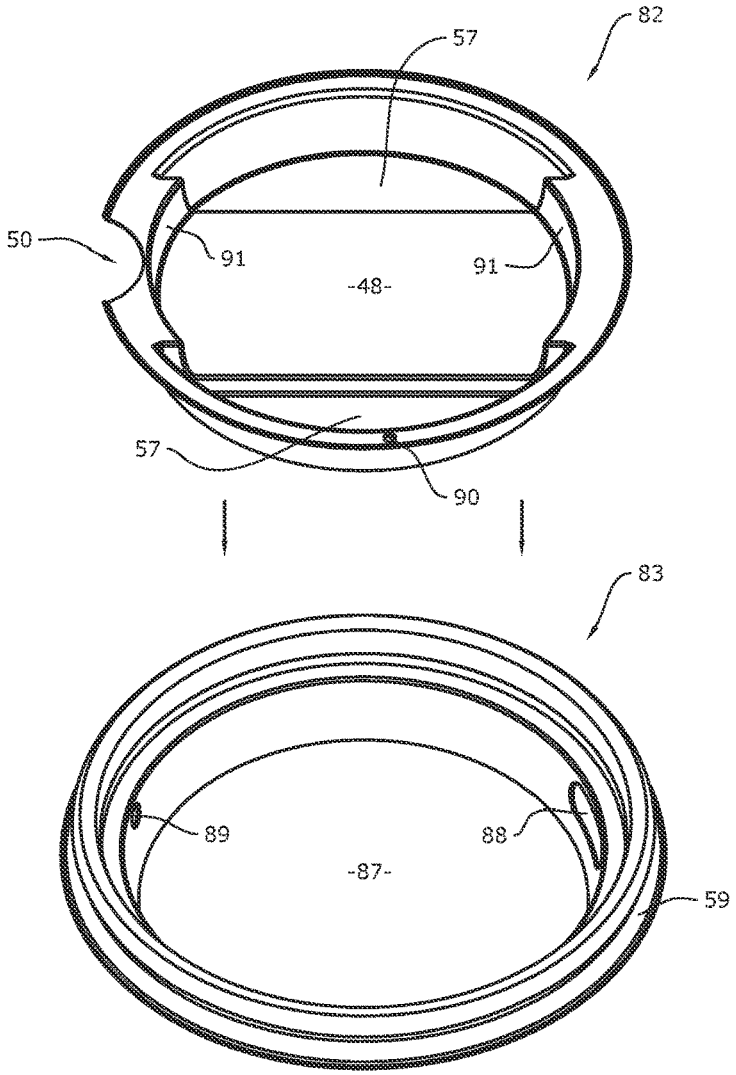

FIG. 62 is an exploded top perspective view of the fifth alternative lid assembly according to the present invention showing from top to bottom the upper lid construction and the lower lid construction in a first open condition of use.

Figure 63:
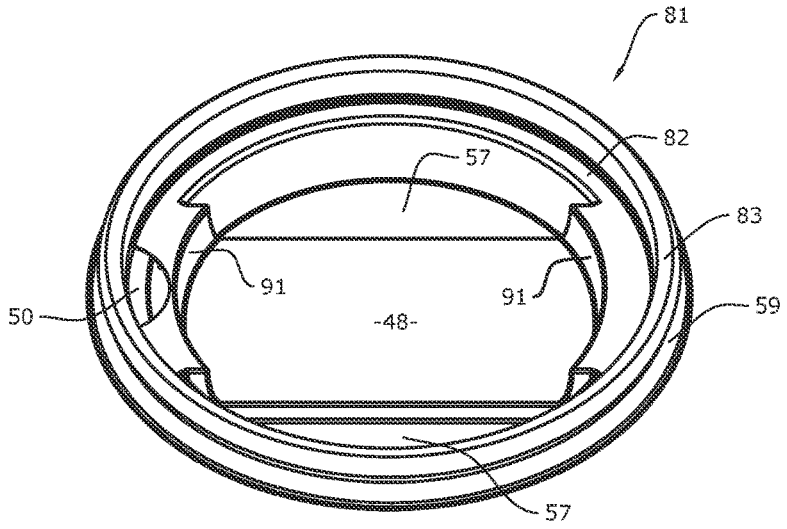

FIG. 63 is a top perspective view of the fifth alternative lid assembly according to the present invention in the first open condition of use.

Figure 64:
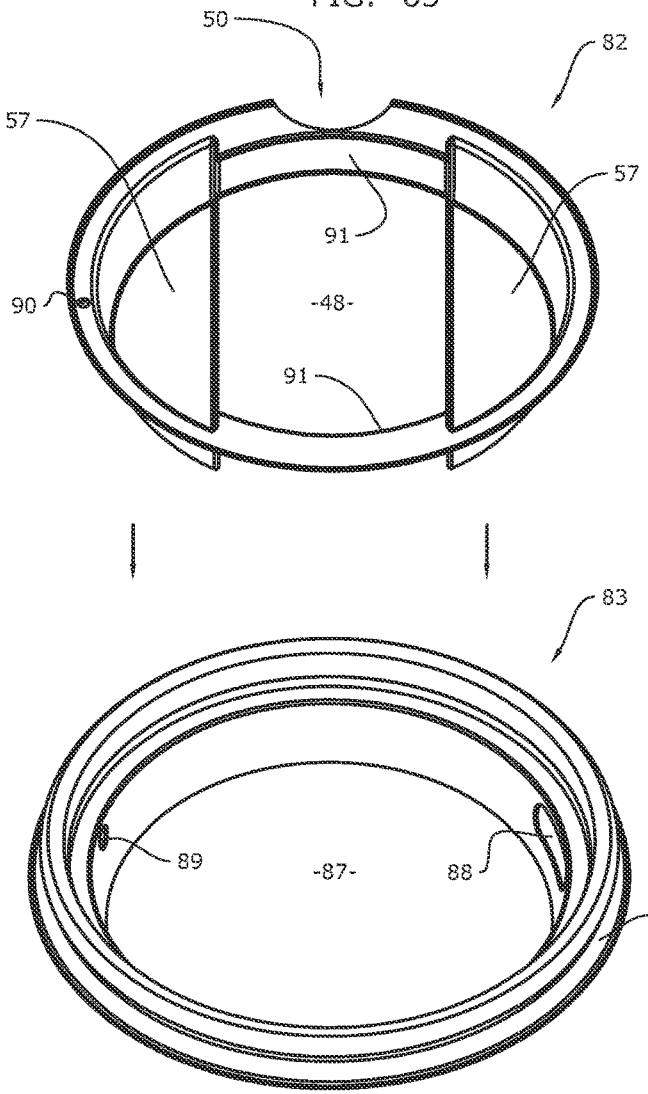

FIG. 64 is an exploded top perspective view of the fifth alternative lid assembly according to the present invention showing from top to bottom the upper lid construction and the lower lid construction in a closed condition of use.

Figure 65:
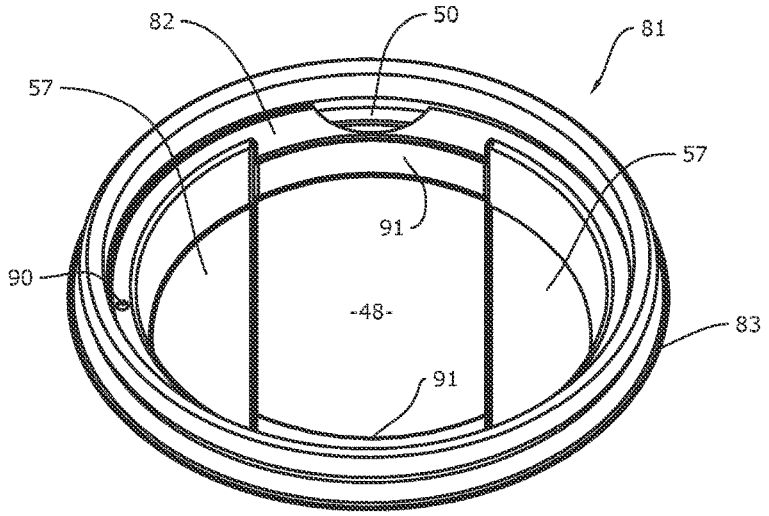

FIG. 65 is a top perspective view of the fifth alternative lid assembly according to the present invention in the closed condition of use.

Figure 66:
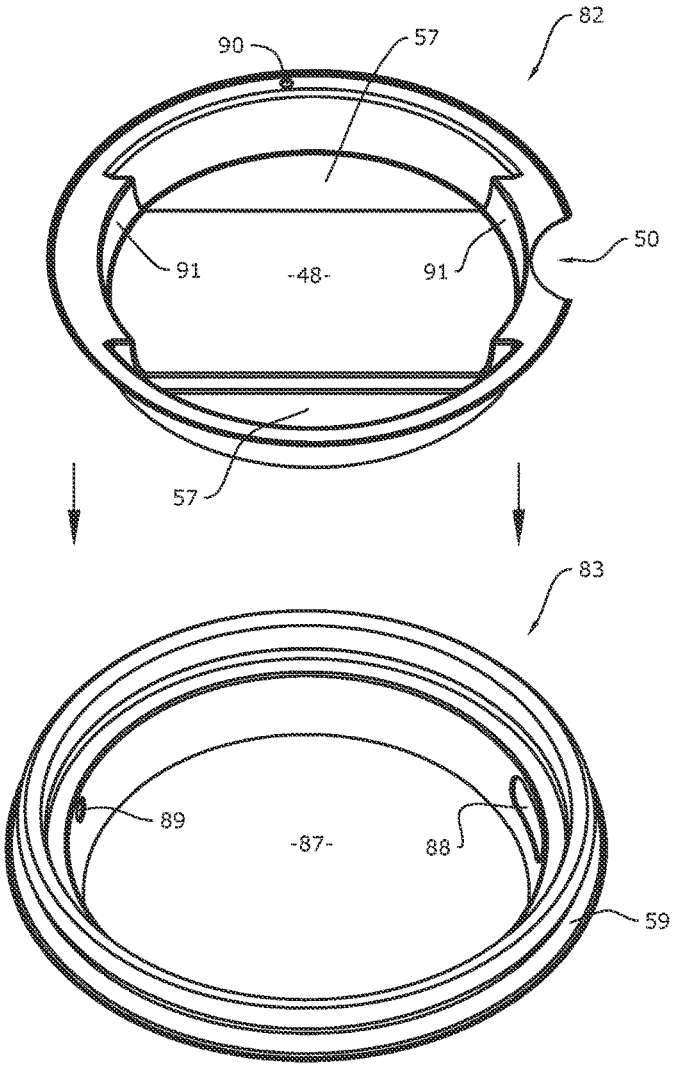

FIG. 66 is an exploded top perspective view of the fifth alternative lid assembly according to the present invention showing from top to bottom the upper lid construction and the lower lid construction in a second open condition of use.

Figure 67:
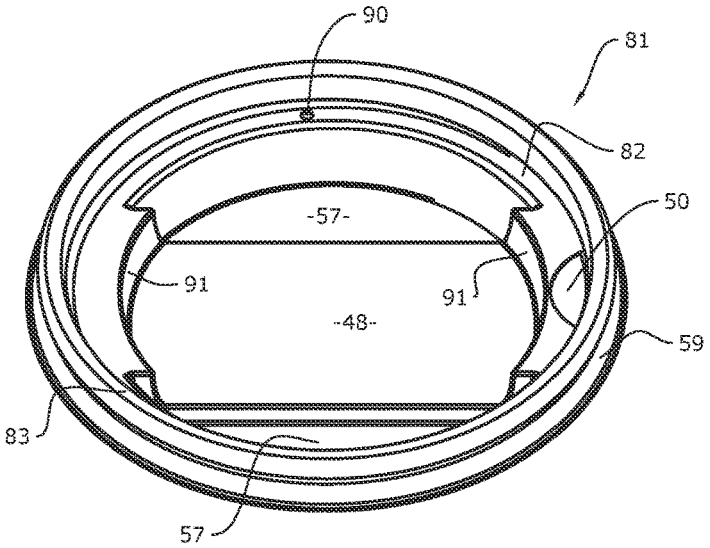

FIG. 67 is a top perspective view of the fifth alternative lid assembly according to the present invention in the second open condition of use.

Figure 68A:
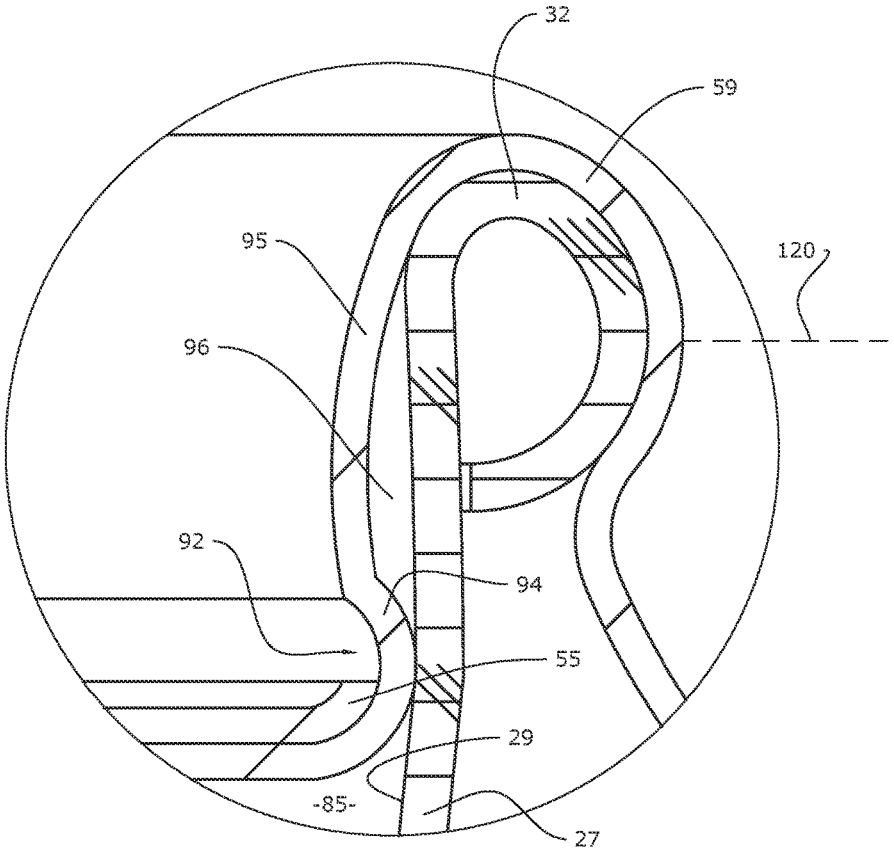
Figure 68:
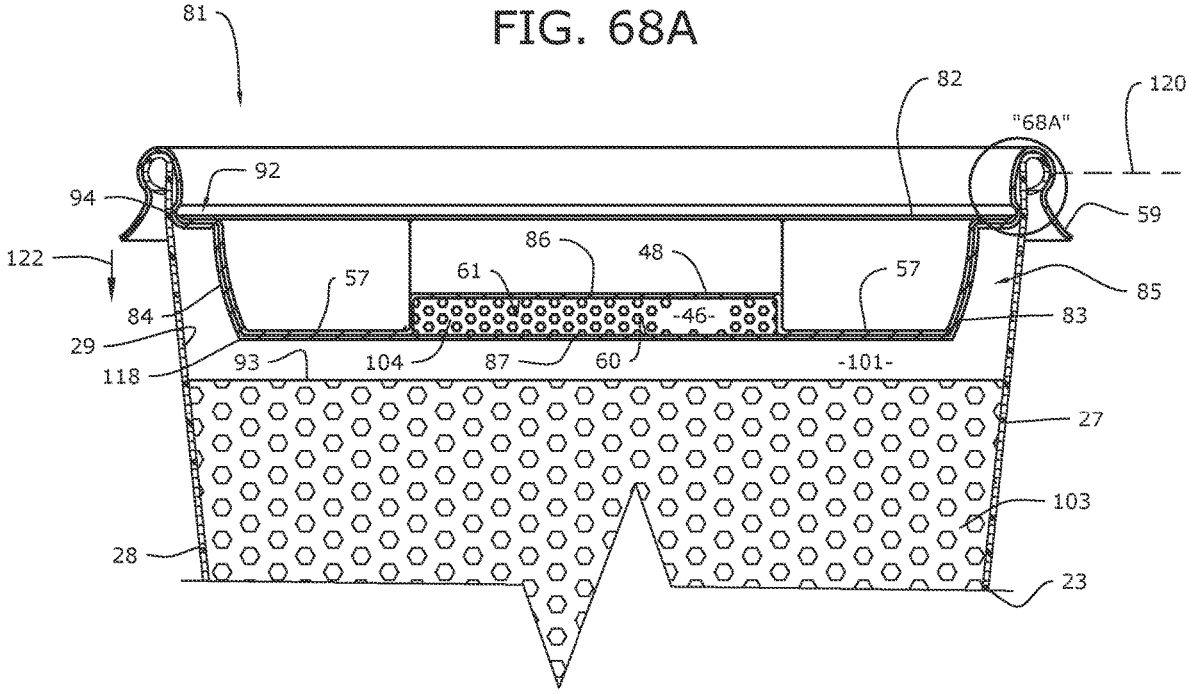

FIG. 68 is an frontal longitudinal cross-sectional vertical view of the fifth alternative lid assembly according to the present invention in assembled relation with a fragmentary upper portion of a liquid container to primarily depict a relatively small liquid volume received in an upper liquid-cooling and liquid-shaping cavity compartment extending in plane substantially parallel to upper liquid surfacing of a relatively large liquid volume received in a lower liquid-containing compartment.

FIG. 68A is an enlarged fragmentary sectional view of the upper right portions of lid-to-container junction site as sectioned from FIG. 68 to depict in greater detail structural formations at the lid-to-container junction site of the fifth alternative lid assembly according to the present invention in assembled relation with a fragmentary upper portion of a liquid container.

Figure 69:
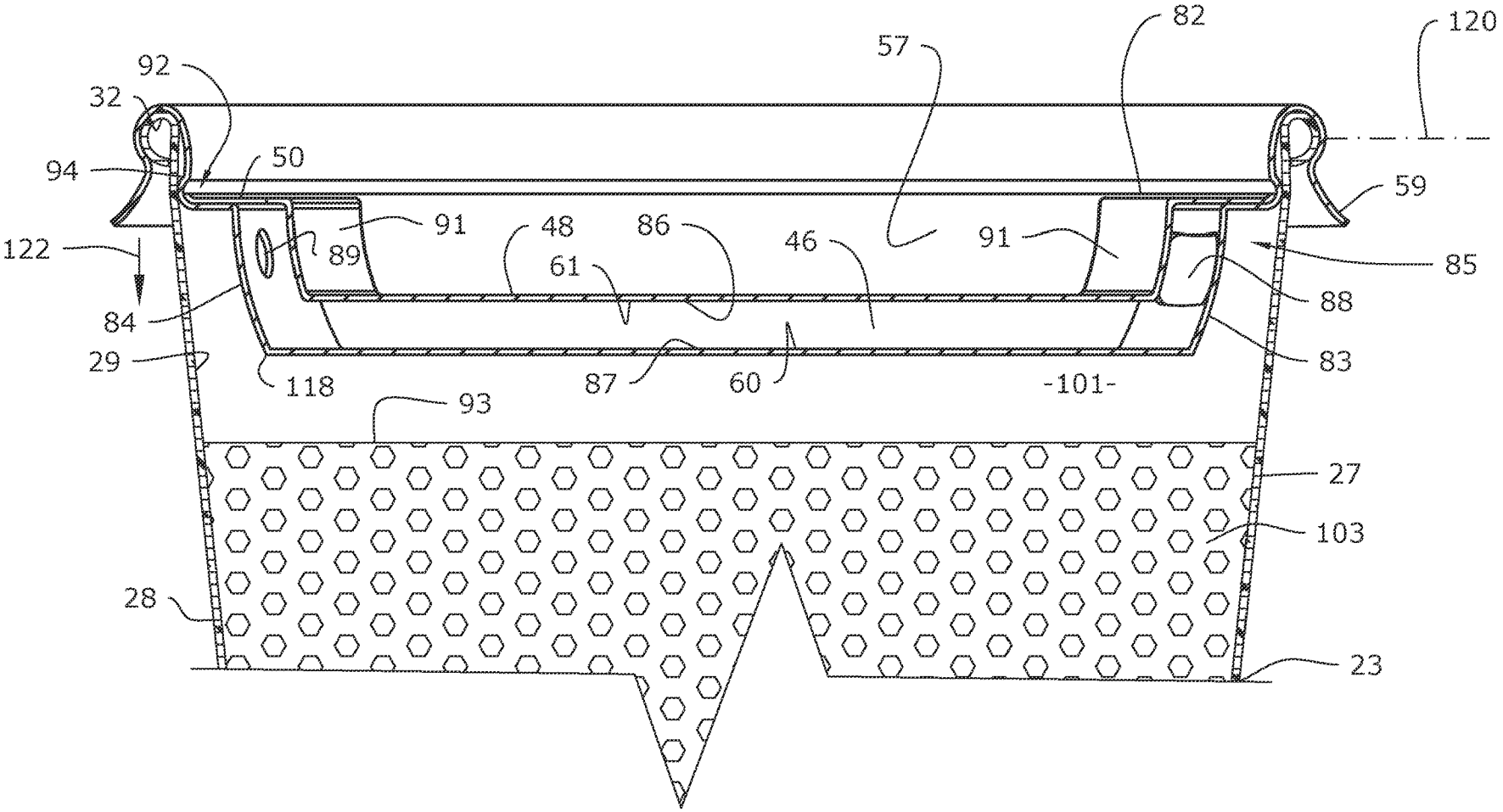

FIG. 69 is a first sequential view of an enlarged medial longitudinal cross-sectional vertical view of the fifth alternative lid assembly according to the present invention depicted in assembled relation with the upper lid construction and the lower lid construction in the first open position of use and in assembled relation with a fragmentary upper portion of a liquid container to primarily depict a relatively large liquid volume received in a lower liquid-containing compartment before directed into an upper liquid-cooling and liquid-shaping cavity compartment defined intermediate the upper lid construction and the lower lid construction.

Figure 70:
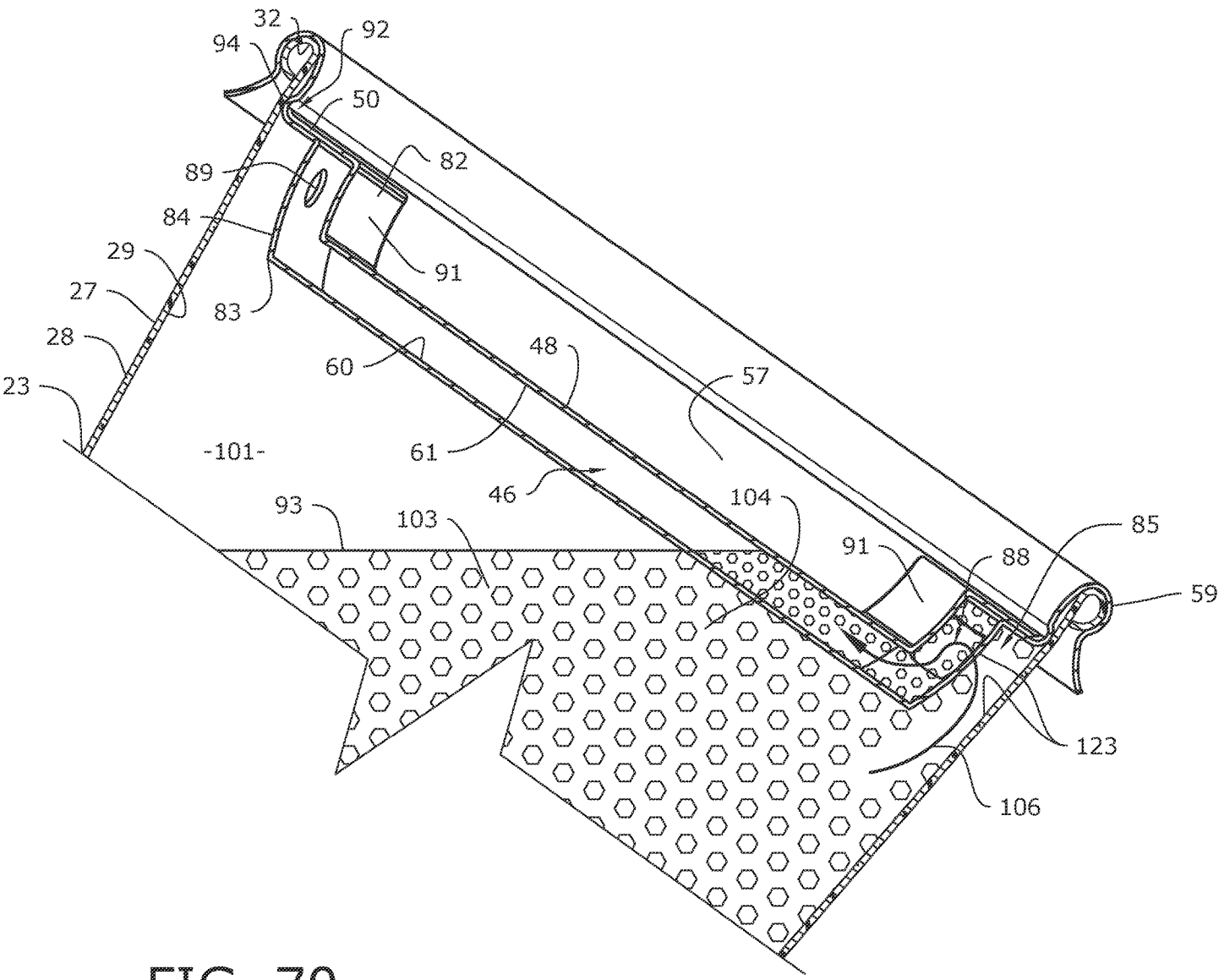

FIG. 70 is a second sequential view of an enlarged medial longitudinal cross-sectional "angled-to-the-right" view of the fifth alternative lid assembly according to the present invention depicted in assembled relation with the upper lid construction and the lower lid construction in the first open position of use and in assembled relation with a fragmentary upper portion of a liquid container to primarily depict a relatively small liquid volume being directed into the upper liquid-cooling and liquid-shaping cavity compartment defined intermediate the upper lid construction and the lower lid construction.

Figure 71:
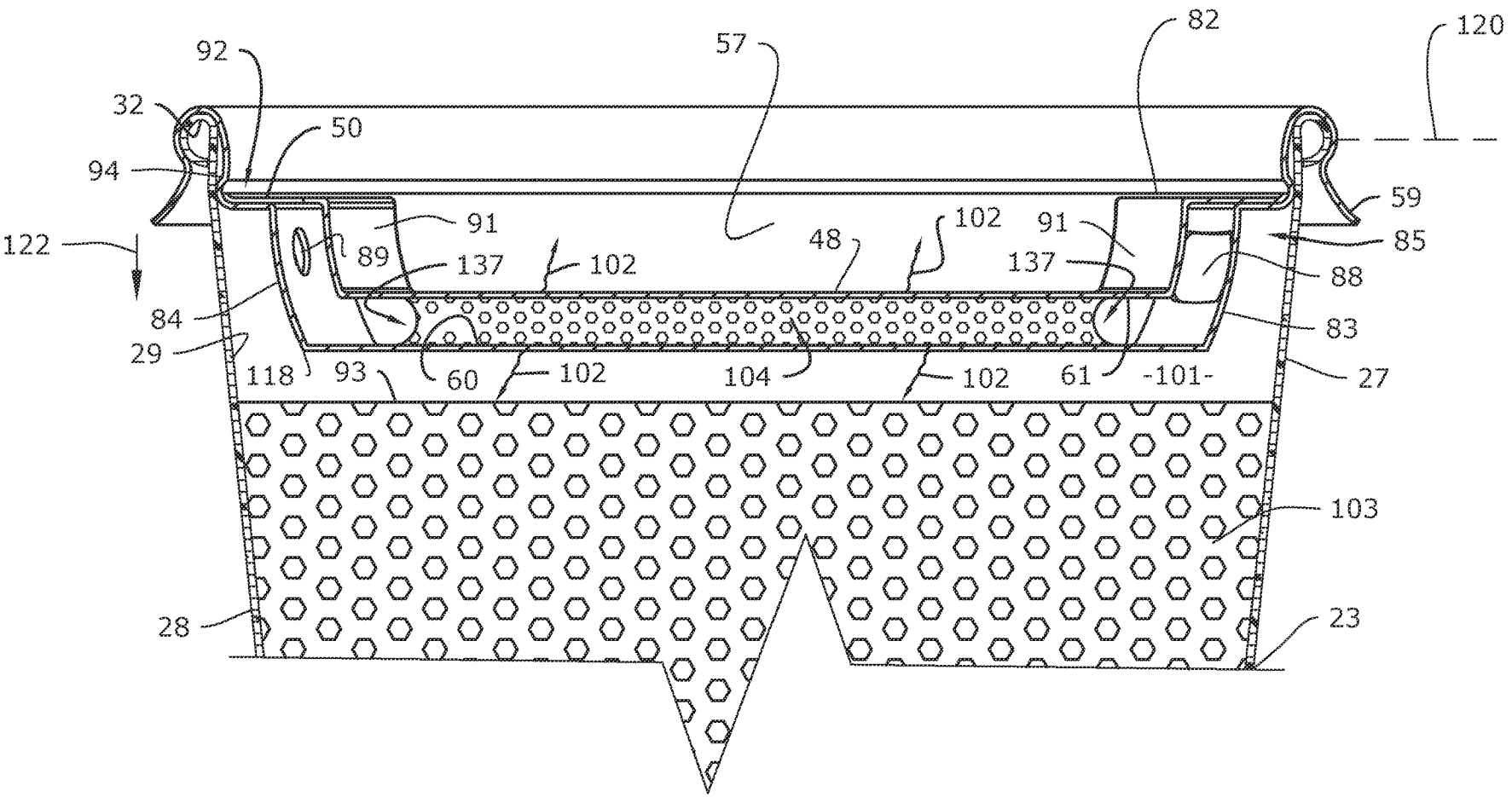

FIG. 71 is a third sequential view of an enlarged medial longitudinal cross-sectional vertical view of the fifth alternative lid assembly according to the present invention depicted in assembled relation with the upper lid construction and the lower lid construction in the first open position of use and in assembled relation with a fragmentary upper portion of a liquid container to primarily depict a relatively small liquid volume received in the upper liquid-cooling and liquid-shaping cavity compartment extending in plane substantially parallel to upper liquid surfacing of the relatively large liquid volume received in the lower liquid-containing compartment.

Figure 72A:
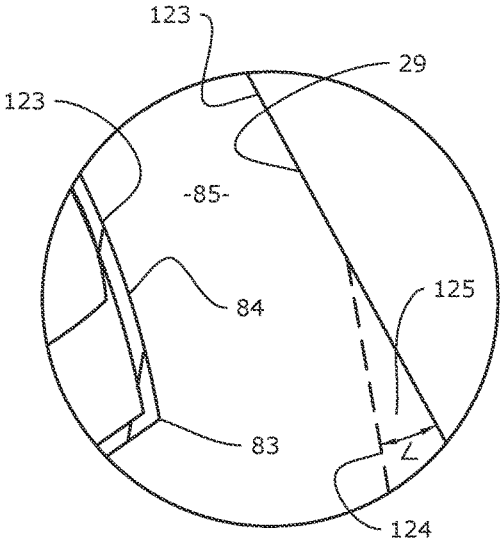
Figure 72:
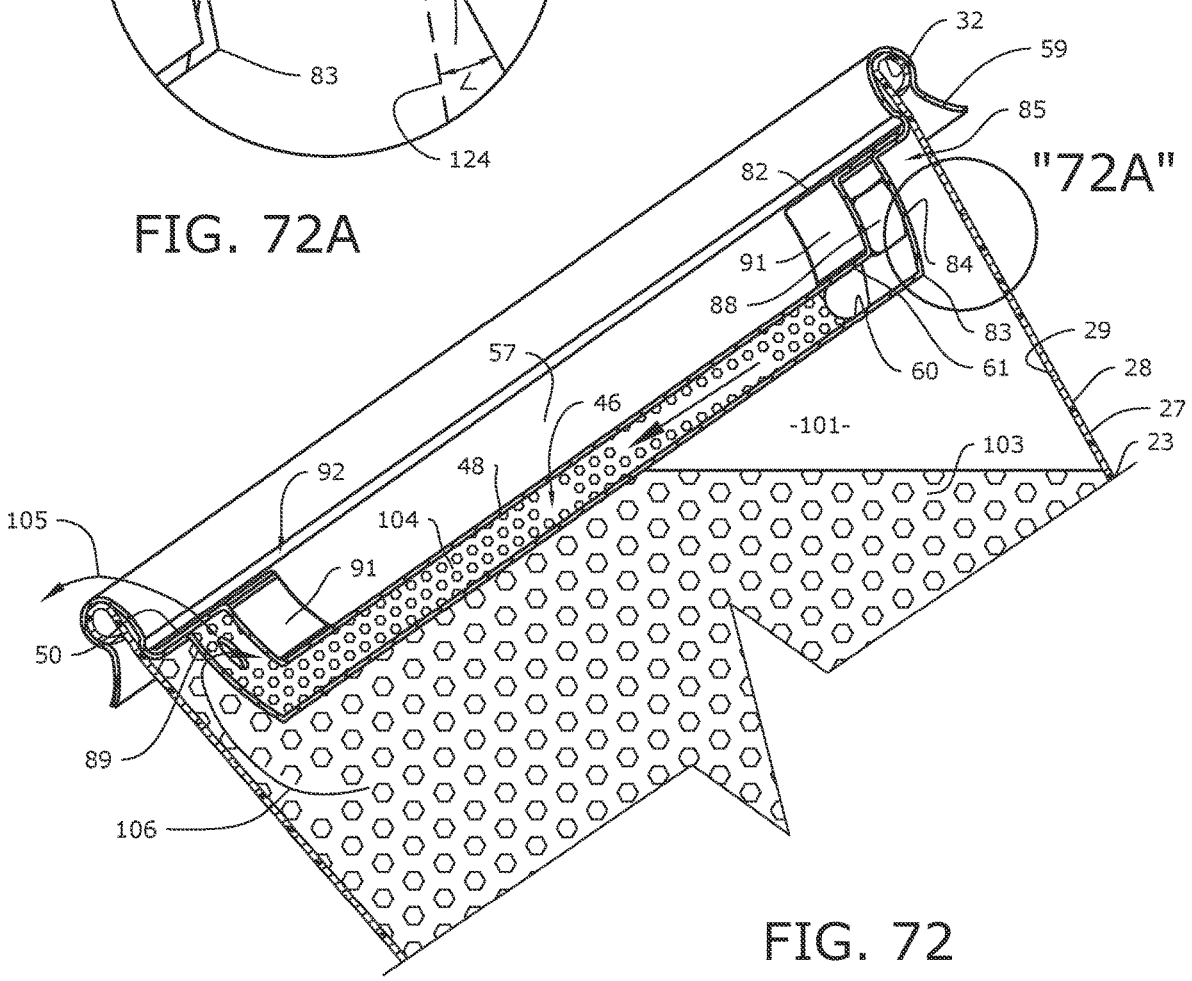

FIG. 72 is a fourth sequential view of a medial longitudinal cross-sectional "angled-to-the-left" view of the fifth alternative lid assembly according to the present invention depicted in assembled relation with the upper lid construction and the lower lid construction in the first open position of use and in assembled relation with a fragmentary upper portion of a liquid container to primarily depict a relatively small liquid volume being directed out of the fifth alternative lid assembly via a primary liquid outlet while simultaneously mixing with a second relatively small liquid volume being directed into the upper liquid-cooling and liquid-shaping cavity compartment defined intermediate the upper lid construction and the lower lid construction.

FIG. 72A is an enlarged fragmentary schematic type sectional depiction of opposed inner container wall surfacing and the outer wall of the lower lid construction of the fifth alternative lid assembly as sectioned from FIG. 72 to depict in greater detail the maximum preferred angle between the outer wall and the inner container wall surfacing.

Figure 73:
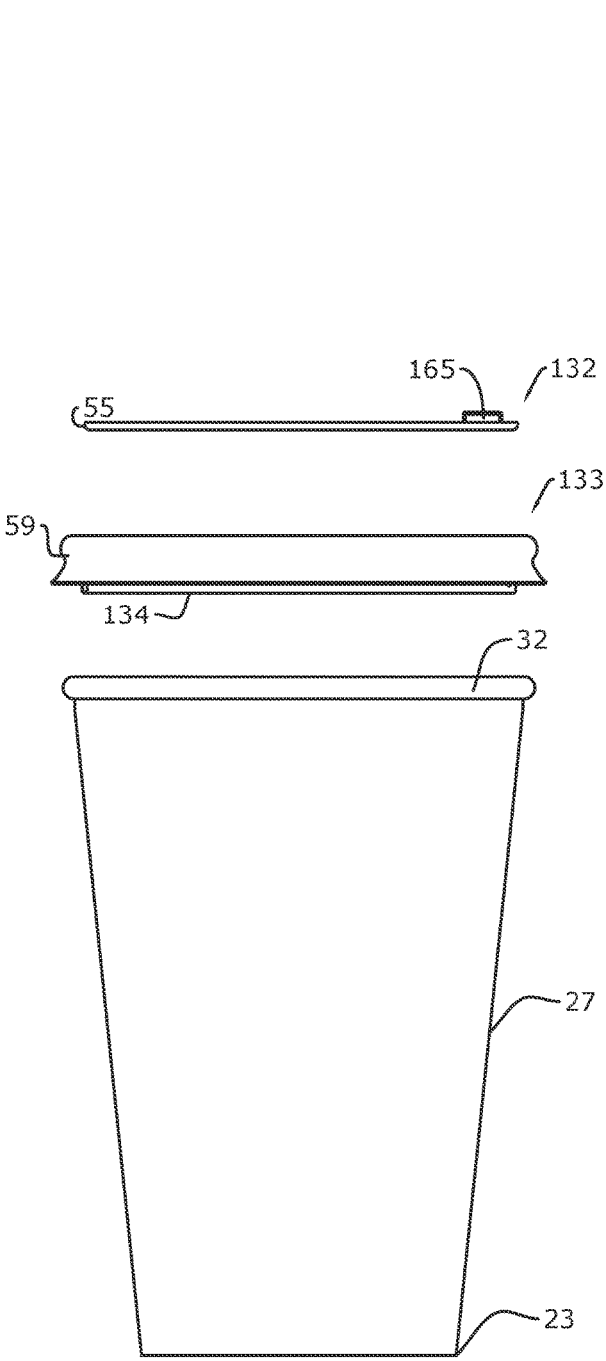

FIG. 73 is an exploded side view of a preferred lid assembly according to the present invention showing from top to bottom, an upper lid construction or insert, a lower lid construction, and a generic liquid container.

Figure 74:
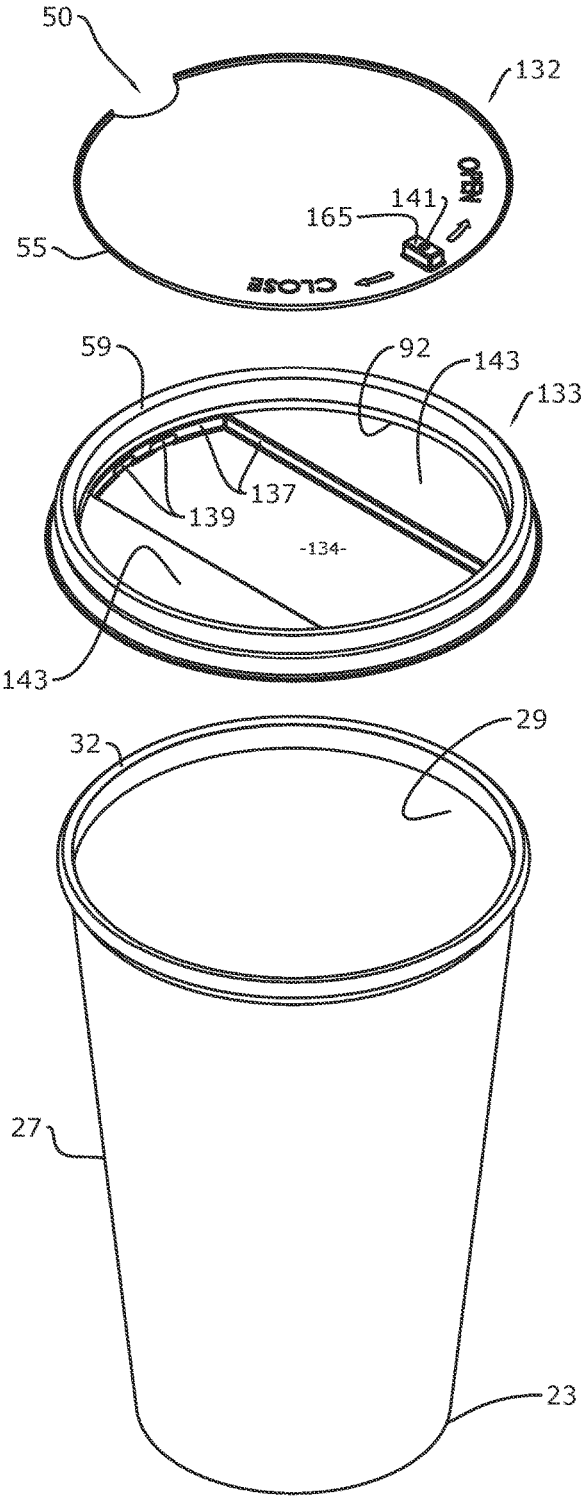

FIG. 74 is an exploded top perspective view of the preferred lid assembly according to the present invention showing from top to bottom, the upper lid construction or insert, the lower lid construction, and a generic liquid container.

Figure 75:
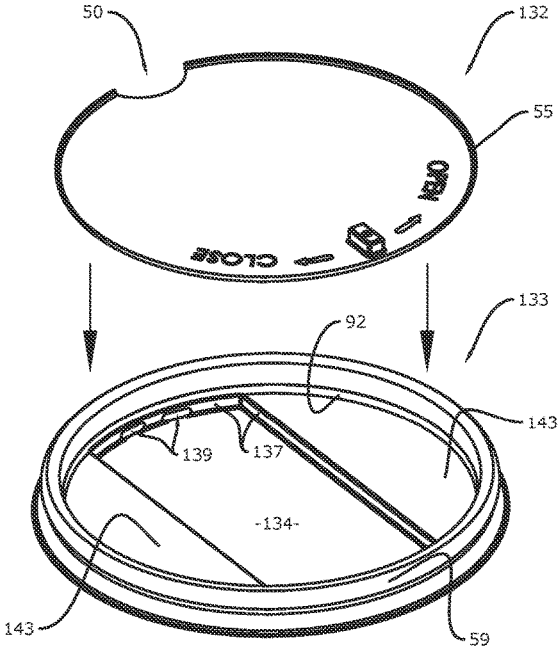

FIG. 75 is an exploded top perspective view of the preferred lid assembly according to the present invention showing from top to bottom the upper lid construction or insert and the lower lid construction in a first open position of use.

Figure 76:
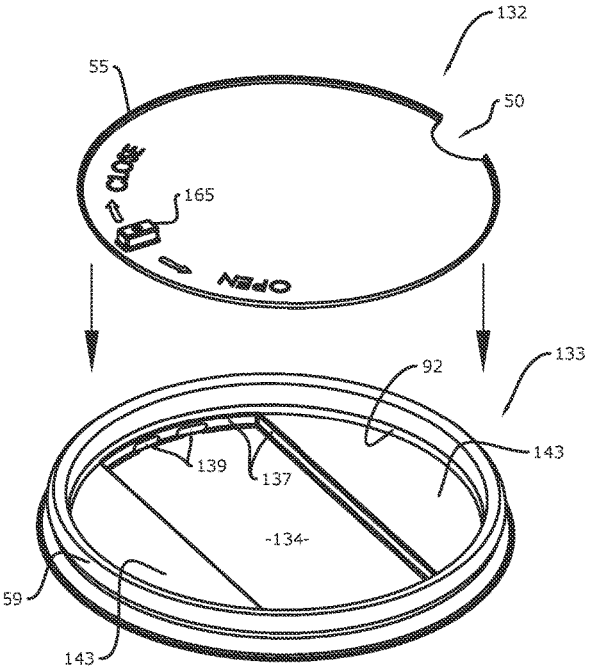

FIG. 76 is a top perspective view of the preferred lid assembly according to the present invention in the first open position of use.

Figure 77:
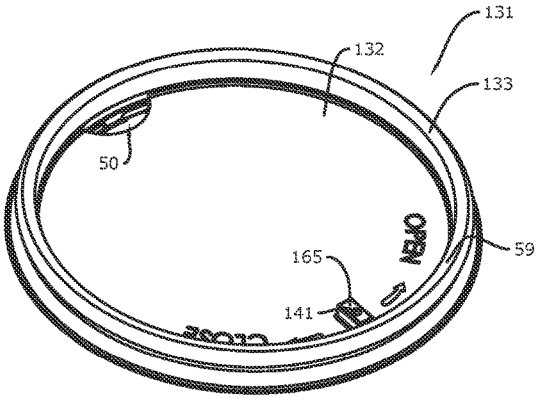

FIG. 77 is an exploded top perspective view of the preferred lid assembly according to the present invention showing from top to bottom the upper lid construction and the lower lid construction in a closed position of use.

Figure 78:
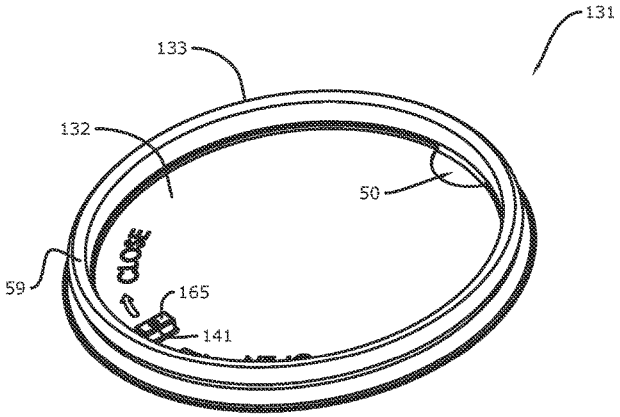

FIG. 78 is a top perspective view of the preferred lid assembly according to the present invention in the closed position of use.

Figure 79:
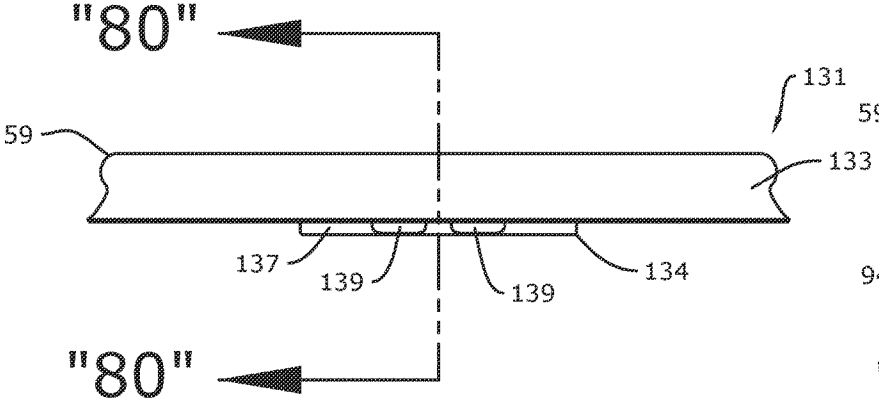

FIG. 79 is a lateral edge elevational view of the preferred lid assembly according to the present invention.

Figure 80:
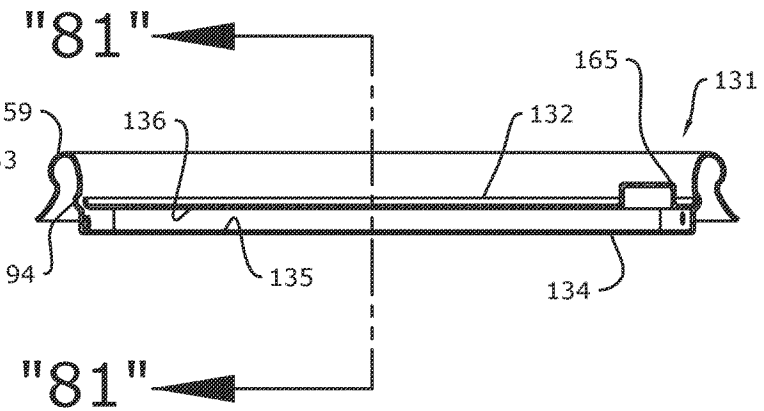

FIG. 80 is a medial longitudinal cross-sectional view of the preferred lid assembly according to the present invention in the first open position of use as sectioned from FIG. 79.

Figure 81:
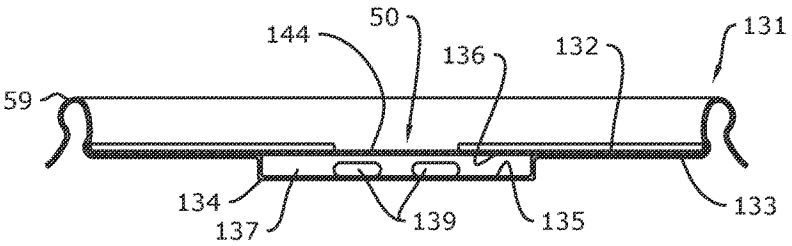

FIG. 81 is a frontal longitudinal sectional view of the preferred lid assembly according to the present invention.

Figure 82:
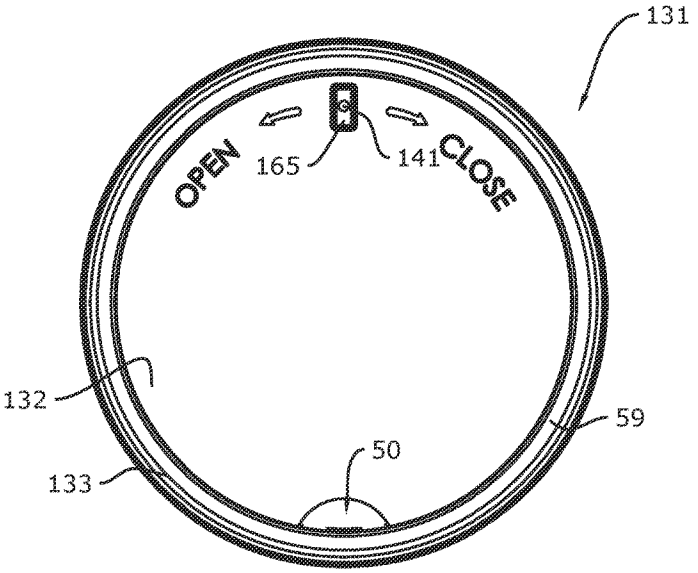

FIG. 82 is a top plan view of the preferred lid assembly according to the present invention.

Figure 83:
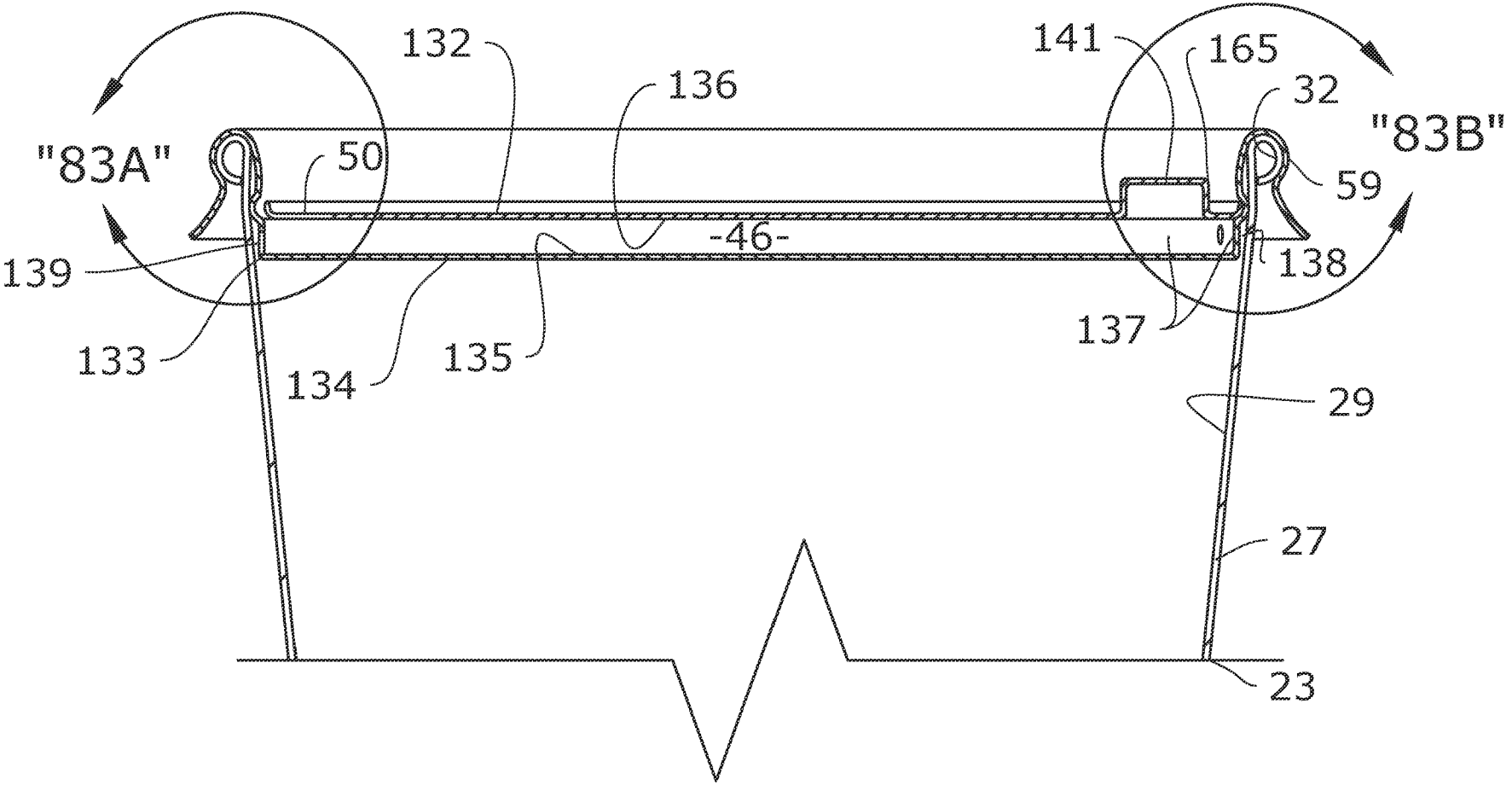

FIG. 83 is an enlarged medial longitudinal cross-sectional vertical view of the preferred lid assembly according to the present invention in assembled relation with a fragmentary upper portion of a liquid container.

Figure 83A:
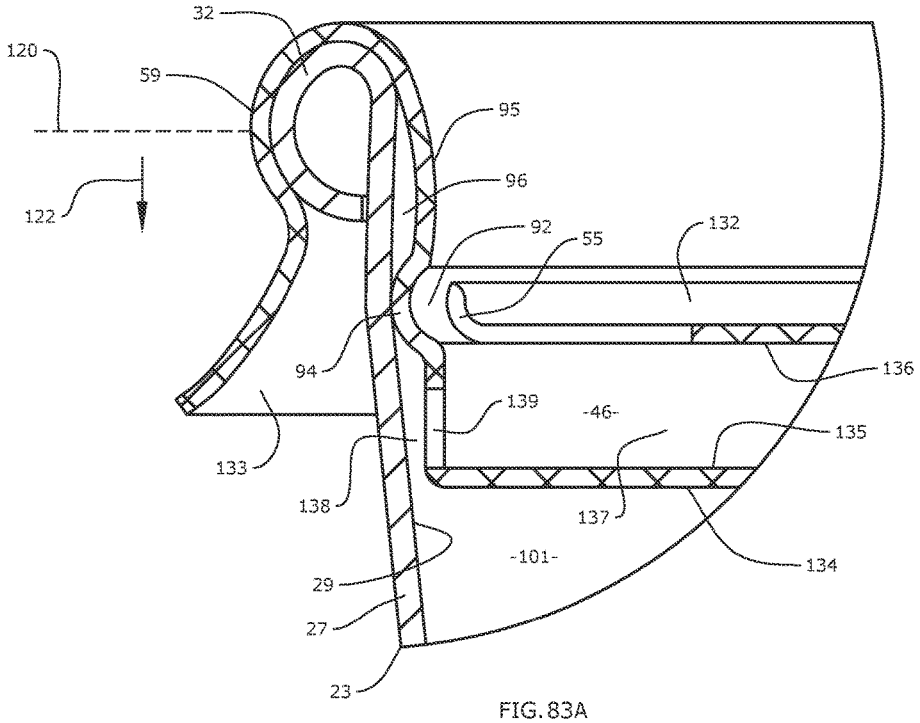

FIG. 83A is an enlarged fragmentary sectional view of the upper left portions of lid-to-container junction site as sectioned from FIG. 83 to depict in greater detail structural formations at the lid-to-container junction site of the preferred lid assembly according to the present invention in assembled relation with a fragmentary upper portion of a liquid container.

Figure 83B:
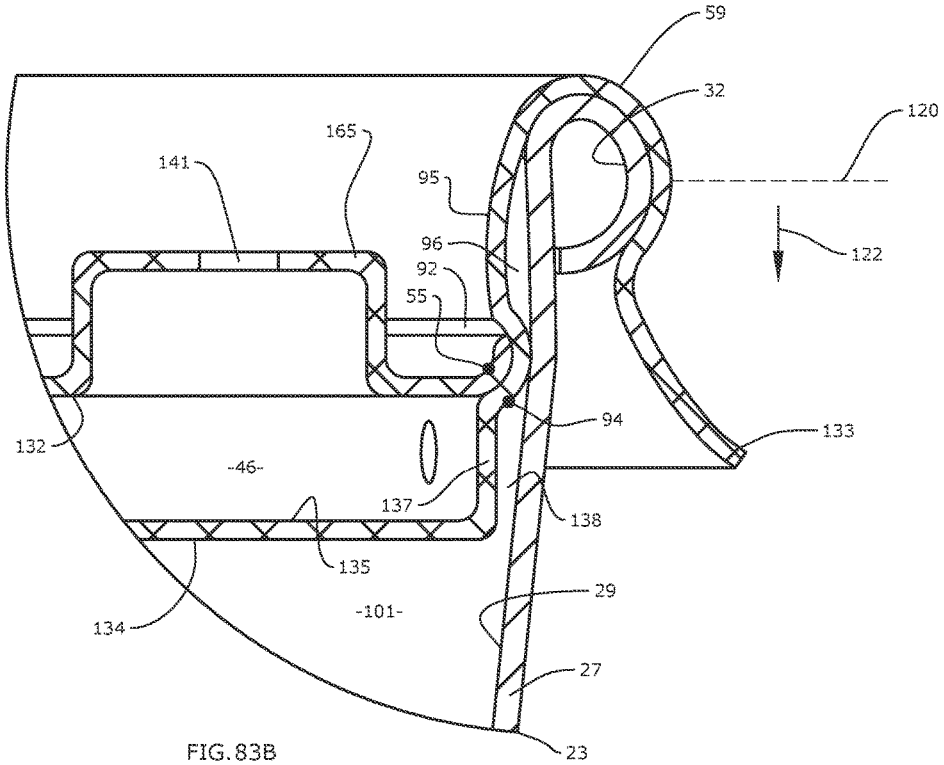

FIG. 83B is an enlarged fragmentary sectional view of the upper right portions of lid-to-container junction site as sectioned from FIG. 83 to depict in greater detail structural formations at the lid-to-container junction site of the preferred lid assembly according to the present invention in assembled relation with a fragmentary upper portion of a liquid container.

Figure 84:
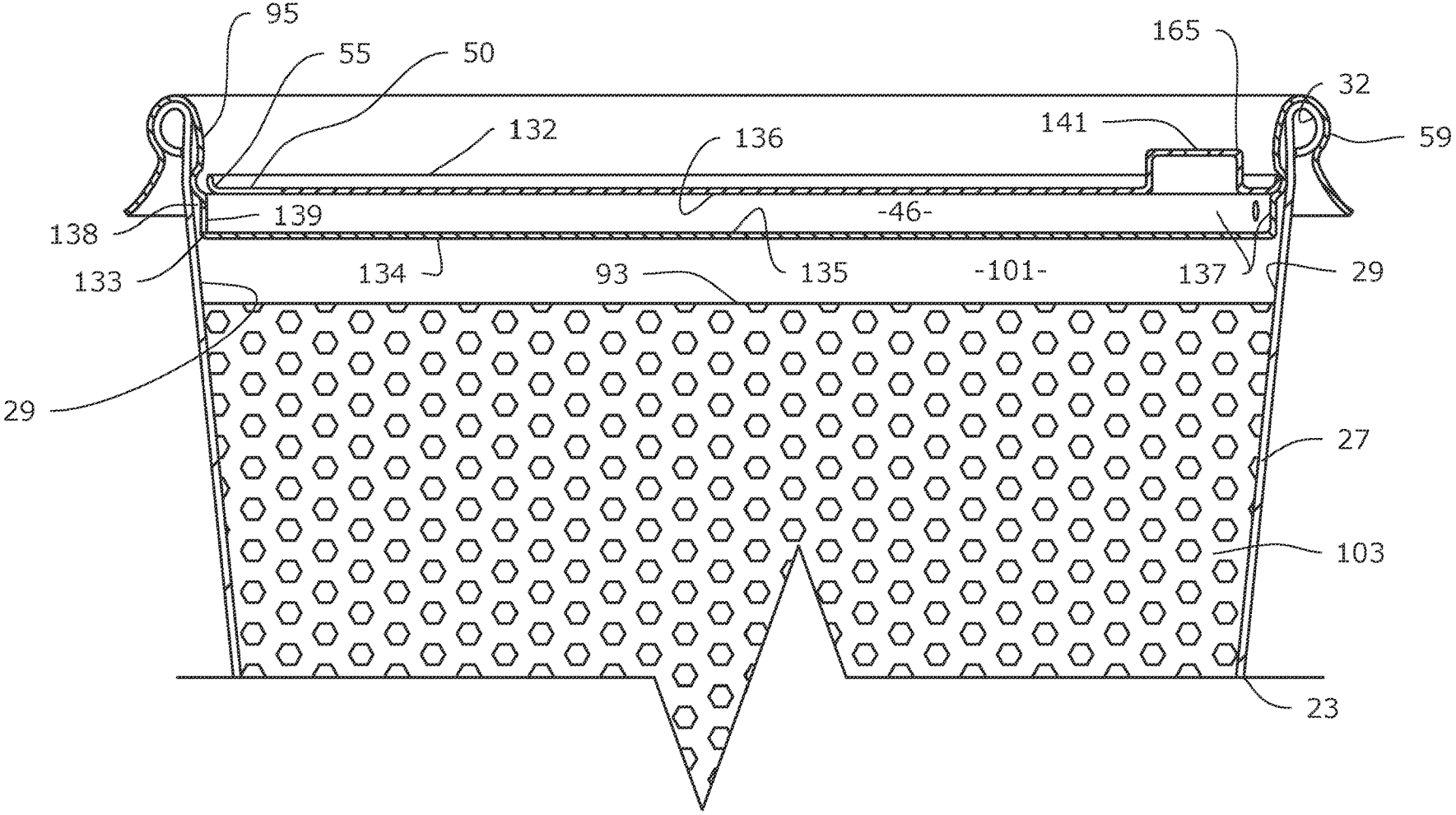

FIG. 84 is a first sequential view of an enlarged medial longitudinal cross-sectional vertical view of the preferred lid assembly according to the present invention depicted in assembled relation with the upper lid construction and the lower lid construction in the first open position of use and in assembled relation with a fragmentary upper portion of a liquid container to primarily depict a relatively large liquid volume received in a lower liquid-containing compartment before directed into an upper liquid-cooling and liquid-shaping cavity compartment defined intermediate the upper lid construction and the lower lid construction.

Figure 85A:
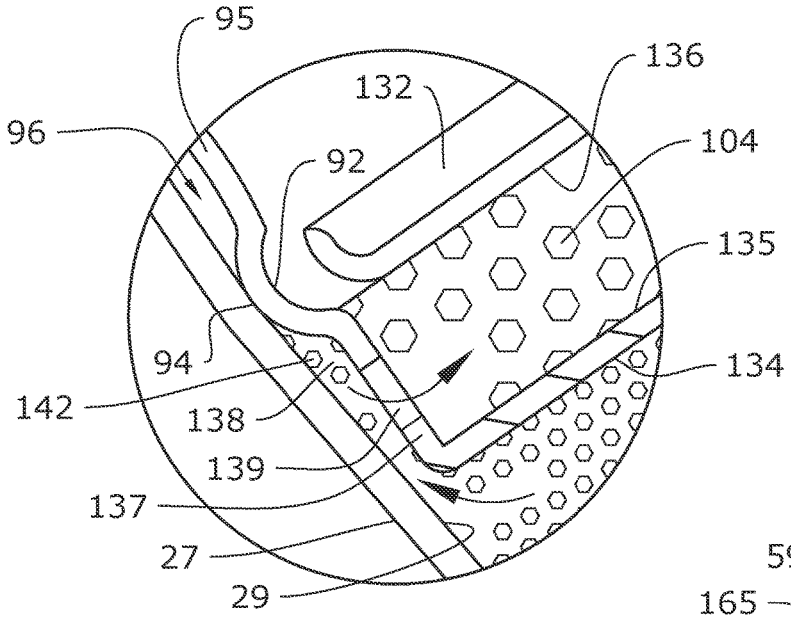
Figure 85:
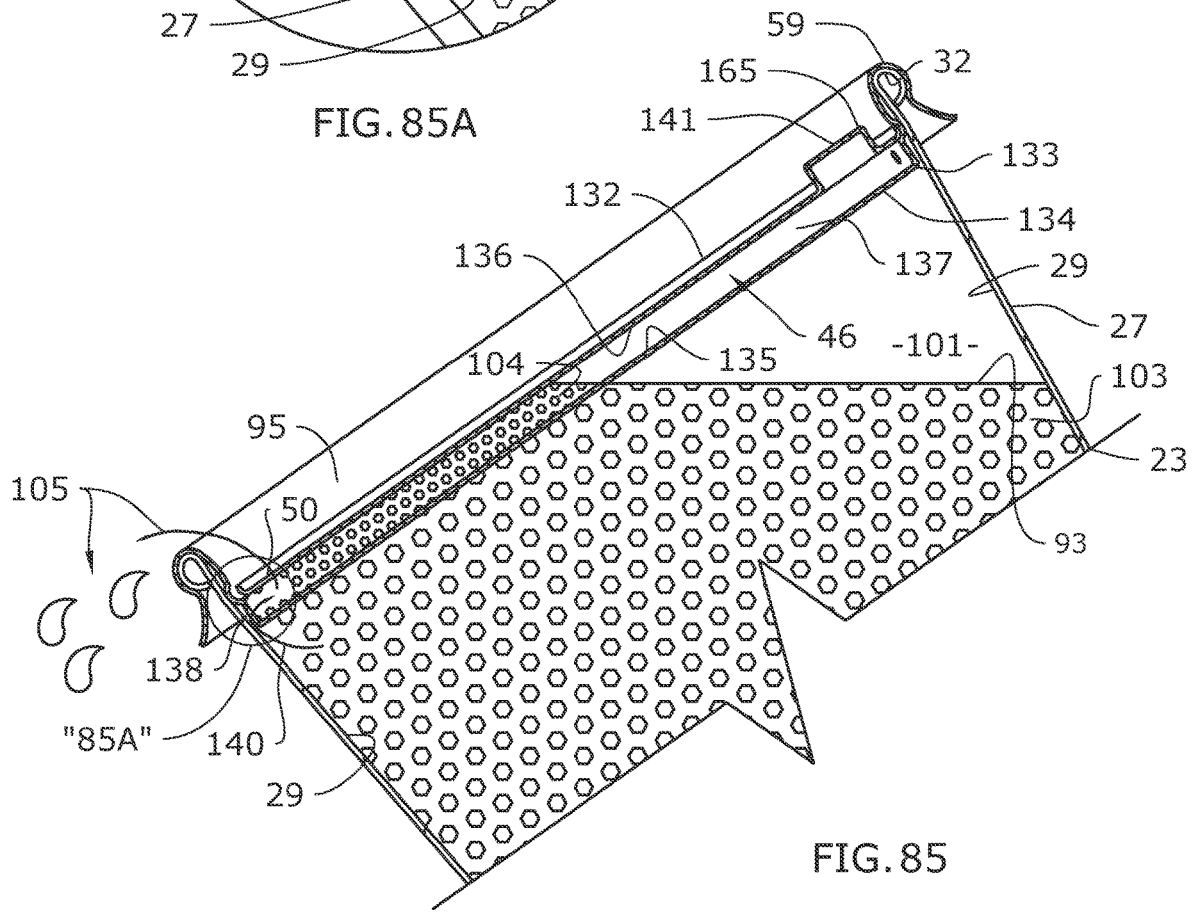

FIG. 85 is a second sequential view of a medial longitudinal cross-sectional "angled-to-the-left" view of the preferred lid assembly according to the present invention depicted in assembled relation with the upper lid construction and the lower lid construction in the first open position of use and in assembled relation with a fragmentary upper portion of a liquid container to primarily depict a relatively small liquid volume being directed into the upper liquid-cooling and liquid-shaping cavity compartment defined intermediate the upper lid construction and the lower lid construction.

FIG. 85A is an enlarged fragmentary sectional view of the upper left portions of the lid-to-container junction site as sectioned from FIG. 85 to depict in greater detail liquid adherence within a channel formed between the lower lid construction and the inner container wall surfacing of the liquid container.

Figure 86:
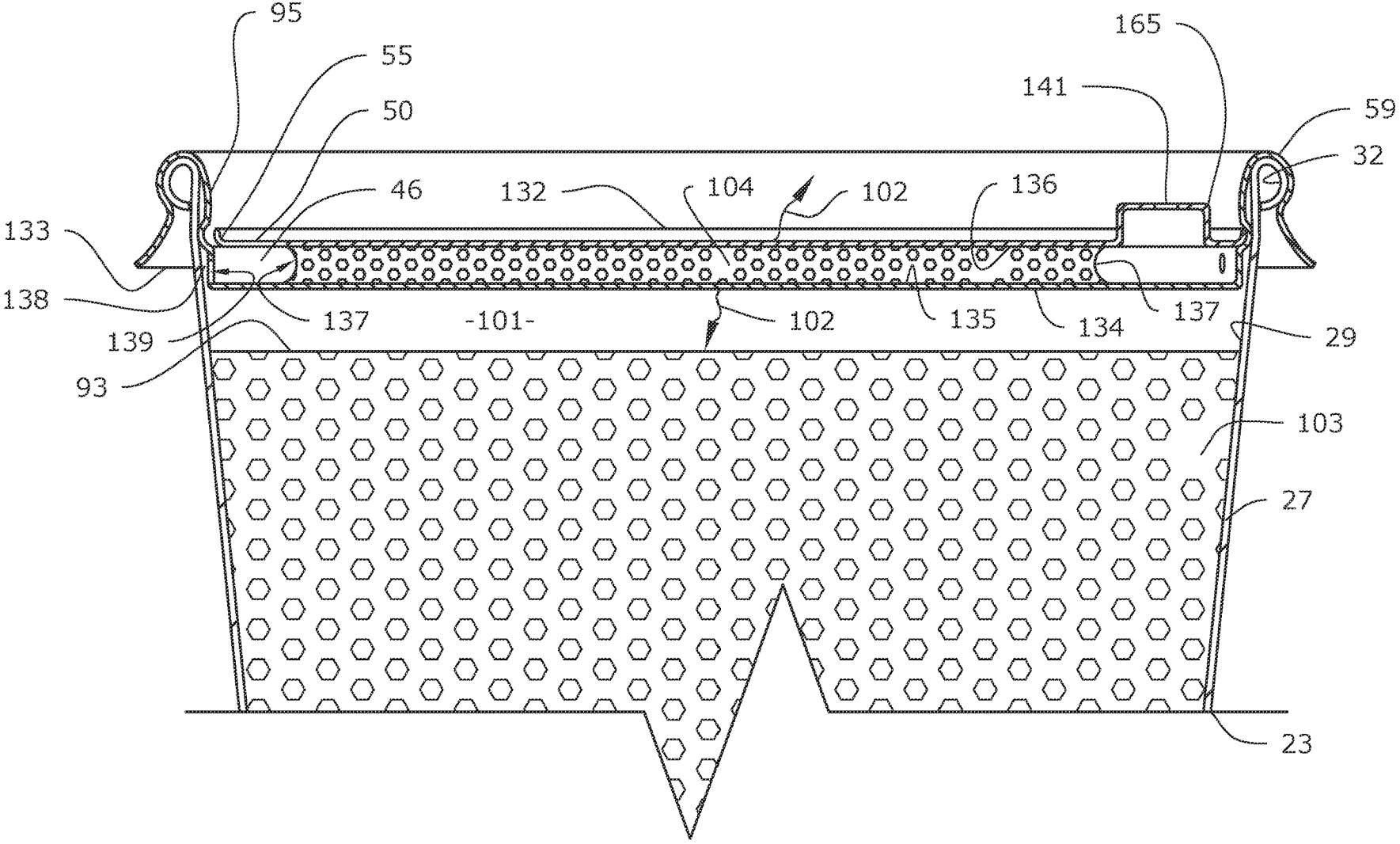

FIG. 86 is a third sequential view of an enlarged medial longitudinal cross-sectional vertical view of the preferred lid assembly according to the present invention depicted in assembled relation with the upper lid construction and the lower lid construction in the first open position of use and in assembled relation with a fragmentary upper portion of a liquid container to primarily depict a relatively small liquid volume received in the upper liquid-cooling and liquid-shaping cavity compartment extending in plane substantially parallel to upper liquid surfacing of the relatively large liquid volume received in the lower liquid-containing compartment.

Figure 87A:
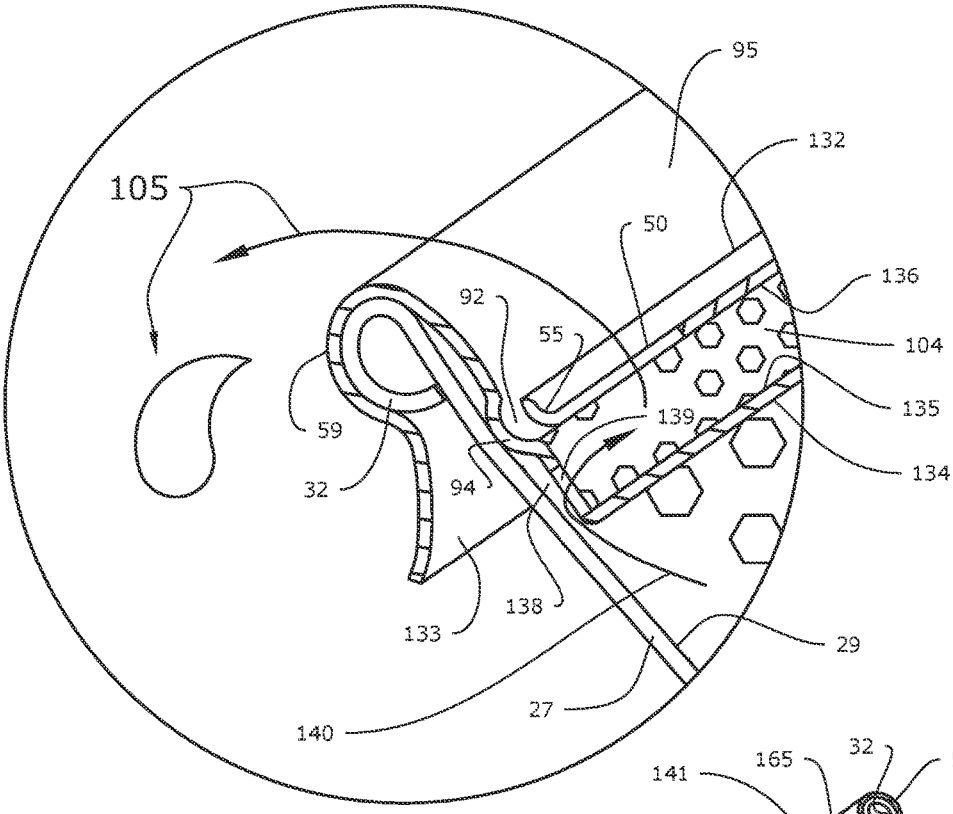
Figure 87:
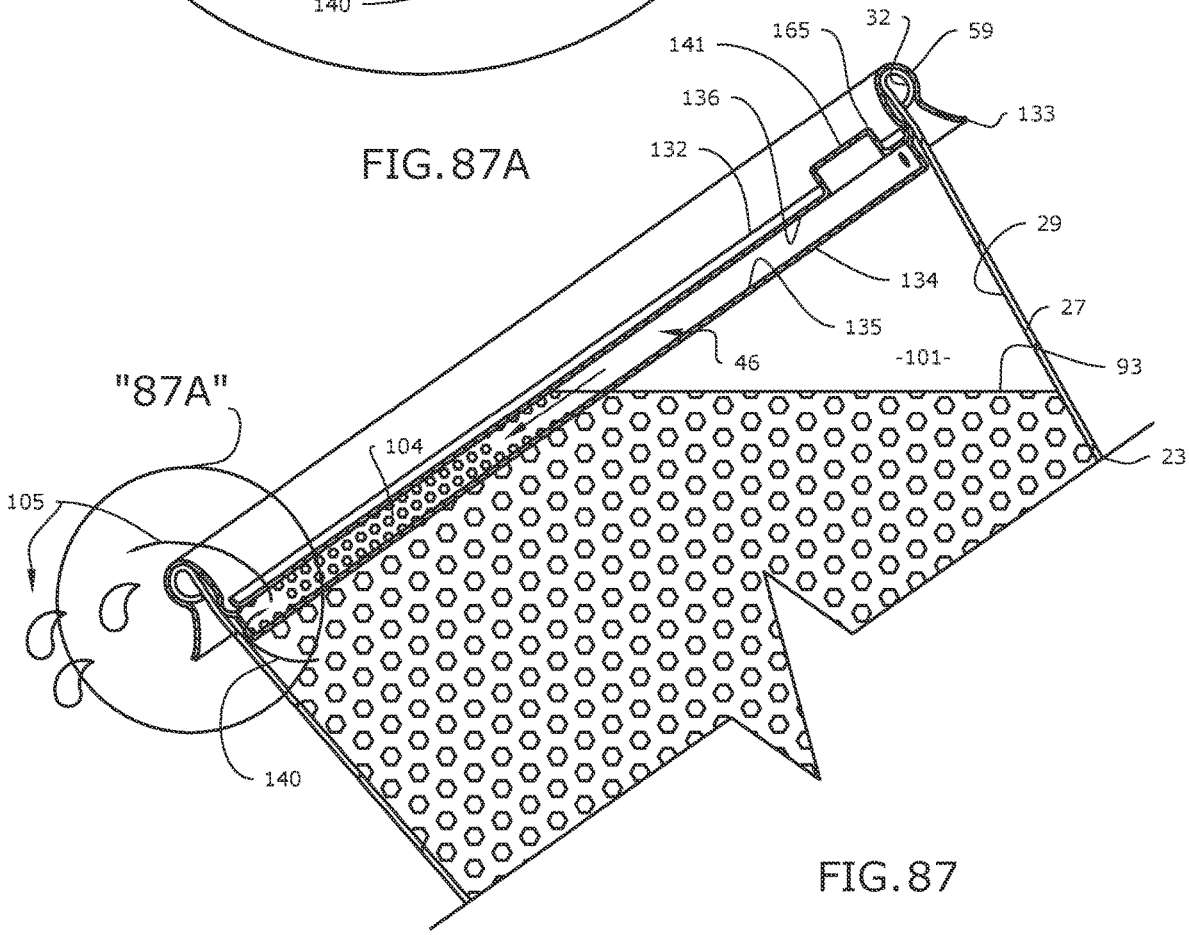

FIG. 87 is a fourth sequential view of an enlarged medial longitudinal cross-sectional "angled-to-the-left" view of the preferred lid assembly according to the present invention depicted in assembled relation with the upper lid construction and the lower lid construction in the first open position of use and in assembled relation with a fragmentary upper portion of a liquid container to primarily depict a relatively small liquid volume being directed out of the preferred lid assembly via a primary liquid outlet while simultaneously mixing with a second relatively small liquid volume being directed into the upper liquid-cooling and liquid-shaping cavity compartment defined intermediate the upper lid construction and the lower lid construction.

FIG. 87A is an enlarged fragmentary sectional view of the upper left portions of the lid-to-container junction site as sectioned from FIG. 87 to depict in greater detail liquid flow characteristics of the relatively small liquid volume being directed out of the preferred lid assembly via a primary liquid outlet while simultaneously mixing with the second relatively small liquid volume being directed into the upper liquid-cooling and liquid-shaping cavity compartment defined intermediate the upper lid construction and the lower lid construction.

Figure 88:
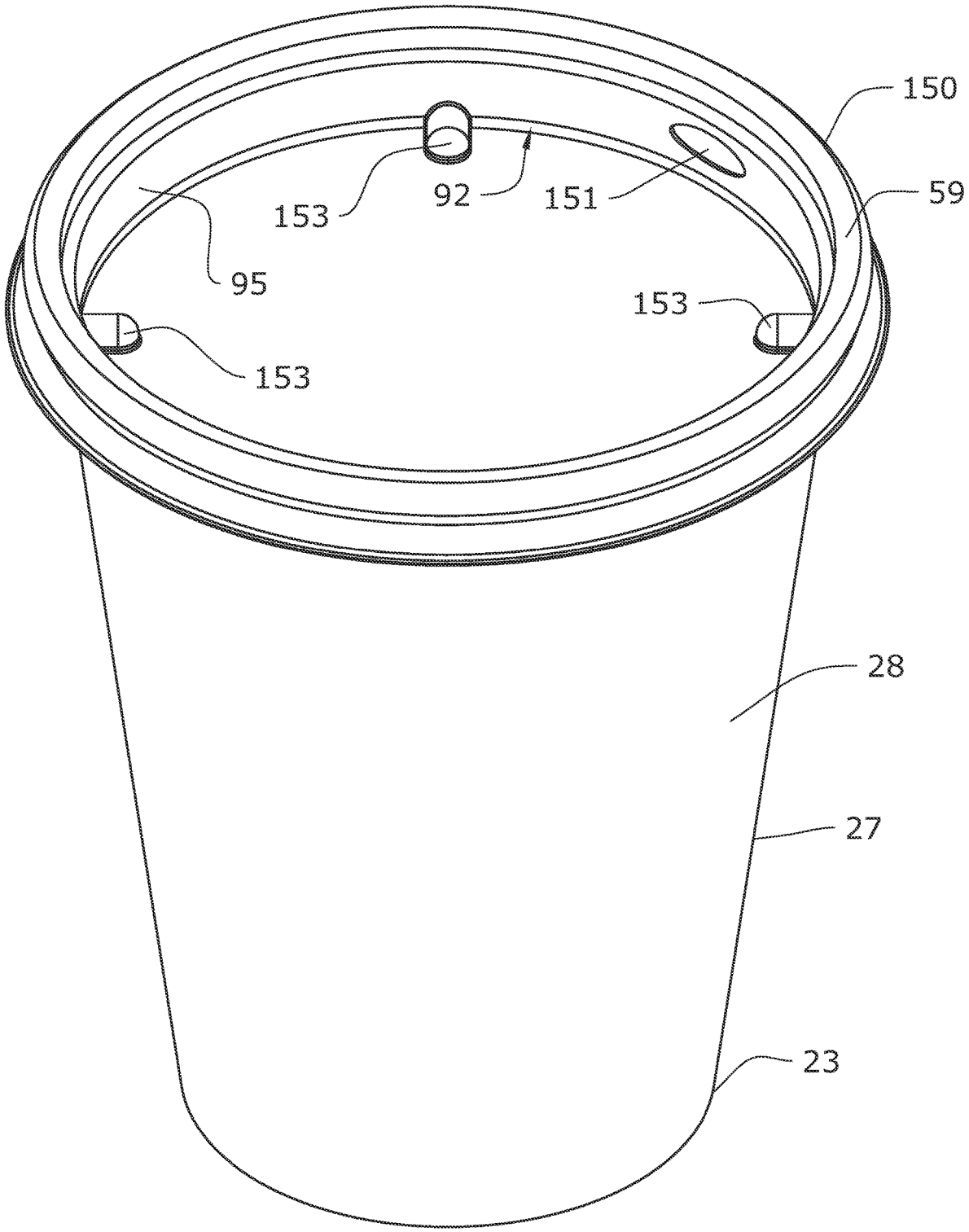

FIG. 88 is a top perspective view of a first alternative unibody lid construction according to the present invention outfitted upon a generic liquid container.

Figure 88A:
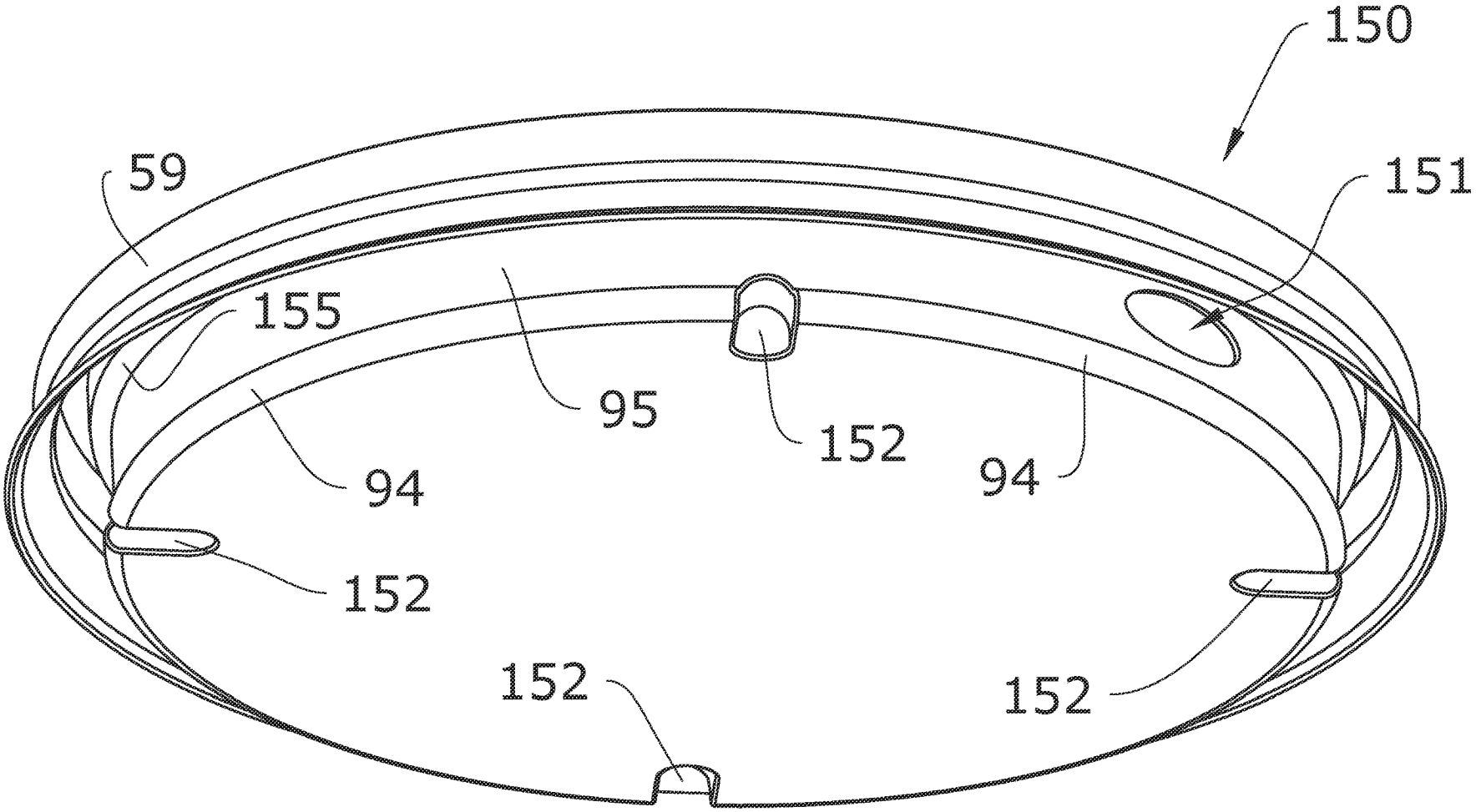

FIG. 88A is a bottom perspective view of the first alternative unibody lid construction according to the present invention.

Figure 89A:
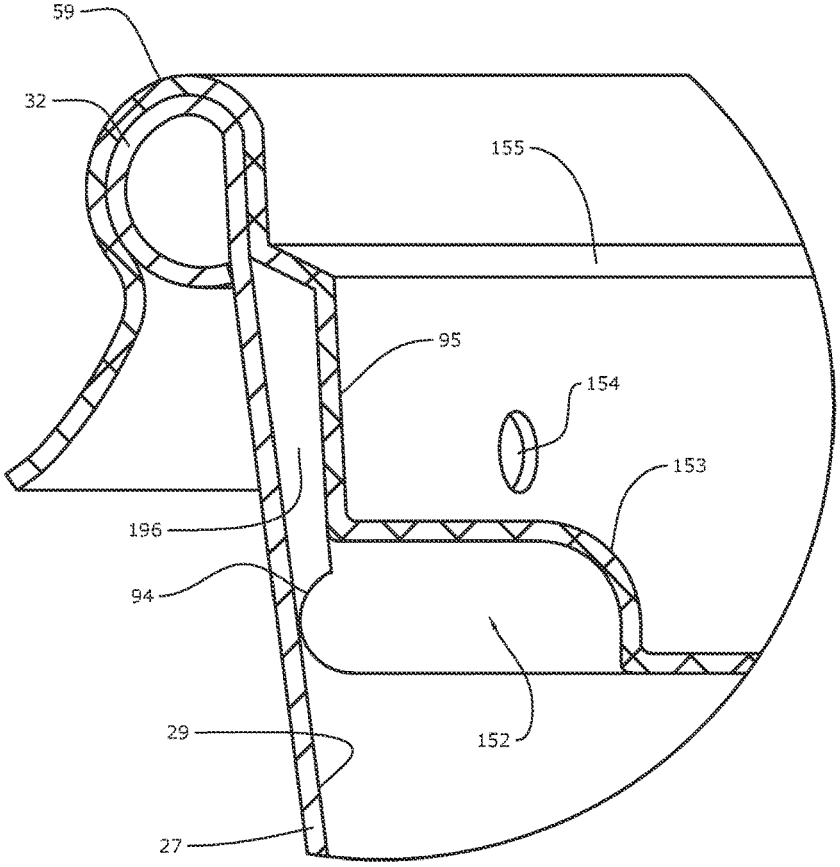
Figure 89:
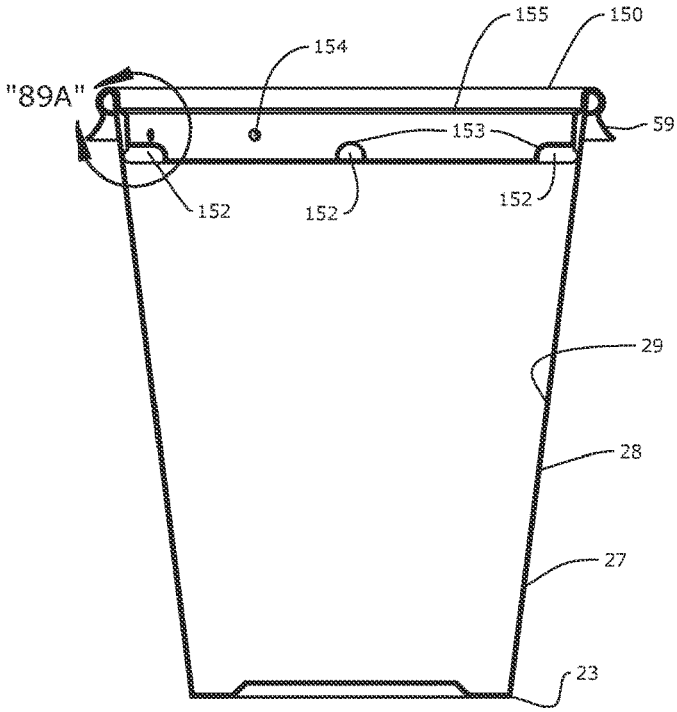

FIG. 89 is a first longitudinal cross-sectional view of the first alternative unibody lid construction according to the present invention outfitted upon a generic liquid container.

FIG. 89A is an enlarged fragmentary sectional view of the upper left portions of the lid-to-container junction site as sectioned from FIG. 89 to depict in greater detail the structural arrangements of the first alternative unibody lid construction relative to an upper container rim and container wall of the generic liquid container.

Figure 90A:
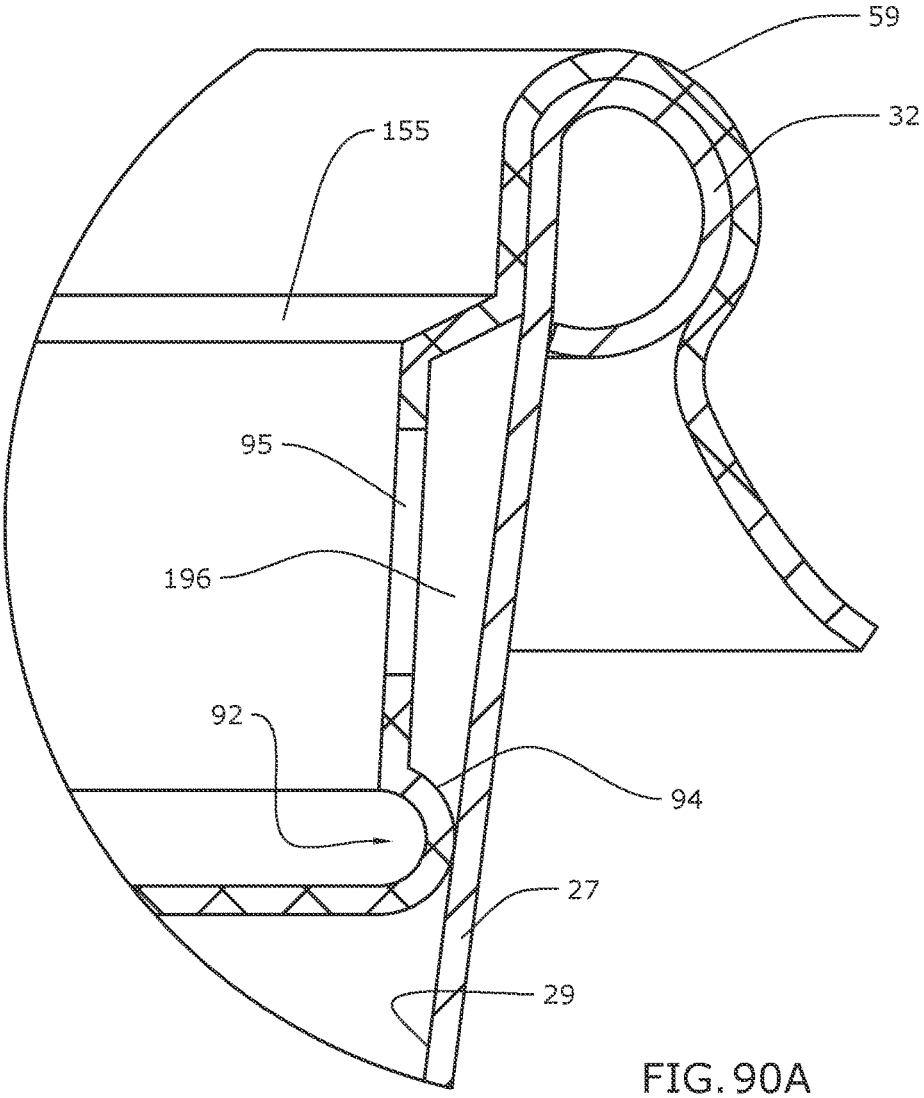
Figure 90:
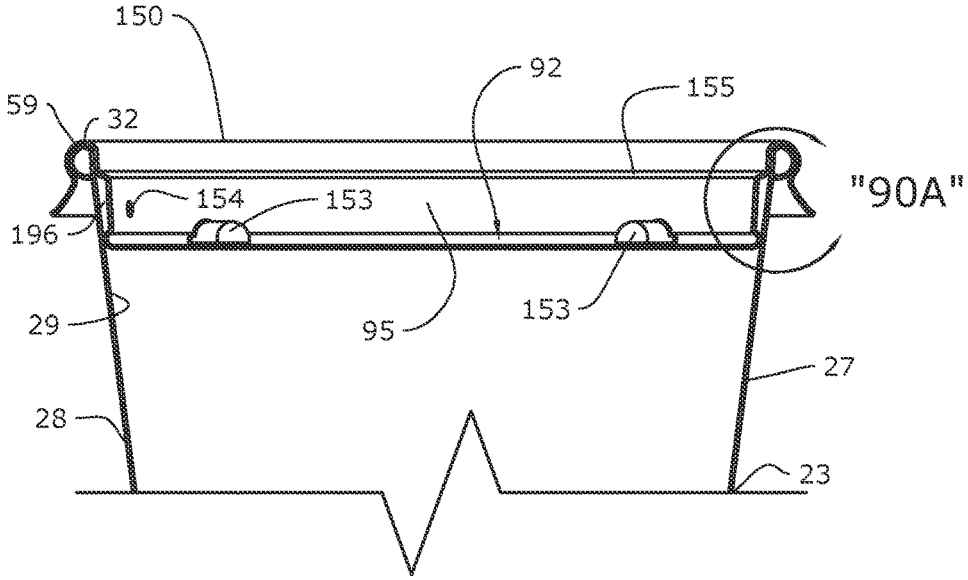

FIG. 90 is a second longitudinal cross-sectional view of the first alternative unibody lid construction according to the present invention sectioned relatively 45 degrees relative to the first longitudinal cross-sectional view otherwise depicted in FIG. 89 as outfitted upon a fragmentary upper portion of a generic liquid container.

FIG. 90A is an enlarged fragmentary sectional view of the upper right portions of the lid-to-container junction site as sectioned from FIG. 90 to depict in greater detail the structural arrangements of the first alternative unibody lid construction relative to an upper container rim and container wall of the generic liquid container.

Figure 91A:
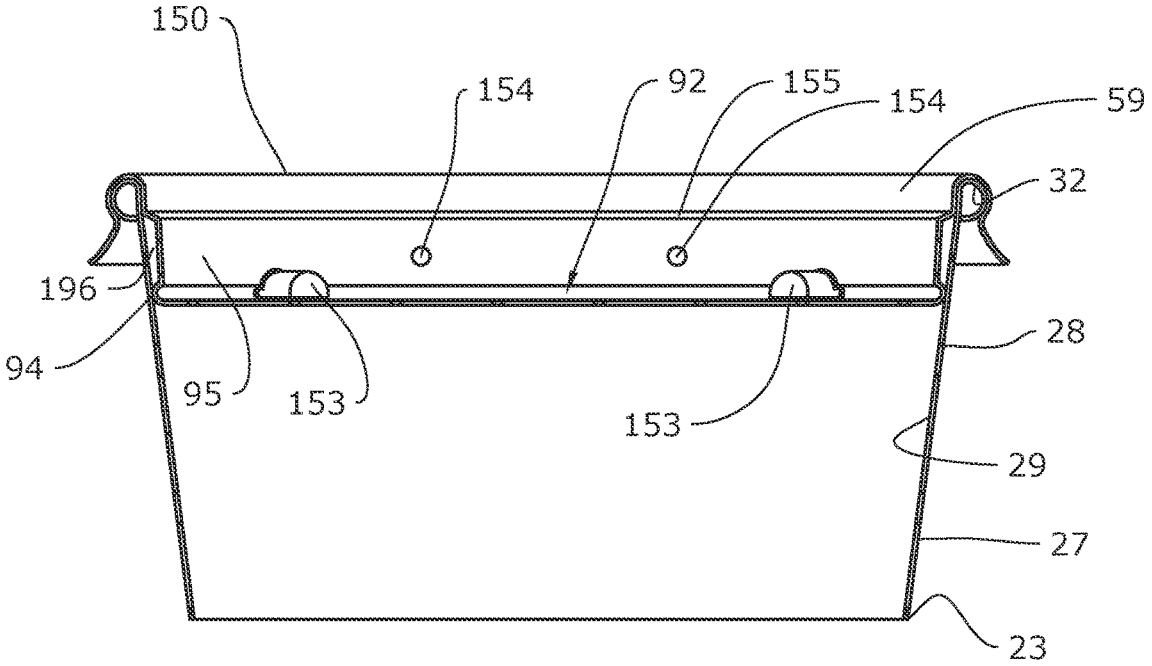
Figure 91:
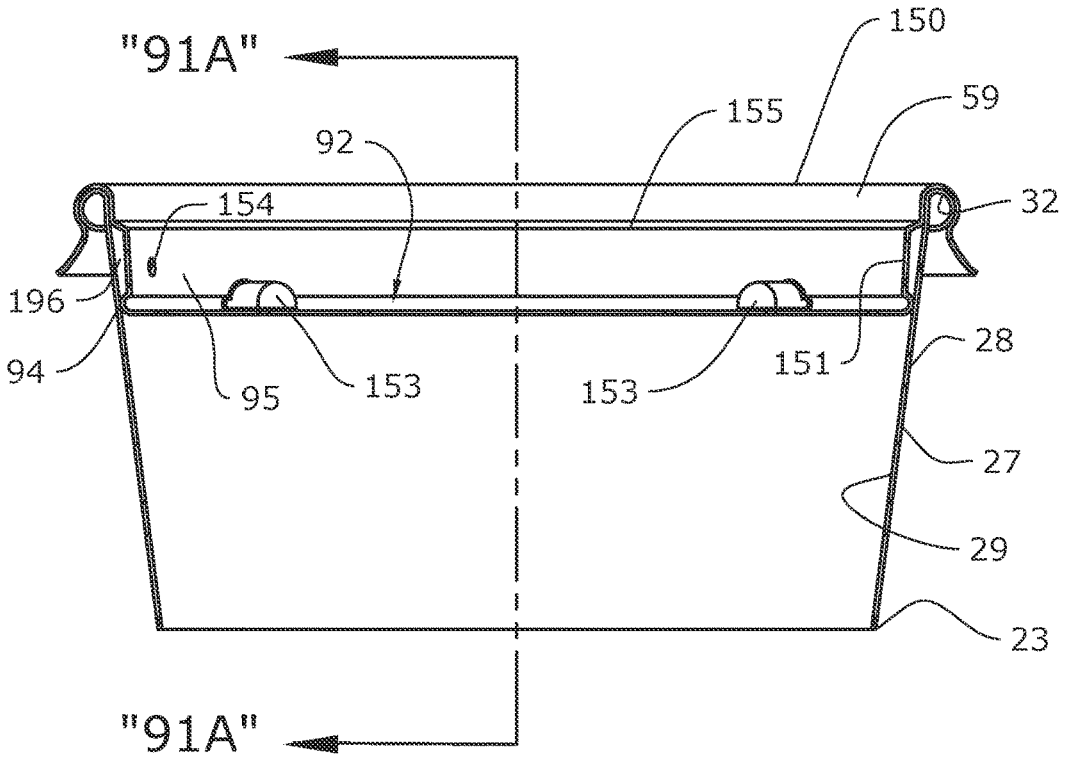

FIG. 91 is a third longitudinal cross-sectional view of the first alternative unibody lid construction according to the present invention substantially identical to the second longitudinal cross-sectional view otherwise depicted in FIG. 90 as outfitted upon a fragmentary upper portion of a generic liquid container and re-presented for side-by-side comparison purposes to FIG. 91A.

FIG. 91A is a fourth longitudinal cross-sectional view of the first alternative unibody lid construction according to the present invention as sectioned 90 degrees to the left relative to the third longitudinal cross-sectional view otherwise depicted in FIG. 91 as outfitted upon a fragmentary upper portion of a generic liquid container and presented for side-by-side comparison purposes to FIG. 91.

Figure 92A:
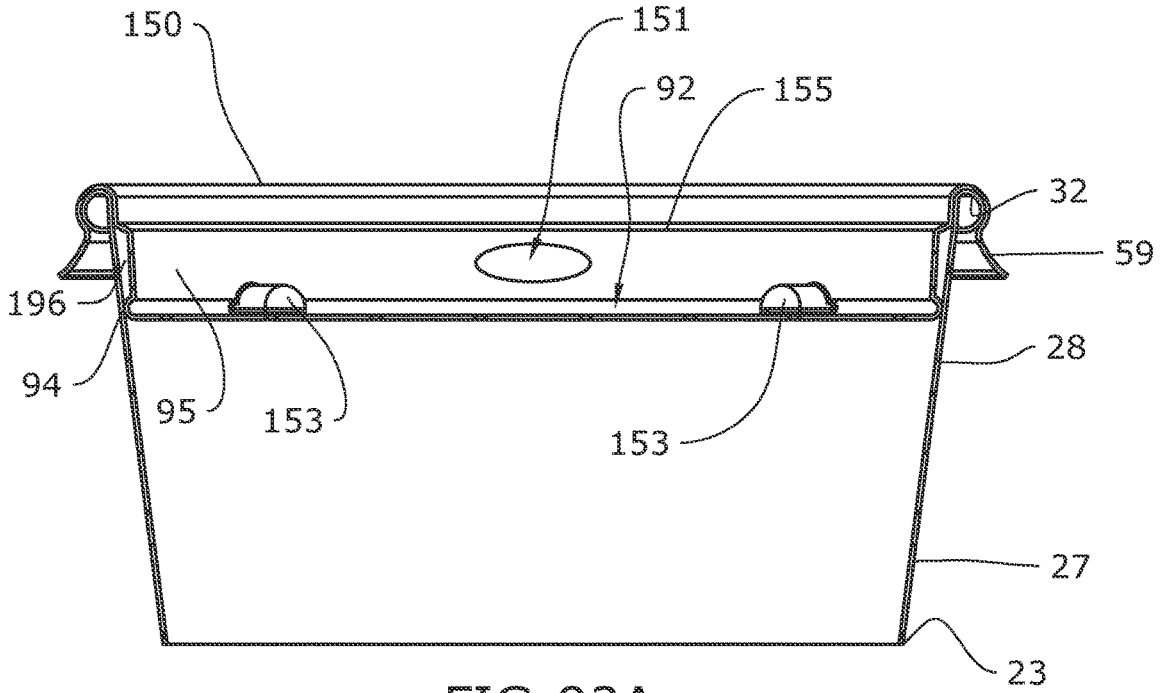
Figure 92:
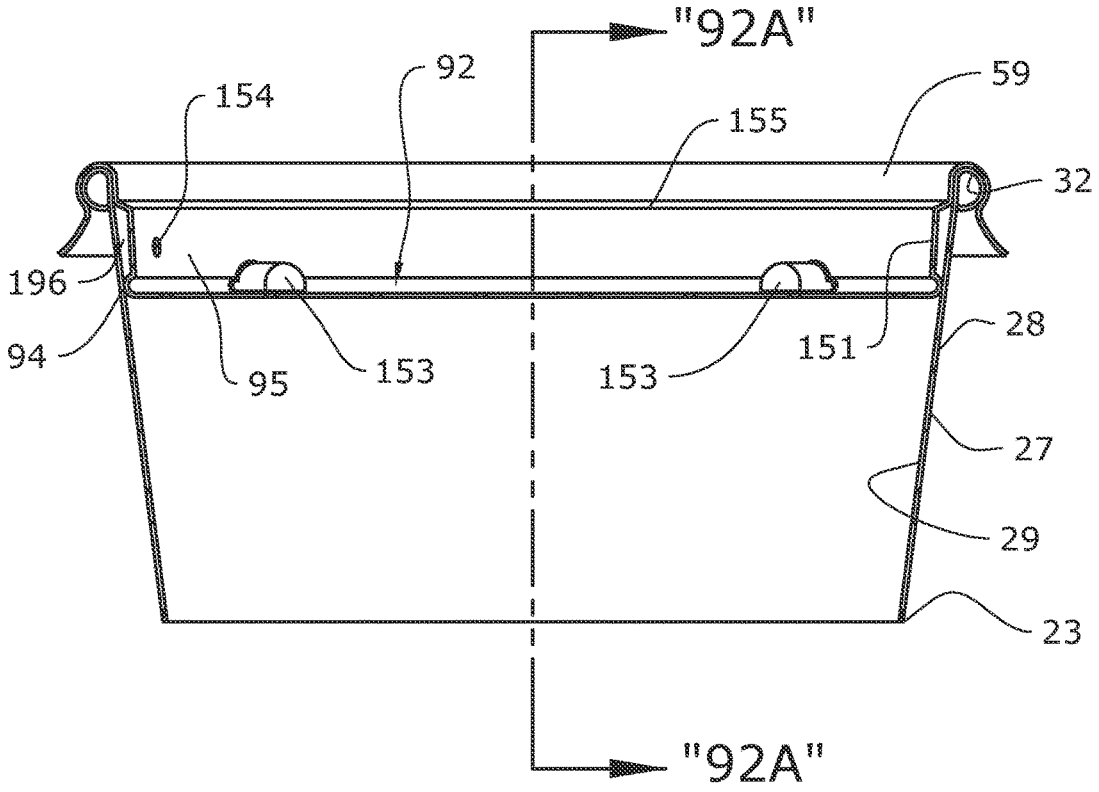

FIG. 92 is a fifth longitudinal cross-sectional view of the first alternative unibody lid construction according to the present invention substantially identical to the second and third longitudinal cross-sectional views otherwise depicted in FIGS. 90 and 91 as outfitted upon a fragmentary upper portion of a generic liquid container and re-presented for side-by-side comparison purposes to FIG. 92A.

FIG. 92A is a sixth longitudinal cross-sectional view of the first alternative unibody lid construction according to the present invention as sectioned 90 degrees to the right relative to the fifth longitudinal cross-sectional view otherwise depicted in FIG. 92 as outfitted upon a fragmentary upper portion of a generic liquid container and presented for side-by-side comparison purposes to FIG. 92.

Figures 93, 93A, 93B:
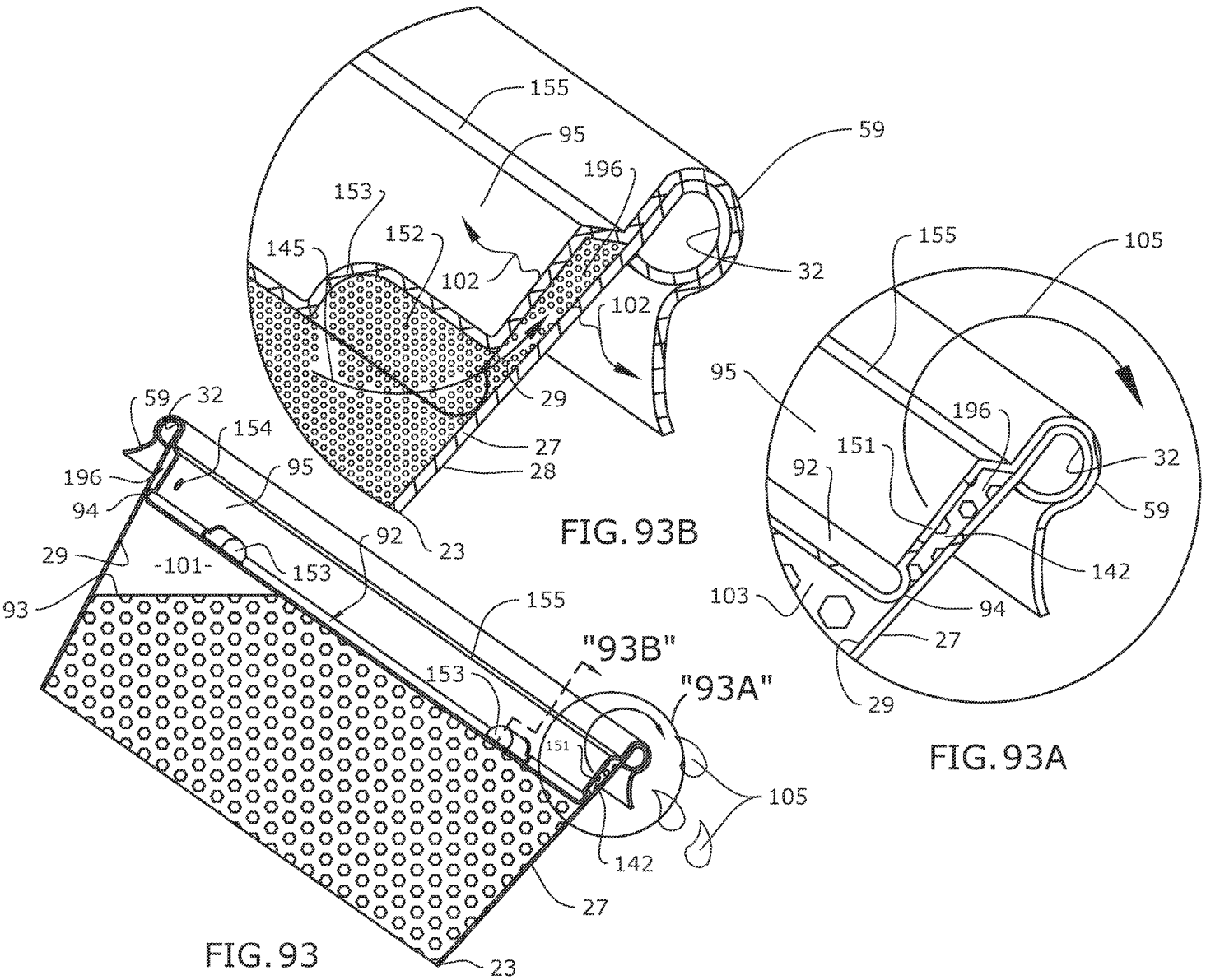

FIG. 93 is a first sequential view of a medial longitudinal cross-sectional "angled-to-the-right" view of the first alternative unibody lid construction according to the present invention depicted in assembled relation with a fragmentary upper portion of a liquid container to depict liquid egression from the lid construction while retaining compartmentalized liquid within a pocket defined by the lid construction relative to a container wall of the liquid container.

FIG. 93A is an enlarged fragmentary sectional view of the upper right portions of the lid-to-container junction site as sectioned from FIG. 93 to depict in greater detail the structural arrangements of the first alternative unibody lid construction relative to an upper container rim and container wall of the liquid container.

FIG. 93B is an enlarged fragmentary sectional view of the lid-to-container junction site as sectioned through a compartment-to-pocket portal of the first alternative unibody lid construction to show liquid flow pattern through said compartment-to-pocket portal.

Figure 94A:
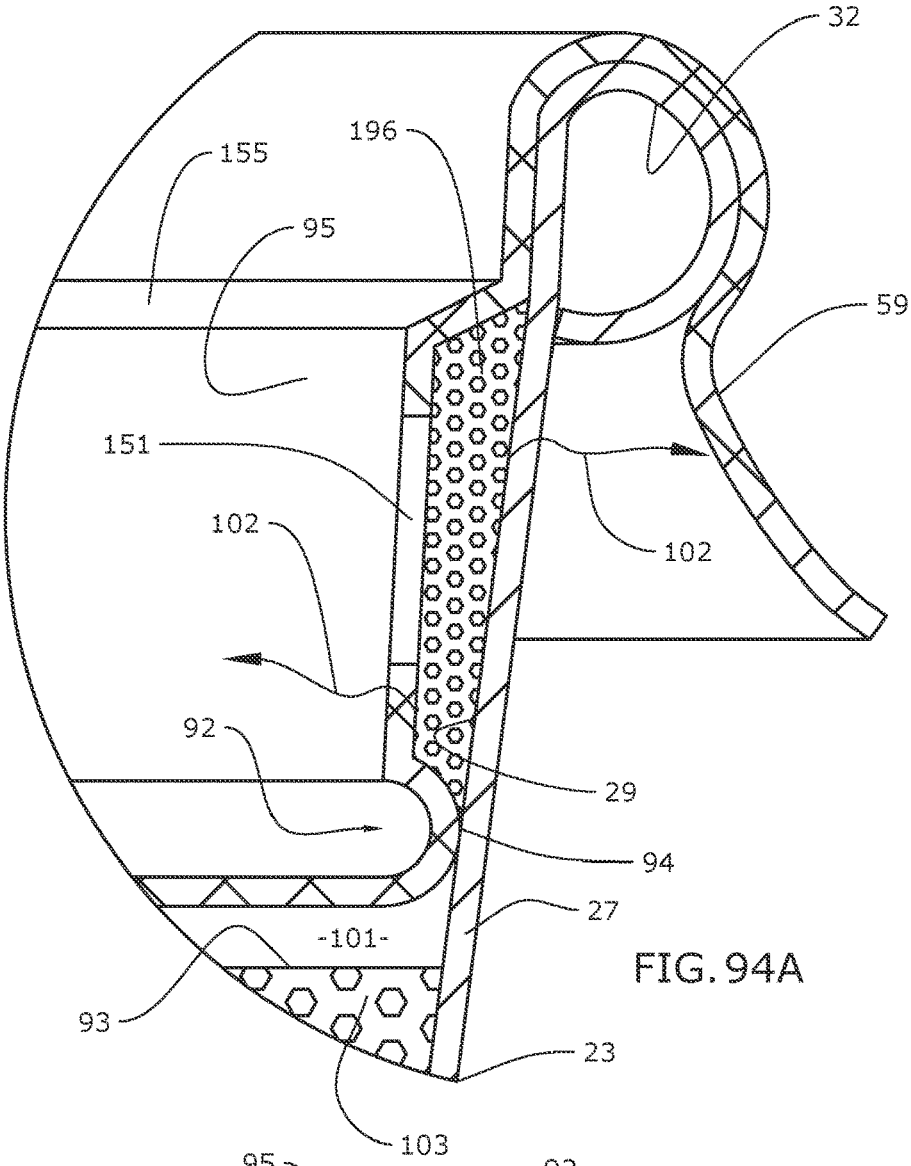
Figure 94:
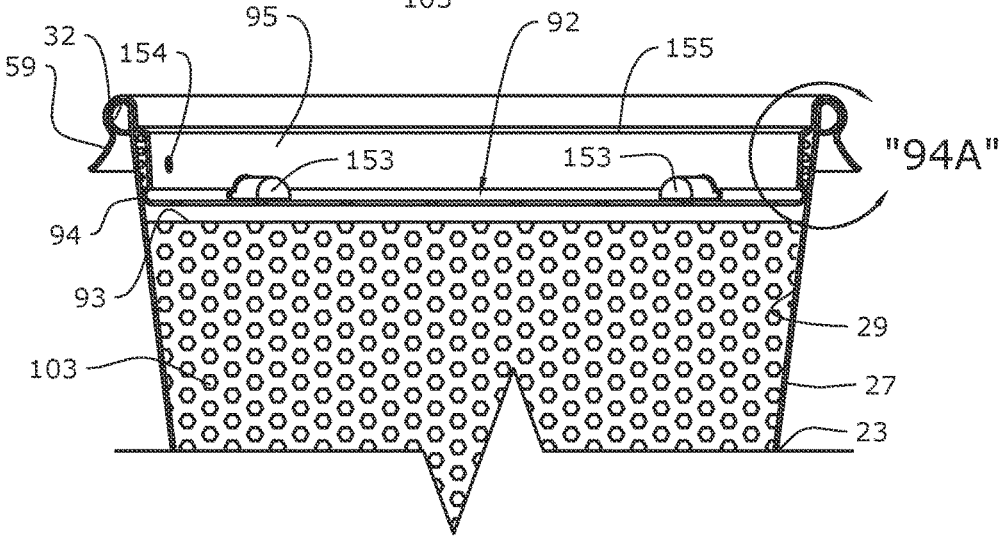

FIG. 94 is a second sequential view of a medial longitudinal cross-sectional vertical view of the first alternative unibody lid construction according to the present invention depicted in assembled relation with a fragmentary upper portion of a liquid container to depict compartmentalized liquid adhesion within a pocket defined by the lid construction relative to a container wall of the liquid container.

FIG. 94A is an enlarged fragmentary sectional view of the upper right portions of the lid-to-container junction site as sectioned from FIG. 94 to depict in greater detail the structural arrangements of the compartmentalized liquid adhesion within a pocket.

DETAILED DESCRIPTION OF THE PREFERRED EMBODIMENTS

Referring now to the drawings with more specificity, the following specifications generally describe a number of container lid constructions and/or damming insert constructions for use with container lids and liquid containers. In all embodiments, the subject lid assemblies are designed for controlling the directional movements of liquid as it migrates from a liquid container to a primary liquid outlet via the subject lid assembly or container orifice structure being addressed.

The liquid flow may be subjected to differing volume-shaping compartments for cooling the liquid volumes received therein. A primary impetus behind the lid assembly designs is a perceived need in the art for controlling and/or cooling highly viscous consumable liquids or beverages as may be preferably exemplified by soups or broths and the like, in addition to controlling and/or cooling relatively low viscosity liquids as may be preferably exemplified by coffee or tea and the like.

With particular reference to relatively high viscosity liquids, the reader is prefatorily directed to the PRIOR ART liquid container assemblies as generally illustrated and depicted in U.S. Patent Application Publication No. 2014/0231419 ('419 Publication) filed in the United States Patent and Trademark Office on 19 Feb. 2013 and assigned to the Campbell Soup Company with current business address of 1 Campbell Place, Camden, New Jersey, 08103. The PRIOR ART liquid container assemblies generally depicted and referenced in the '419 Publication inspired the inventive concepts being described in these specifications.

FIGS. 1-23 attempt to address certain improvements upon the state of the art otherwise exemplified by the hot consumable container teachings set forth in the '419 Publication, with particular reference to the so-called "soup-on-the-go" embodiment generally illustrated therein. These specifications are being presented to describe in detail certain hot beverage or liquid container lid constructions for use with structurally cooperable "soup-on-the-go" container constructions (as generally depicted and referenced at 12) such that the lid constructions provide a bowl-shaped, liquid-pooling or liquid-collecting depression that provides both beverage/liquid-damming/redirecting functionality as well as beverage/liquid cooling functionality.

The reader is first invited to envision a bowl of hot soup and a soup spoon for enabling the user to consume the hot soup in mouthful-sized or reduced, quicker-cooling, portion sizes. A soup spoon may thus be used to dip into the relatively large volume of bowl-contained hot soup for collecting hot soup or liquid into the liquid-pooling or liquid-collecting, bowl-shaped portion of the spoon for iteratively separating relatively smaller liquid volumes of hot soup from the relatively larger liquid volume for consumption. Each relatively small volume of hot soup, received in the liquid-pooling or liquid-collecting, bowl-shaped and relatively shallow portion of the spoon, may typically experience a relatively rapid heat transfer from the hot soup given the relatively cooler surface area of the spoon as well as the ambient air.

Referencing FIGS. 1, 2, and 14-17, the reader will there consider a generic "soup-on-the-go" packaging container construction 12 of the type shown in the '419 Publication with an added "bowl shape" damming/cooling insert 10 according to the present invention in a liquid-cooling, first condition or position of use intermediate a liquid container lid 11 and container. The damming/cooling insert 10 in the first condition or position of use thereby operates to form an upper liquid-cooling compartment as at 100 and a lower liquid-containing compartment as at 101. When soup or other hot liquid enters through a first type of liquid-letting aperture or opening as at 13 located at roughly 180 degrees from the primary liquid outlet 14 of the liquid container lid 11, liquid may be pooled or collected and cooled at the centralized, liquid pooling or liquid-collecting portion 15 of the damming/cooling insert 10.

Thereafter, the cooled liquid volume 104 may be consumed through the primary liquid outlet 14 of the liquid container lid 11. The damming/cooling insert 10 (preferably of a polymeric or plastic material construction or some other similar such material) may be preferably permanently attached to the inwardly extending peripheral flange seat or O-ring as at 16. Referencing FIGS. 3, 4, 18, and 19 in comparison to FIGS. 1, 2, and 14-17, the reader will note that the positioned placement of the liquid container lid 11 relative to the damming/cooling insert 10 is such that soup or other hot liquid 103 may be directly accessed from the liquid-letting aperture or opening 13 aligned or directly in inferior adjacency to the primary liquid outlet 14. This structural arrangement may be referred to as a "direct access" second condition or position of use and allows the drinker or consumer to obtain relatively hotter liquid content directly from the compartment 101 as generally depicted in FIG. 19.

FIGS. 5-9 showcase or depict in relatively greater clarity the centerpiece of the "soup-on-the-go" embodiment according to the present invention, namely, the damming/cooling insert hereinafter referred to as simply damming insert 10. The damming insert 10 is receivable intermediate the liquid container construction 12 and container lid 11 and preferably comprises a centralized, liquid-pooling or liquid-collecting portion or liquid-pooling, central portion as at 15; at least one liquid-letting inlet or aperture as at 13; and an outwardly extending peripheral seat flange as at 17.

The outwardly extending peripheral seat flange 17 of the damming insert 10 is preferably seatable upon (and permanently or adhesively affixed to) the inwardly extending peripheral flange seat 16 of the liquid container 12 for selectively positioning the liquid-letting inlet or aperture 13 in inferior adjacency to the container lid 11. The damming insert 10 thereby forms an upper liquid-cooling compartment as at 100 and a lower liquid-containing compartment as at 101. The damming insert 10 is further operable to direct a relatively smaller liquid volume 104 from the relatively larger liquid volume 103 into the liquid-pooling central portion 15 via the liquid-letting inlet or aperture 13 for enabling heat transfer 102 therefrom prior to outletting as at 105 through the primary liquid outlet 14 of the container lid 11 for consumption.

The outwardly extending peripheral seat flange 17 may be discontinuous with a break (as at 18) therein at the site of the liquid-letting inlet or aperture 13. The liquid-letting inlet or aperture 13 may thus be seen to extend downwardly form the discontinuous, outwardly extending peripheral seat flange 17 as generally depicted perhaps most clearly in FIGS. 5, 8, and 9. In an alternative damming insert embodiment according to the present invention, the outwardly extending peripheral seat flange or analogous structure may be continuous or annular as generally depicted in FIG. 13.

The damming insert 10 according to the present invention may further comprise at least one, and preferably at least two, laterally offset air-letting inlet(s) 19 opposite the liquid-letting inlet or aperture 13 for enabling air passage and pressure equalization via the damming insert 10 between the upper liquid-cooling compartment 100 and the lower liquid-containing compartment 101. The reader will note that the air letting inlet(s) 19 may also function as liquid letting-letting apertures, particularly in cases where low viscosity liquids like broth (coffee or tea) are contained by the assemblies. While the terms liquid-letting and air-letting are used to denote particular apertures in these specifications, the reader will recall that such apertures often provide dual functionality and may simply be referred to as letting apertures interchangeably.

The liquid-pooling or liquid-collecting central portion 15 preferably comprises a vertically arcuate transverse cross-section for directing and pooling the liquid volume 104 prior to outletting through the primary liquid outlet 14. More particularly, the liquid-pooling central portion 15 is preferably downwardly bowed (or concave) relative to the container lid 11 for directing and pooling the liquid volume 104 centrally prior to outletting through the primary liquid outlet 14.

Figure 13:
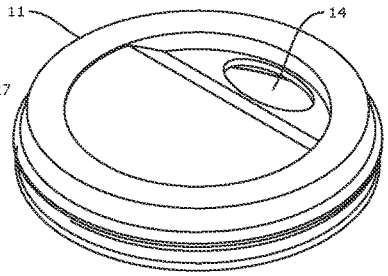
FIG. 13 is an exploded top perspective view of the second alternative container assembly according to the present invention showing the upper container lid, the lower liquid container and the orifice structure intermediate the upper container lid and lower liquid container in a second, "direct access" position of use.
Figure 13:
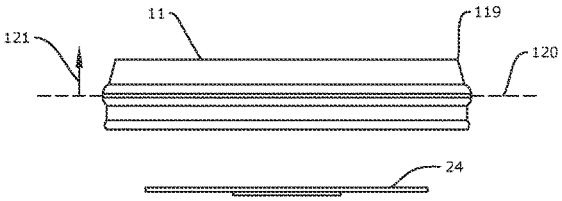
Figure 13:
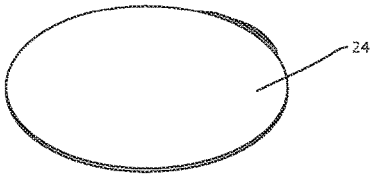
Figure 13:
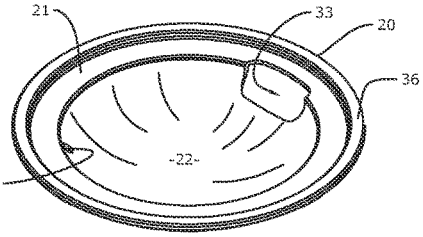
Figure 13:
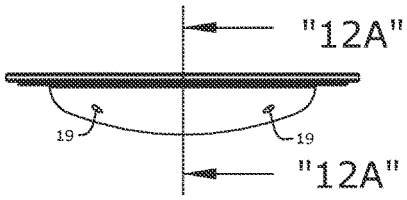
Figure 13:
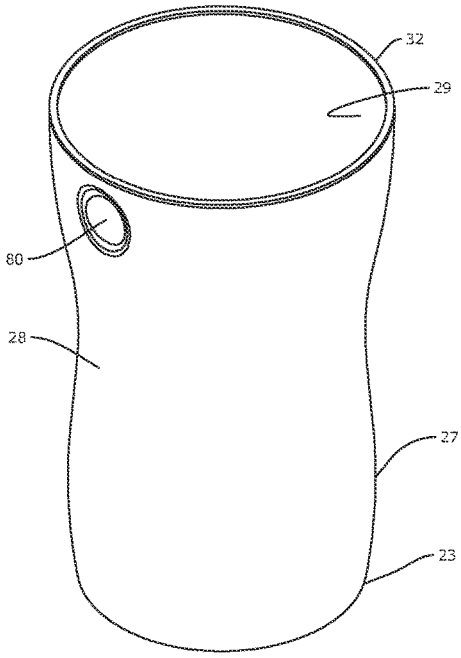
Figure 12:
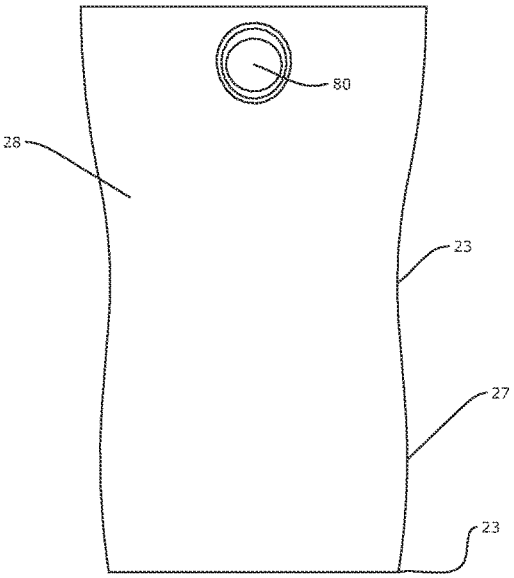
FIG. 12 is an exploded side view of a second alternative container assembly according to the present invention showing from top to bottom an upper container lid, an orifice structure cover or seal element, an orifice structure, and a lower liquid container.

An alternative "soup-on-the-go" embodiment or container assembly 31 according to the present invention is generally depicted in FIGS. 12 and 13, and contemplates a combination orifice structure 20, which orifice structure 20 comprises an annulus or O-ring section or portion 21 permanently attached to or integrally formed with a centralized, liquid-pooling or collecting portion or section as at 22.

Figure 2:
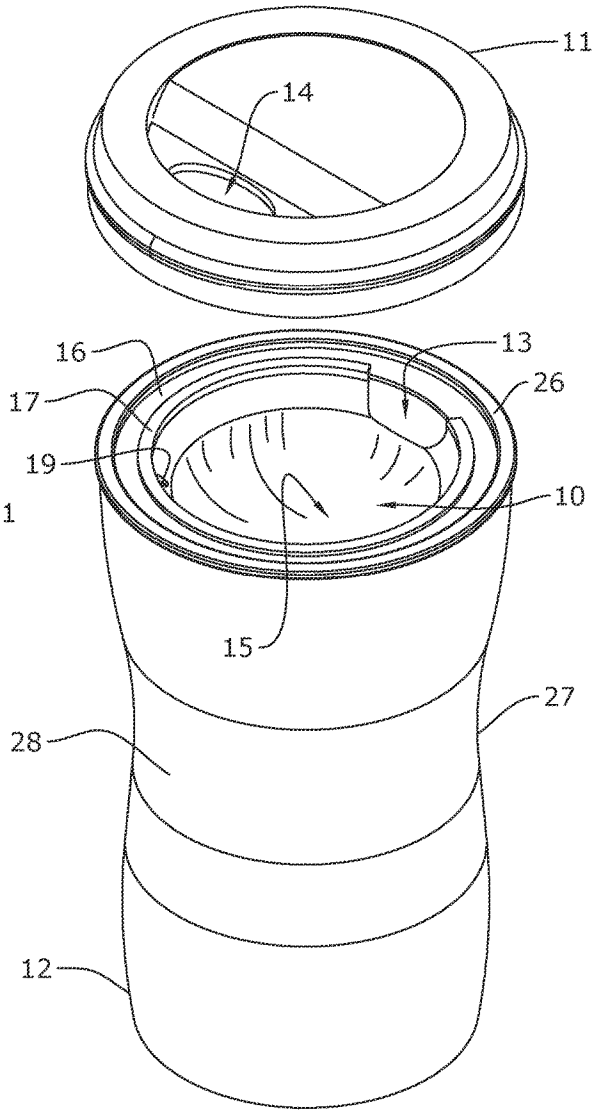
FIG. 2 is a top perspective view of the first alternative container assembly according to the present invention with the upper container lid exploded from an assembled lower liquid container and damming insert in the first, liquid-cooling position of use.
Figure 1:
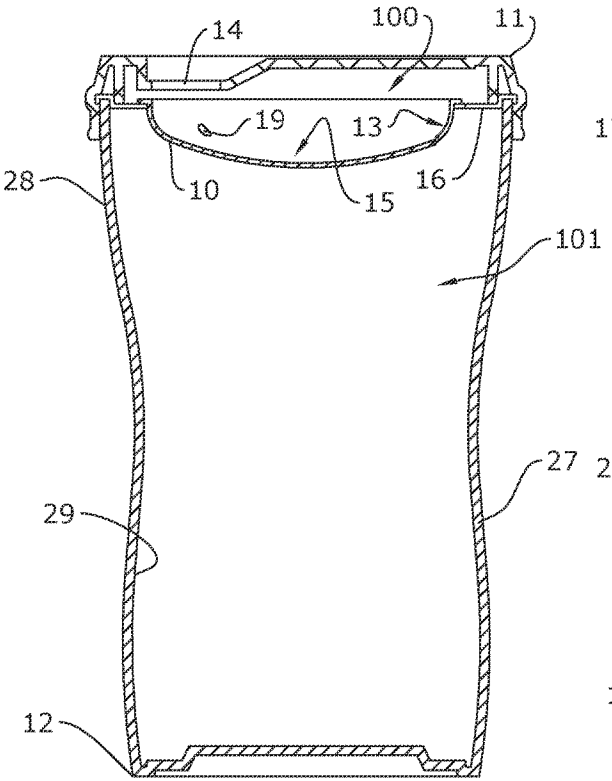
FIG. 1 is a medial longitudinal cross-sectional view of a first alternative container assembly according to the present invention depicted in assembled relation with an upper container lid, a lower liquid container and a damming insert received intermediate the upper container lid and lower liquid container in a first, liquid-cooling position of use.
Figure 4:
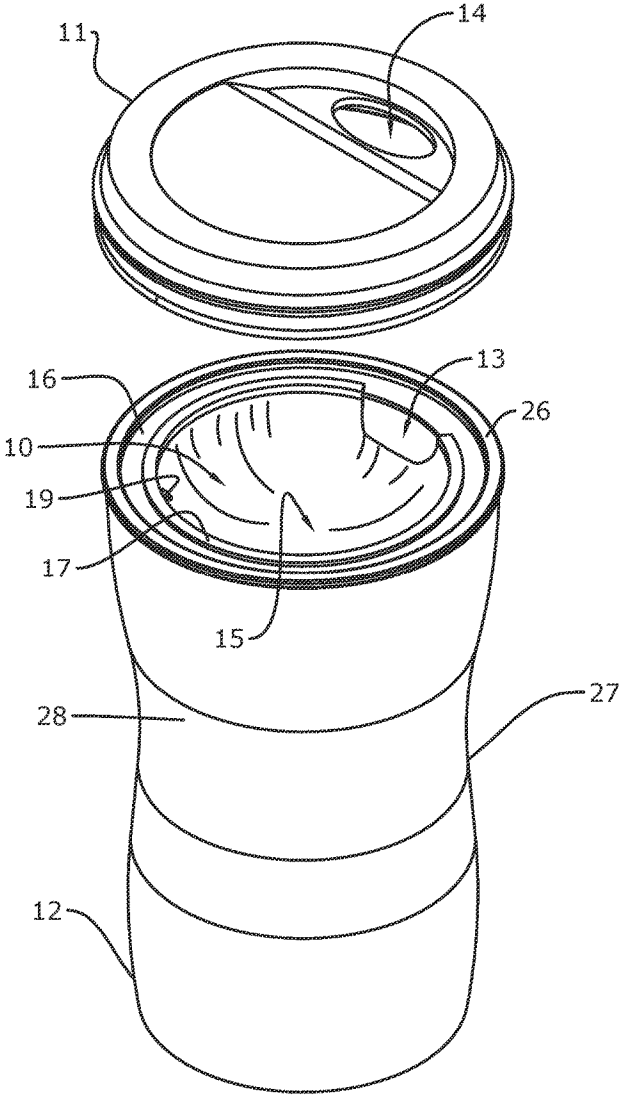
FIG. 4 is a top perspective view of the first alternative container assembly according to the present invention with the upper container lid exploded from an assembled lower liquid container and damming insert in the second, "direct access" position of use.
Figure 3:
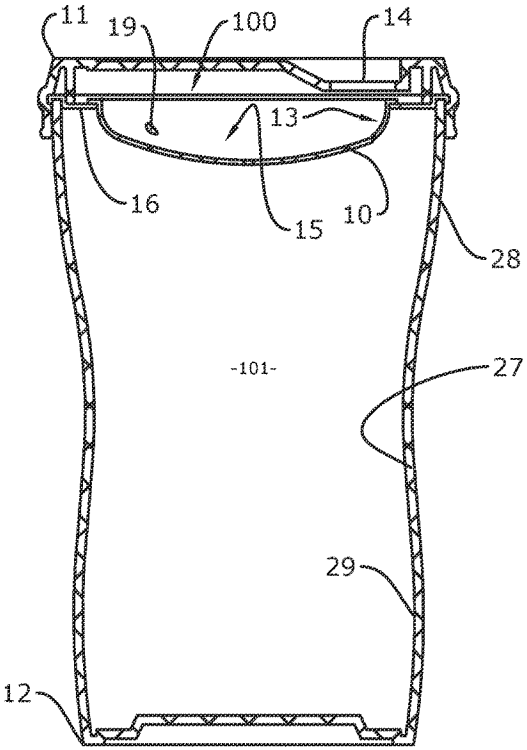
FIG. 3 is a medial longitudinal cross-sectional view of the first alternative container assembly according to the present invention depicted in assembled relation with the upper container lid, the lower liquid container and the damming insert received intermediate the upper container lid and lower liquid container in a second, "direct access" position of use.
Figure 7:
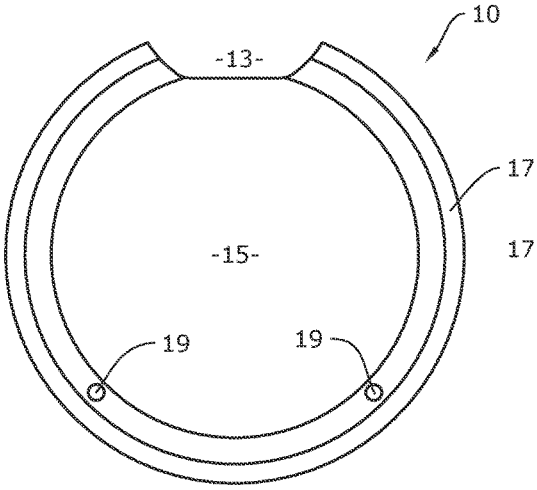
FIG. 7 is a bottom plan view of the damming/cooling insert usable in combination with the first alternative container assembly according to the present invention showing the posterior, laterally offset letting apertures, and the anterior, central letting aperture.
Figure 9:
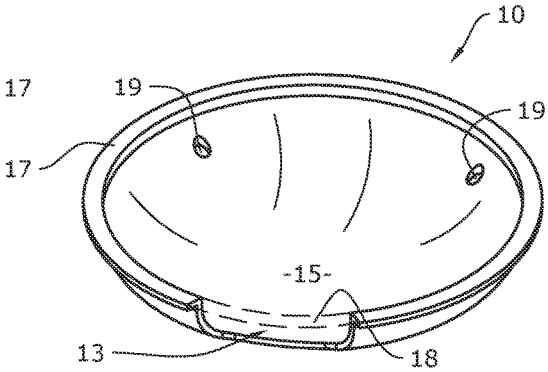
FIG. 9 is an enlarged anterior top perspective view of the damming/cooling insert usable in combination with the first alternative container assembly according to the present invention highlighting the posterior, laterally offset letting apertures.
Figure 6:
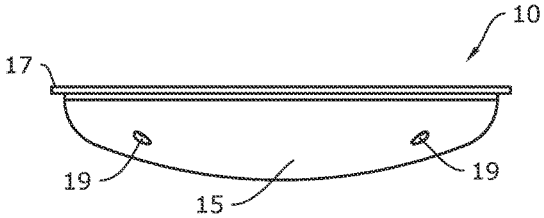
FIG. 6 is a posterior elevational edge view of the damming/cooling insert usable in combination with the first alternative container assembly according to the present invention showing laterally offset letting apertures.
Figure 5:
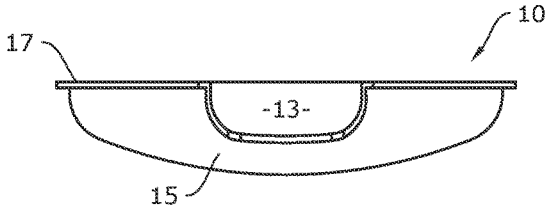
FIG. 5 is an anterior elevational edge view of a damming/cooling insert usable in combination with the first alternative container assembly according to the present invention showing a discontinuous upper seat flange and central letting aperture extending downwardly from an upper plane of the damming/cooling insert.
Figure 8:
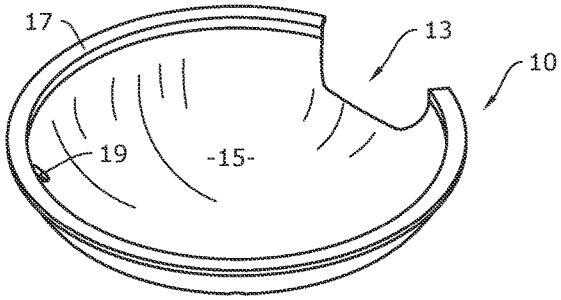
FIG. 8 is a posterior top perspective view of the damming/cooling insert usable in combination with the first alternative container assembly according to the present invention highlighting the anterior, central letting aperture.
Figure 10:
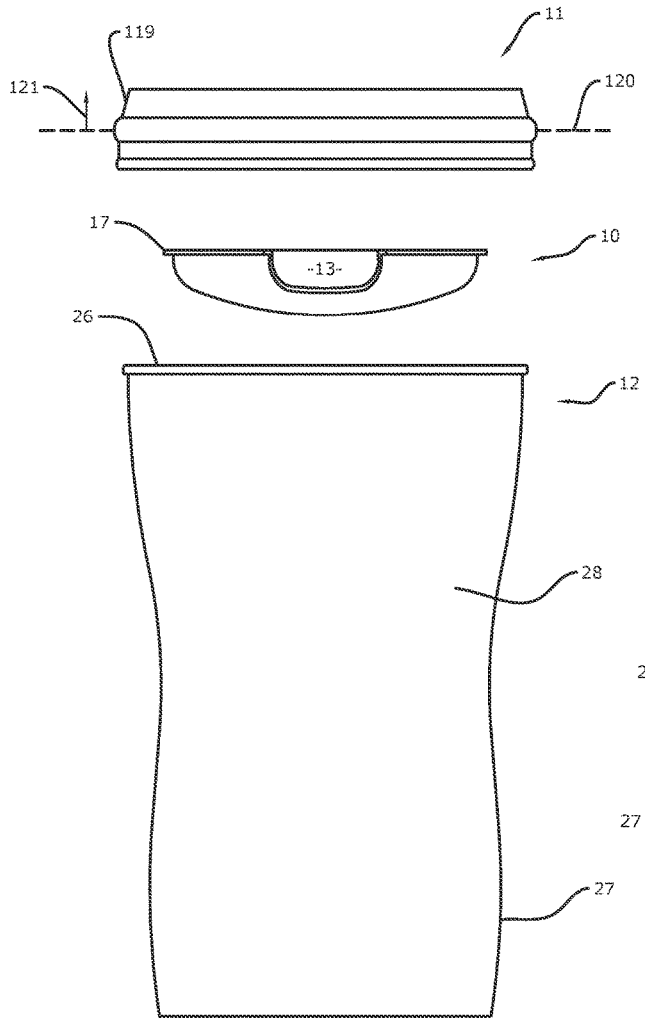
FIG. 10 is an exploded side view of the first alternative container assembly according to the present invention showing the upper container lid, the lower liquid container and the damming insert intermediate the upper container lid and lower liquid container.
Figure 11:
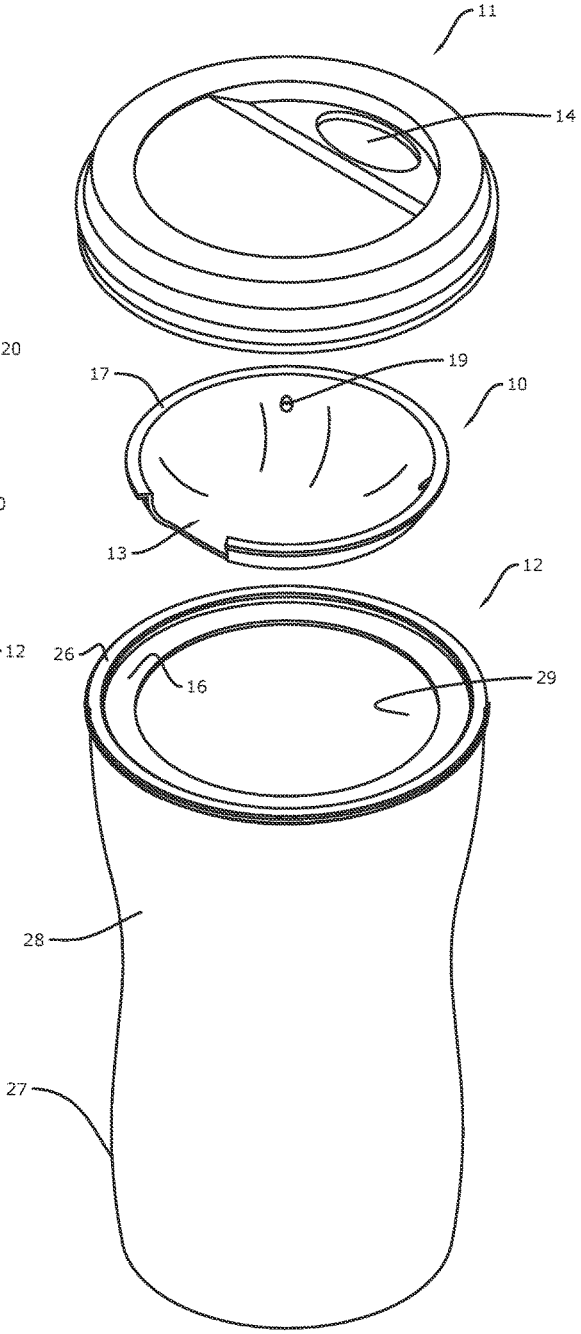
FIG. 11 is an exploded top perspective view of the first alternative container assembly according to the present invention showing the upper container lid, the lower liquid container and the damming insert received intermediate the upper container lid and lower liquid container in the first, liquid-cooling position of use.
Figure 12A:
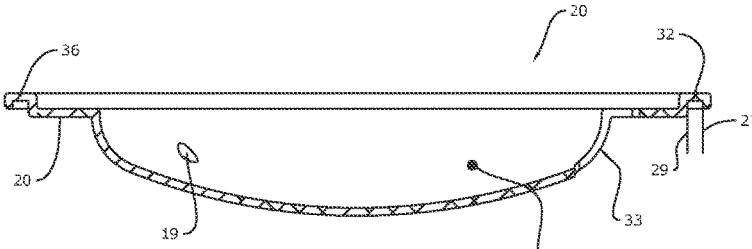
FIG. 12A is an enlarged medial longitudinal cross-sectional view of the orifice structure as sectioned from FIG. 12 and depicting the right side of the orifice structure engaged with a fragmentary upper container of a lower liquid container.

This combination assembly is seatable upon or attached to the lower container structure 23, and the entire resulting assembly may be capped with the liquid container lid 11. FIGS. 10 and 11 depict a damming insert 10 that may be permanently attached to the seat flange 17 in the liquid-cooling first condition or position of use relative the container lid 11. FIGS. 12 and 13 comparatively depict a bowl-shaped cooling structure 22 integrally formed with the O-ring portion 21 in the so-called "direct access" second condition of use relative to the container lid 11.

Referencing FIGS. 14-17, the reader will comparatively see a series of sequential views showing a method of utilizing the "soup-on-the-go" embodiment of the container assembly 30 according to the present invention. In other words, the liquid flow dynamics showing the preferred method of finally outletting 105 liquid originating from compartment 101 are depicted in the sequential series of figures at FIGS. 14-17. The reader should pay particular attention the damming insert 10 when comparing the sequence of views.

Referencing FIG. 14, the reader will there see container assembly 30 preferably comprising liquid container 12; container lid 11; and damming insert 10. A relatively large liquid volume 103 is received in the lower liquid-containing compartment 101 while the assembly 30 is at rest in a substantially vertical orientation. The reader will note that the liquid-letting inlet or aperture 13 of the damming insert 10 is positioned at the right of the figure while the primary liquid outlet 14 is positioned at the left of the figure.

FIG. 15 is a second sequential view of the container assembly 30 depicting the assembly 30 angled-to-the-right so that the relatively large liquid volume 103 comes into contact with the liquid-letting inlet or aperture 13 for inletting (as at arrows 106) a relatively small liquid volume 104 into the upper liquid-cooling compartment 100. FIG. 16 depicts a third sequential view of the container assembly 30 being returned to a substantially vertical orientation to highlight the centralized pooling effect of the relatively small liquid volume 104 at the centralized, liquid-pooling or liquid-collecting portion 15. FIG. 16 further depicts heat transfers as at 102 from the pooled liquid volume 104.

FIG. 17 is a fourth sequential view of the container assembly 30, this time depicting the container assembly 30 being angled-to-the-left for outletting 105 the relatively small liquid volume 104 via the primary liquid outlet 14 of the container lid 11. FIGS. 18 and 19 are to be compared to the sequential views depicted in FIGS. 14-17, which figures generally depict the sequence for the liquid-cooling, first condition of use for the container assembly 30.

FIGS. 18 and 19, by contrast, depict the "direct access" second condition or position of use for the container assembly 30 whereby liquid from the lower liquid-containing compartment 101 may be directly outlet 105 via the liquid-letting inlet or aperture 13 of the damming insert 10 and the primary liquid outlet 14 of the container lid 11, the letting aperture 13 and primary liquid outlet 14 being in alignment with one another at the right side of the figures.

FIGS. 20 and 21 comparatively depict certain contemplated packaging details for the transportation/selling mode of the container assembly 30 whereby the damming insert 10 may be provided or outfitted with a food grade foil type seal or similar other material seal as at 24. It is noted that the state of art or Prior Art "soup-on-the-go" container otherwise shown in the '419 Publication appears to suffer from certain shortcomings in terms of the overall packaging versus consumable preparation schemes, as discussed in more detail hereinafter.

In this regard, it is noted that the plastic lid container 11 and aluminum ring element 26 fit tightly when the package is at room temperature and sold to consumers in the stores. As discussed in greater detail in the '419 Publication, the "soup-on-the-go" embodiment contemplates that the container contents will be consumed when in a heated state as exemplified by the microwavable feature of the container 12.

When the hot liquid consumable container 12 is heated, however, the thermal expansion coefficients of the material construction of the container lid 22 and the ring element 26 are different resulting in a loose fit between the lid and the container at the plane of the ring element 26 as at plane 115. Very often when the consumer wishes to consume hot soup from such a container, the container leaks, potentially causing injury to the consumer.

In this regard, the container assembly 30 or the container lid 11 may preferably further comprise or provide a resilient interior ring or annulus element as at 25 as perhaps most clearly depicted in FIGS. 22 and 23. The interior (plastic) resilient ring or annulus element 25 fits tightly in radial inner adjacency to the aluminum O-ring element 26 at all temperatures and particularly when the temperature of ring element 26 is raised and undergoes thermal expansion.

Simultaneously, the resilient outer lid wall as at 35 fits tightly in radial outer adjacency to the aluminum O-ring element 26 at all temperatures and particularly when the temperature of ring element 26 is raised. Together the resilient outer lid wall 35 and resilient annulus element 25 structurally cooperate with the ring element 26 during thermal expansion activity to prevent leakage therebetween.

Other noted shortcomings of the Prior Art "soup-on-the-go" container assembly include a plastic lid that is difficult to remove from the liquid container portion. In many instances a tool or implement is required to remove the plastic lid from the container portion of the Prior Art "soup-on-the-go" container assembly. One possible remedy to overcome this shortcoming would be to provide an indention as at 80 in inferior and radial adjacency to the lower lid shroud end 99 of the container lid 11 for enabling the user to more easily grab and remove the container lid as at 11 from the container portion as at 12.

Further, it is noted that the container portion of the Prior Art "soup-on-the-go" container assembly has a poor insulation value and when the container contents are heated as instructed, the container portion becomes difficult to manually grasp due to the elevated temperatures of the container wall portions. One way to remedy this shortcoming would be to add a thermally insulative layer or layers on to the cup, such as spraying or adhesively attaching an additional insulation layer or to provide a specifically contoured insulation sleeve. Other packaging cost minimizing options are also contemplated.

It will thus be understood that with regard to the content or subject matter generally illustrated in FIGS. 1-23 that the present invention essentially provides a liquid container assembly as at 30 for enabling (a) liquid pooling (in a liquid-pooling-cooling compartment 100) and (b) heat transfer from a lid-pooled liquid volume (as at 104) prior to liquid egression 105 from a primary liquid outlet 14 formed in a container lid 11 of the container assembly 30. To achieve these basic functions, the liquid container assembly 30 according to the present invention basically comprises, in combination, a liquid container as a 12; a container lid as at 11, and a damming insert as at 10.

The liquid container 12 usable in combination with the container lid 11 and damming inset 10 preferably comprises a container wall as at 27, an upper container ridge or ring as at ring element 26, and a radially and inwardly extending peripheral flange seat as at 16. The inwardly extending peripheral flange seat 16 preferably extends radially inwardly from the container wall 27 in inferior adjacency to the upper container ridge or ring element 26. The container wall 27 inherently comprises certain outer wall surfacing as generally referenced at 28, and certain inner wall surfacing as generally referenced at 29.

The container lid 11 usable in combination with the liquid container 12 and the damming insert 10 preferably comprises certain lid-to-container fastening means and a primary liquid outlet as at 14. The lid-to-container fastening means function to removably fasten the container lid 11 to the liquid container 12 such that portions of said fastening means simultaneously engage the peripheral seat flange 16 and the outer wall surfacing 28 as perhaps most clearly depicted in FIG. 23. In this regard, the reader will recall that the container lid 11 preferably comprises an interior (plastic) resilient ring or annulus element 25, which element downwardly engages the flange seat 16 and outwardly engages ring element 26.

The damming insert 10 usable in combination with the container lid 11 and liquid container 12 is receivable intermediate the liquid container 12 and container lid 11 and preferably comprises a liquid-pooling central portion as at 15, a liquid-letting inlet or aperture as at 13, and an outwardly extending peripheral seat flange as at 17. The outwardly extending peripheral seat flange 17 is seatable upon the inwardly extending peripheral flange seat 16 for selectively positioning the liquid-letting inlet 13 in inferior adjacency to the container lid 11.

The damming insert 10 may be removably or permanently attachable to the liquid container 12 in the described manner for forming an upper liquid-cooling compartment 100 and a lower liquid-containing compartment 101 within the container assembly 30. The damming insert 10 is thus central to the practice of container assembly 30 and is basically operable to enable a liquid consumer to direct (as at arrows 106) a liquid volume 104 into the liquid-pooling central portion 15 via the liquid-letting inlet 13 for enabling heat transfer as at 102 therefrom prior to outletting 105 through the primary liquid outlet 14 of the container lid 11.

The container lid 11 preferably comprises an upper lid plane 107 and the inwardly extending peripheral flange seat 16 preferably extends in a first seat plane 108. The primary liquid outlet 14 extends in an outlet plane 109 parallel to and intermediate the upper lid plane 107 and first seat plane 108. The outwardly extending peripheral seat flange 17 extends in a second seat plane 110, which second seat plane 110 preferably extends parallel to and intermediate the first seat plane 108 and the outlet plane 109.

The outwardly extending peripheral seat flange 17 may be either discontinuous as depicted at break or broken lines 18 in first alternative container assembly 30 or continuous as generally depicted in connection with alternative container assembly 31 generally depicted in FIGS. 12 and 13. The alternative container assembly 31 basically differs from container assembly 30 by providing a liquid-pooling central portion 22 that is integrally formed with or otherwise permanently attached to an O-ring portion 21 of an orifice structure 20 attachable to an upper rim 32 of a liquid container structure 23 via a rim-receiving annular (aluminum) ring element 36.

Comparatively referencing FIGS. 24-24B versus FIGS. 24C-24E, the reader will there note container assembly 30 versus container assembly 31. Container assembly 30 is characterized by a separate damming insert construction as at 10, which damming insert construction 10 preferably comprises a seat flange 17 that seats down upon flange seat 16, and defines centrally a liquid-pooling central portion 15.

Container assembly 31, by contrast, is characterized by a peripheral rim-engaging orifice structure as at 20, which structure 20 comprises an annular ring element 36 analogous to the ring element 26 and attached to or integrally formed with a O-ring portion 21 analogous to a co-planar seat flange 17 and flange seat 16. Container assembly 31 is thus devoid of a second seat plane 110. Care should be taken not to confuse the ring plane 115 with the second seat plane 110 as these need not necessarily be coplanar.

In other words, the annular ring element 36 is analogous to the ring element 26 and attached to the O-ring portion 21, which O-ring portion 21 is in turn attached to or integrally formed with the liquid pooling central portion 22. The liquid-letting inlet or aperture 13 of damming insert 10 preferably extends downwardly from the discontinuous, outwardly extending peripheral seat flange 17 and a liquid-letting inlet or aperture 33 of the orifice structure 20 extends in inferior adjacency to the continuous, outwardly extending peripheral seat 21. Both inlets 13 and 33 basically operate to let liquid into the liquid-cooling compartment(s) 100.

The peripheral rim-engaging orifice structure 20 may preferably comprise an upper-outer peripheral ring element as at 26 or 36 and a lower-inner peripheral flange seat or O-ring portion as at 16 or 21. The upper-outer peripheral ring element 26 or 36 extends in a ring plane 115, and the lower-inner peripheral flange seat extends in a first seat plane 108. The primary liquid outlet 50 extends in an outlet plane109 parallel to the first seat plane 108, and the ring plane 115 is preferably parallel to and intermediate the first seat plane 108 and outlet plane 109.

The damming insert 10 and/or orifice structure 20 may each further comprise at least one, but preferably two laterally offset, air-letting inlet(s) as at 19. The air-letting inlets 19 are preferably structurally situated opposite the liquid-letting inlets 13 or 33 for enabling pressure equalization between the upper liquid-cooling compartment 100 and the lower liquid-containing compartment 101 when liquid volumes 104 are being directed into the liquid-pooling central portions 15 or 22. Air-letting inlets or apertures 19 are formed so as to relatively larger than state of the art air-letting apertures because of the intended dual use of letting liquids in certain scenarios.

As noted hereinabove, the air letting inlet(s) 19 may also function as liquid letting-letting apertures, particularly in cases where low viscosity liquids like broth (coffee or tea) are contained by the assemblies. While the terms liquid-letting and air-letting are used to denote apertures in these specifications, the reader will recall that such apertures often provide dual functionality.

The liquid-pooling central portions 11 or 22 according to the present invention preferably comprise a vertically arcuate transverse cross-section for directing and pooling liquid volumes 104 prior to outletting through the primary liquid outlet 14 of the container lid(s) 11. More particularly, the liquid-pooling central portions are preferably downwardly bowed (or concave) relative to the container lid(s) 11 for directing and pooling liquid volumes 104 radially centrally prior to outletting through the primary liquid outlet(s) 14 of the container lid(s) 11.

A liquid container damming insert construction as at orifice structure 20 according to the present invention may be said to enable liquid pooling and heat transfer from lid-pooled liquid prior to liquid egression, which liquid container damming insert or orifice structure 20 is receivable intermediate a liquid container as at 23 and a container lid as at 11.

The liquid container damming insert construction or orifice structure 20 preferably comprises a liquid-pooling central portion as at 22, a liquid-letting inlet as at 33, and a peripheral seat flange or ring as at 21, which peripheral seat flange or ring 21 is seatable upon an upper container rim 32 of the liquid container 23 for selectively positioning the liquid-letting inlet 33 in inferior adjacency to the container lid 11.

The damming insert construction thereby forms an upper liquid-cooling compartment as at 100 and a lower liquid-containing compartment as at 101 and is operable to direct liquid volumes as at 104 into the liquid-pooling central portion 22 via the liquid-letting inlet 33 for enabling heat transfer 102 therefrom prior to outletting through a primary liquid outlet 14 of the container lid 11.

The foregoing specifications are presented to describe in detail a hot beverage or liquid lid construction for use with structurally cooperable containers that basically provide a bowl-shaped, liquid-pooling or liquid-collecting depression that provides both (a) beverage/liquid-damming/redirecting functionality as well as (b) beverage/liquid cooling functionality. In this regard, the reader was invited to envision a bowl of hot soup and a soup spoon for enabling the user to consume the soup in mouthful sized portions.

A soup spoon may be used to dip into a bowl of hot soup for drawing hot soup into the liquid-pooling or liquid-collecting, bowl-shaped portion of the spoon for iteratively separating smaller volumes of hot soup for consumption. The relatively small volume of hot soup, received in the liquid-pooling or liquid-collecting, bowl-shaped and relatively shallow portion of the spoon, experiences a relatively rapid heat transfer from the hot soup given the relatively cooler surface area of the spoon and the air in adjacency to the spoon-pooled soup.

As may be gleaned from the foregoing descriptions in connection with container assemblies 30 and 31, the present inventive concepts attempt to harness these principles and structurally provide a lid assembly or construction for providing a very similar set of functions as compared to the structural analogies of the soup bowl and soup spoon. Certain lower lid-based formations or constructions according to the present invention all provide a lid-based spooning effect whereby relatively smaller, consumable liquid volumes are or may be directed into an intermediate liquid-cooling position before consumption via the lid-based formation(s).

In other words, the lid assembly embodiments 40 and 41 generally depicted in FIGS. 25-87A further develop these concepts via a number of different embodiments, all of which provide an upper lid construction cooperable with a lower lid construction having a bowl or spoon-shaped cross-sectional profile or portion. The upper lid constructions in certain embodiments may preferably tightly mimic certain upper surfacing of the lower lid construction or may be elevated in relation thereto in whole or in part to control liquid volume formations upon the upper downwardly bowed or concave surfacing of the lower lid constructions. Two lid assemblies are generally depicted in FIGS. 25-41, including lid assembly or embodiment 40 (for relatively low viscosity liquids) and lid assembly or embodiment 41 (for relatively high viscosity liquids). Both assemblies 40 and 41 are contemplated as disposable applications.

Referencing FIGS. 25-28, the reader will consider that FIGS. 25 and 26 attempt to depict lid assembly or embodiment 40 in an open lid configuration while FIGS. 27 and 28 attempt to depict the lid assembly or embodiment 40 in a closed lid configuration. FIG. 25 attempts to explode the lid assembly 40 so that the upper lid construction 42 may be viewed in superior adjacency to the lower lid construction 43 such that the raised section 48 and primary outlet aperture 50 of the upper lid construction 42 are in general alignment with the apertures 37 and 39 of the lower lid construction 43. The apertures 37 being thereby oriented in inferior adjacency to the primary liquid outlet 50 and thus in an open lid configuration.

Comparing FIG. 27 to FIG. 25, it will be seen that the raised section 48 and primary outlet aperture 50 of the upper lid construction 42 are positioned so as to be roughly 90 rotational degrees relative to the opposed apertures 37 and 39 of the lower lid construction 43. The apertures 37 of the lower lid construction 43 in FIG. 27 are thereby oriented so as to be roughly 90 rotational degrees out of alignment with the primary liquid aperture 50 and in inferior adjacency to the arc-chord conformation section 57 and thus in a closed lid configuration.

In alternative lid assembly embodiment 40 designed primarily as a disposable, low viscosity liquid application, the contours of the upper lid construction 42 are divided by an upwardly projected pathway channel or groove as at 45 in which a liquid volume 104 may collect. In other words, the channel or groove 45 provides a substantially tight space or cavity 46 between the spoon-shaped depression 47 or area of concavity of the lower lid construction 43 and the upwardly projected pathway channel or groove 45 of the upper lid construction 42. The upwardly projected pathway channel or groove 45 may be preferably viewed exteriorly or upwardly as a raised band section 48, although it should be noted that raised band section 48 need not necessarily conform precisely to the underlying contour of groove 45.

The upwardly projected pathway or groove 45 and the liquid-receiving cavity 46 formed thereby when the upper lid construction 42 is engaged with the lower lid construction 43 thereby preferably interconnects at least one, but preferably two liquid-letting aperture(s) as at 37 formed in the lower lid construction 43 with at least one air-letting aperture 39 formed opposite the liquid-letting aperture(s) 37. A relatively larger, single liquid-letting aperture 38 characterizes lower lid construction 44 by contrast, in which construction air-letting apertures 49 are opposed the liquid-letting aperture 38, which apertures 38 and 49 are functionally interchangeable in terms of their letting operability.

The reader will take note that the liquid-receiving cavity 46 defines a relatively low liquid volume or "tight" space within which the received liquid volume 104 may adhere to both the upper and lower surfacing 60 and 61 of the lower lid construction(s) 43 and 44 and the upper lid construction 42 respectively. This structural arrangement allows for relatively rapid heat transfer(s) through the opposed material construction(s) of the upper and lower lid constructions. In this regard, the concepts here being discussed represent further developments that build upon the concepts specified in related U.S. patent application Ser. Nos. 14/838,343 and 14/852,411 from which these specifications continue in part and to which applications these specifications claim a benefit.

The upper lid construction 42 of lid assembly 40 is seatable upon and preferably rotatable relative to the lower lid construction(s) 43 and 44 for enabling selective and rotatable placement of a primary liquid outlet 50 of the upper lid construction 42 relative to the lower lid constructions 43 and 44. The upper lid construction 42 may preferably be alternatively affixed to the lower lid constructions 43 and 44 by being snap-received in a radial groove 51 located in radial outer and superior adjacency to the spoon-shaped depression or concavity 47 of lower lid constructions 43 and 44. The radial groove 51 is perhaps most clearly depicted in FIG. 38A.

In other words, the edge-receiving groove 51 may be preferably formed at the bottom inner corner of the annular and planar depression 52 radially inward to the upper ridge 53 and adjacent the centralized, liquid-pooling or liquid-collecting bowl-shaped depression or portion 47. The circular upper lid construction 42 preferably comprises an annular and planar support portion 54 that may seat upon the depression 52 and in the case of those lower lid constructions comprising an edge-receiving groove 51, the outer peripheral edge 55 of the upper lid construction 42 may be received in the edge-receiving groove 51.

The upper lid construction 42 is rotatable as at arrow 112 about a lid axis of rotation as at 111 for selectively opening and closing the lid assemblies 40 and 41 by aligning the primary liquid outlet(s) 50 at the outlying periphery of the bowl-shaped upper lid construction or cap 42 with select liquid-letting aperture(s) (e.g. 37, 38, or 49) formed in the lower lid construction(s) 43 or 44. The reader will note that the primary liquid outlet 50 in all cases is preferably in communication with the cavity 46 or channel 45 formed in the upper lid construction 42. Further, the entire depression 47 may be formed in such a manner so as to be shifted anteriorly, particularly in low viscosity liquid applications, as discussed in more detail in connection with lid assembly 71 hereunder.

Still further, the reader will note that there is no requirement to rotate the upper lid construction 42 180 rotational degrees relative to the lower lid construction 44 to obtain a direct flow or "direct access" option since either the relatively large air/liquid-letting aperture 38 or laterally offset air/liquid-letting apertures 49 may both selectively operate to let liquid pass directly through to the primary liquid outlet 50. Whereas the liquid-letting apertures 37 of the low viscosity liquid lower lid construction 43 are primarily liquid-letting apertures (and air-letting aperture 39 is primarily an air-letting aperture), aperture 38 and apertures 49 are air/liquid-letting apertures interchangeably.

The liquid-letting and/or air-letting aperture(s) 37, 38, 39, and/or 49 formed in the lower lid construction(s) 43 and 44 are preferably formed at or adjacent upper edging of the radial or annular flange seat or depression 52 in radial outer adjacency to the bowl-shaped depression or liquid-pooling/collection portion 47 of the lower lid construction(s) 43 and 44 for letting liquid flow from the lower liquid-containing compartment 101 into the cavity 46. When liquid flows via the letting apertures, the liquid flow may then mix with the trapped/cooled liquid within the substantially tight space of the cavity 46 between the bowl shaped depression 47 of the lower lid construction 43 or 44 and the upwardly projected pathway or channel 45 of the upper lid construction 42 for cooling and preventing spillage of liquid egressing from the liquid-letting aperture(s).

The bowl-shaped cap or upper lid construction 42 may further preferably comprise a vertical depression or offset as at 56 in radially outer adjacency to the laterally-opposed (e.g. bowl-shaped or concave) arc-chord conformation sections 57 of the upper lid construction 42. The arc-chord conformation sections 57 are preferably defined outwardly by arc lengths of the offset 56 and inwardly by chord lengths of the raised band section 48. This offset 56 of the upper lid construction 42 is specifically designed to tightly mate into the vertical depression or offset 58 formed in radially outer adjacency to the bowl-shaped depression or concavity 47 of the lid body or lower lid construction(s) 43 and 44.

The mated tightness or snug fit at the radial junction between the offsets 56 and 58 of the bowl-shaped lower lid constructions 43 and 44 and channel-divided bowl-shaped upper lid construction 42, and the contoured conformation sections of the upper lid construction 42 to the lower lid constructions 43 and 44 at the laterally-opposed, cavity-defining upper-to-lower arc-chord conformation sections 57 enable the user to selectively close off or cover the liquid-letting aperture(s) and opposed air-letting aperture(s) by rotating the upper lid construction 42 relative to the lower lid construction(s) 43 and/or 44 about 90 rotational degrees.

Stated another way, the reader will thus appreciate that the upper lid construction 42 preferably comprises an upper vertical offset as at 56 and the lower lid construction(s) 43 and 44 preferably comprise a lower vertical offset as at offset 58. The upper vertical offset 56 extends orthogonally from the annular support portion 54 and the lower vertical offset 58 extends orthogonally from the annular support seat 52. The upper and lower vertical offsets 56 and 58 are particularly or specifically dimensioned peripherally for frictionally engaging one another and enhancing the fitted relationship between the upper lid construction 42 and the lower lid constructions 43 and 44. In addition, the offsets 56 and 58 may preferably comprise differently shaped geometries for frictionally and selectively engaging one another thereby enhancing the fitted relationship between the upper and lower lid constructions.

FIGS. 25 and 26 depict an open position for lid assembly 40 and may be compared to FIGS. 27 and 28, which figures depict the closed position of lid assembly 40. This feature operates in the same manner for both (a) low viscosity or thin liquid embodiments (e.g. coffee, tea, broth) as generally depicted in FIGS. 25-35 in connection with lid assembly 40 or (b) high viscosity or thick liquid embodiments (e.g. for creamy soups) as generally depicted in FIGS. 36-41 in connection with lid assembly 41.

For enhanced tightness and/or fit, the vertical depression of the bowl-shaped part of the lid body can be formed so as to provide a micro-elliptical circumference. In other words, the frontal cross section of the offset structure 56 could be formed so as to be a few microns less than the diameter of the offset structure 58 in adjacency to the air-letting aperture 39 and between the liquid-letting apertures 37 on the lower lid construction 43.

Referring back now to the dual operability of apertures 39 and 49 of the high viscosity liquid lid assembly 41, it will be noted that the liquid flow characteristics of the dual use embodiment or lid assembly 41 operate in substantially similar manner as compared to the liquid flow characteristics of the "soup-on-the-go" embodiments generally discussed in connection with container assemblies 30 and 31. In this regard, it will be noted that he primary liquid outlet 50 of the upper lid construction 42 may be rotatably positioned so as to be alignment with the relatively larger liquid-letting inlet or aperture 38.

The relatively larger liquid-letting inlet or aperture 38 enables the user to directly access container contents via the aligned liquid letting apertures. The primary effective structural difference between the dual use thick liquid embodiment or lid assembly 41 and the thin liquid embodiment or lid assembly 40 is the relatively larger, singular, ovular opening or aperture 38 replaces the substantially vertical liquid letting apertures 37, which opening or aperture operates to enhance or expedite the "spoon" effect in lid assembly 41. The primary liquid outlet 50 may also be selectively positioned over relatively smaller apertures 49 if a slower flow is desired. In this case, the aperture 38 provides air-letting functionality and the apertures 49 provide liquid-letting functionality.

The reader should note further that the liquid-letting apertures 49 of the bowl-shaped lower lid construction 44 preferably extend through the depression 52, offset 58 and upper radial portion of the liquid-pooling depression 47. This structural feature provides additional damming structure together with the upper lid construction 42 limits the space for liquid to pass through. This structural feature also helps to controllably divert a desired liquid volume 104 to the bowl-shaped substantially tight space of the cavity 46 for cooling functionality.

Other secondary functional features of the lid assemblies 40 and 41 are that they generally provide upper concave surfacing at the upper lid construction 42. The upper radius of the upwardly projected pathway or raised section 48 preferably resembles the bottom or lower radius of the liquid-pooling depression 47 so that the lid assemblies 40 and 41 may be more easily and nestably stacked (not specifically illustrated). Further, the upper concavity of the lid assemblies 40 and 41 enable a user's nose to extend into or beyond the upper lid ridge plane 113 in FIG. 32 as at arrow 114.

It will thus be understood that the lid assemblies 40 and 41 essentially provide liquid container lid assemblies for enabling liquid pooling and heat transfer from lid-pooled liquid prior to liquid egression, which lid assemblies may be said to basically provide or comprise a lower lid construction as exemplified by lower lid constructions 43 and 44; and an upper lid construction as may be exemplified by upper lid construction 42.

Each lower lid construction preferably comprises certain lid-to-container fastening means, a centralized, liquid-collecting portion as at depression 47, and at least one liquid-letting aperture as various exemplified by apertures 37, 38, and/or 49. The lid-to-container fastening means function to removably fasten the lower lid construction to an upper container rim 32 of a generic liquid container as at 23.

In this regard, it is contemplated that the lid-to-container fastening means may be exemplified by a state of the art rim-receiving groove as at 59 and may preferably define a rim plane as at 120. The centralized, liquid-collecting pan portion 47 preferably comprises certain upper portion surfacing as at 60, and the at least one liquid-letting aperture is preferably formed at an upper edge of the liquid-pooling portion 47.

The upper lid construction 42 is nestable atop the lower lid construction(s) and comprises a centralized, liquid-opposing or pan-opposing portion as exemplified by the liquid-receiving channel or groove 45, and a primary liquid outlet as at 50. The liquid-opposing or pan-opposing portion comprises certain lower portion surfacing as at 61. The upper and lower portion surfacing 60 and 61 each preferably comprise surfacing-mimicking contours for receiving and shaping a liquid volume 104 received therebetween. In this regard, the present inventive concepts may be said to build upon the surfacing-mimicking contour concepts otherwise discussed in U.S. patent application Ser. Nos. 14/838,343 and 14/852,411 from which this application claims a benefit. The primary lid outlet 50 being orientable in superior adjacency the lower lid construction(s) 43 or 44 for outletting a portion of the liquid volume via the primary liquid outlet 50.

The upper lid construction 42 is preferably rotatably nestable atop the lower lid construction(s) 43 and/or 44 for enabling a user to rotate as at 112 the upper lid construction 42 about a lid axis of rotation as at 111 relative to the lower lid construction(s) 43 and 44 for selectively orienting the primary lid outlet 50 in superior adjacency to the at least one liquid-letting aperture as various exemplified at 37, 38, and 49.

The upper lid construction 42, via the channel or groove 45, may be said to provide a volume-forming portion, which volume-forming portion provides a liquid-receiving cavity as at 46 at the lower portion surfacing 61. The liquid-receiving cavity 46 is preferably in communication with the primary lid outlet 50 for conveying or outletting the portion of the liquid volume 104 from the liquid-receiving cavity 46.

The upper and lower portion surfacing 60 and 61 each define downwardly bowed vertical transverse cross-sections, and the liquid volume 104 received therein is thereby concavely shaped relative to the upper lid construction 42. The lower lid construction(s) 43 and 44 each preferably comprise an annular support seat as at annular depression 52 and the upper lid construction 42 preferably comprises an annular support portion as at 54. The annular support portion 54 is seatable atop the annular support seat 52.

The volume-forming portion and liquid-receiving cavity 46 formed thereby preferably traverse the upper lid construction 46 intermediate opposed portions 62 of the annular support portion 54. The upper lid construction 42 may further preferably comprise laterally-opposed, cavity-defining upper-to-lower arc-chord conformation sections as at 57. In this regard, it will be recalled that the cavity 46 is essentially formed by groove 45, and the arc-chord conformation sections 57 are basically groove-defining lands). The conformation sections 57 conform to the upper portion surfacing 60 for eliminating space between the upper and lower lid constructions and directing the liquid volume 104 into the liquid-receiving cavity 46.

Referencing FIG. 42-44, the reader will there consider liquid flow dynamics of the lid assembly 40 designed with relatively low viscosity liquids contained in a generic liquid container as at 23 having a container wall 27 and an upper container rim 32 to which the lid assembly 40 is removably attached via heretofore exemplified lid-to-container fastening means such as the rim-receiving groove 59. FIGS. 42-44 generally depict a sequential set of views and may preferably be viewed in tandem with one another for illustrating how liquid progresses from a lower liquid-containing compartment into a liquid-cooling compartment and out the primary liquid outlet 50.

FIG. 42 generally depicts a lid assembly-outfitted (fragmentary) container 23 being angled-to-the-left from a substantially vertical orientation so as to direct (as at arrow 106) a liquid volume 104 into the cavity 46 (akin to liquid-cooling compartment 100). The reader will note that the upper liquid construction 42 is rotatably positioned relative to the lower lid construction 43 such that the primary liquid outlet 50 is aligned with the site of the liquid-letting apertures 37 for enabling direct access to liquid as outlet at arrow(s) 105. Apertures 37 are preferably located slightly and laterally offset from the primary liquid outlet 50 for providing a slight redirect of liquid during "direct access" use scenarios thereby providing additional damming effect for egressing liquid flow 105 and slightly delaying movement of the liquid volume 104 from the cavity 46.

FIG. 43 generally depicts the lid assembly-outfitted (fragmentary) container 23 being returned to a substantially vertical orientation so as to direct or centrally pool the liquid volume 104 within the cavity 46 preferably having concavity relative to the upper lid construction 42 for effecting heat transfer 102 from the liquid volume received within the substantially tight space defined by the cavity 46. In this regard, it will be seen that the liquid volume 104 is in direct contact with both the upper and lower surfacing as at 60 and 61, which contact effects a relatively rapid heat transfer.

FIG. 44 generally depicts the lid assembly-outfitted (fragmentary) container 23 being re-angled-to-the-left from the substantially vertical orientation so as to again direct (as at arrow 106) a liquid volume 104 into the cavity 46 as liquid volume 104 also exits as at 105 the lid assembly 40 via the primary liquid outlet 50. The reader will note that mixing of the relatively smaller liquid volume and the relative larger liquid volume 103 occurs during this process.

A further alternative lid assembly or embodiment according to the present invention is generally depicted and referenced at 70 in FIGS. 45-52. Lid assembly 70 contemplates an upper lid construction 69 that is substantially elevated (and planar) relative to the lower lid construction substantially identical to lower lid construction 43. This liquid container lid assembly 70 also enables liquid pooling and heat transfer from a lid-pooled liquid volume 104 prior to liquid egression as generally depicted in FIGS. 49-52, and as particularly depicted in FIG. 51. Comparing FIG. 43 versus FIG. 51, the reader will comparatively note that cavity 46 provides a relatively smaller liquid-receiving volume or compartment 100 and operates to shape the liquid volume 104 via the upper lid construction 42.

The liquid-cooling compartment 100 of lid assembly 70, by contrast does not shape the liquid volume 104 received therein via the upper lid construction 69. Further, lid assembly 70 provides a relatively larger liquid-receiving cavity or liquid-pooling cavity on par with the liquid-pooling compartments 100 of the container assemblies 30 and 31.

The liquid volume 104 is preferably collected or pooled centrally within the depression 47 due to the upper concavity of the centralized, liquid-collecting portion or depression 47 of the lower liquid construction 43. The upper lid construction 69 comprises a primary liquid outlet as at 50, and secondary letting apertures as at 68 primarily for letting heated air as heat is transferred 102 from the pooled liquid volume 104.

This lid assembly 70 may thus be said to comprise a lower lid construction as at 43, and an upper lid construction 69 whereby the lower lid construction 43 comprises certain lid-to-container fastening means as previously exemplified, a centralized, liquid-collecting portion as at depression 47, and at least one liquid-letting aperture as at letting apertures 37. Again, the lid-to-container fastening means removably fasten the lower lid construction to a liquid container, and the centralized, liquid-collecting portion comprises upper portion surfacing as at 61. The at least one liquid-letting aperture is preferably formed at an edge of the liquid-pooling portion.

The upper lid construction 69 is preferably rotatably attached to the lower lid construction 43 (via outer peripheral edging 55 rotatably received in edge-receiving groove 51) and comprises a centralized, liquid-opposing or pan-opposing portion 67 and a primary liquid outlet as at 50, which outlet 50 may be rotatable positioned relative to the lower liquid construction 43 by rotating as at 112 the upper lid construction 69 about a lid axis of rotation as at 111. All rotatable elements may be preferably outfitted with knob-like protrusions 65 for easing manual rotation(s).

The liquid-opposing or pan-opposing portion 67 comprises certain lower portion surfacing as at 66. The upper and lower portion surfacing 60 and 66 operate to compartmentalize the liquid volume 104 received therebetween via the at least one liquid-letting aperture 37. The primary lid outlet 50 is orientable in superior adjacency the lower lid construction 43 for outletting 105 a portion of the liquid volume 104 via the primary liquid outlet 50 as generally depicted in FIG. 52.

The upper lid construction 69 of this alternative lid assembly 70 or of any of the lid assemblies discussed in these specifications may preferably comprise a transparent material for (a) enabling a user to visually perceive (as generically depicted at eyeball 200) the liquid volume 104 collected at the centralized, liquid-collecting portion 47 and (b) thus enhancing a user's ability to control the magnitude and flow characteristic of the liquid volume 104.

Referencing FIGS. 49-52, the reader will there consider liquid flow dynamics of the lid assembly 70 designed with relatively low viscosity liquids contained in a generic liquid container as at 23 having a container wall 27 and an upper container rim 32 to which the lid assembly 70 is removably attached via heretofore exemplified lid-to-container fastening means such as the rim-receiving groove 59. FIGS. 44-52 generally depict a sequential set of views and may preferably be viewed in tandem with one another for illustrating how liquid progresses from a lower liquid-containing compartment 101 into a liquid-cooling compartment 100 and out the primary liquid outlet 50.

FIG. 49 generally depicts a lid assembly-outfitted (fragmentary) container 23 in a substantially vertical orientation with a relatively larger liquid volume 103 contained in the lower liquid-containing compartment 101. FIG. 50 depicts the ensemble being angled-to-the-right from a substantially vertical orientation so as to direct (as at arrow 106) a liquid volume 104 into the liquid-cooling compartment 100. The reader will note that the upper liquid construction 69 is rotatably positioned relative to the lower lid construction 43 such that the primary liquid outlet 50 is aligned with the site of the liquid-letting apertures 37, but that this angled orientation directs (low viscosity) liquid as at 106 through the aperture 38.

FIG. 51 generally depicts the lid assembly-outfitted (fragmentary) container 23 being returned to a substantially vertical orientation so as to direct or centrally pool the liquid volume 104 within the liquid-cooling compartment 100 upon the concave surfacing 60 for effecting heat transfer 102 from the liquid volume received within the compartment 100. FIG. 52 generally depicts the lid assembly-outfitted (fragmentary) container 23 being angled-to-the-left from the substantially vertical orientation so as to direct (as at arrow 106) a liquid volume 104 into the compartment 100 as liquid volume 104 also exits as at 105 the lid assembly 70 via the primary liquid outlet 50. The reader will note that mixing of the relatively smaller liquid volume 104 and the relative larger liquid volume 103 occurs during this process.

Referring now to lid assembly 71 as generally depicted and referenced in FIGS. 53-56, the reader will note that the centralized liquid-pooling or liquid-collecting depression 47 is formed in the lower lid construction 73 such that the axis of rotation 111 about which the upper lid construction 72 rotates 112 relative to the lower lid construction 73 is shifted out of coaxial alignment of the primary lid axis 116 in an anterior direction a shift length 117. It is contemplated that this shift or offset may be primarily aimed at low viscosity or liquid applications as is the case in coffee/tea or similar other applications.

In this regard, it will be noted that upper lid construction 72 basically comprises a smaller overall diameter as compared to upper lid construction 42, and thus provides relatively more stability and less flexibility. Because a relatively smaller diameter lid construction has a lesser tendency to bend, the upper lid construction 72 provides a relatively more stable and planar outer ring as at 74, which stable planar outer ring provides for a tighter fit to the surface 75 of the lower lid construction 73.

Basically, as viscosity of the application liquid decreases, so too can the diameter or size of the upper lid construction 72 for effecting a sturdier lid construction. The relatively more stable upper lid construction 72 is easier to assemble into the lower lid construction, easier to rotate since there is less overall friction, consists of relatively less material, and thus is less costly. By contrast, the primary benefit of concentric upper and lower lid construction embodiments are the 180 degree turn for optional direct flow or "direct access" position of use or liquid-cooling position of use capabilities for either low or high viscosity liquid applications.

Lid assembly 71 is substantially similar to lid assemblies 40 and 41 but for the anterior offset as at length 117 basically due to a reduced diameter depression 47 and reduced diameter upper lid construction cooperable therewith. Other differences include a revised letting aperture arrangement whereby an air-letting aperture 76 is formed in superior adjacency to a posterior upper cavity as at 77, and aperture 78 formed in lower lid construction 73.

The upper cavity 77 is opposite an anterior upper cavity as at 80. Cavities 77 and 80 enable breathability of the lid assembly 71 and are extensions of cavity 46 at the vertical offset 79 of the lower lid construction 73, which may be discontinuous as at 80 in lid assembly 71 for enhancing the overall flow characteristics of the fourth alternative lid assembly 71.

Referencing FIGS. 57-72, the reader will there consider a fifth alternative lid assembly 81 according to the present invention. Comparatively referencing FIGS. 1-56 in this application, the reader will note that the various embodiments depicted therein provide a lid assembly or construction having an upper or dome portion 119 that is generally elevated (as at arrow 121) relative to the plane 120 of the lid-to-container attachment means as exemplified by an upper container rim-receiving groove construction as generally depicted and referenced at 59 throughout these specifications.

The fifth alternative lid assembly 81 according to the present invention departs from a lid assembly or construction having an upper or dome portion 119 elevated 121 relative to the plane 120 of the lid-to-container attachment means and instead provides a pan portion 118 that is generally dropped or depressed (as at arrow 122) relative to the plane 120 of the lid-to-container attachment means as exemplified by an upper container rim-receiving groove construction as generally depicted and referenced at 59.

The lid assembly 81 is also substantially similar to lid assemblies 40 and 41 but for the dropped or depressed 122 structural configuration of the pan portion 118 as compared to the elevated 121 dome portion 119, which structural configuration is excellent for directing and controlling either low or high viscosity liquids due to narrow channel, hydrophilic property-harnessing. In this regard, the core structural considerations to note in addition to the dropped 122 pan portion are the liquid-cooling and liquid-shaping cavity as at 46 of the lid assembly 81 formed by the contours of upper surfacing 60 and lower surfacing 61 of the lower lid construction 83 and the upper lid construction 82 respectively.

Other notable structural differences attendant to lid assembly 81 relative to the other lid assemblies in these specifications include a revised structural arrangement between the pan portion 118 and the inner container wall surfacing 29 due to the pan portion 118 being radially and centrally located relative to the inner container wall surfacing 29. The reader should note in this regard that the outer wall 84 of the lower lid construction 83 is substantially parallel to the inner container wall surfacing 29.

Because of the relatively tight juxtaposition of the inner container wall surfacing 29 and the outer wall 84 of the lower lid construction 83, the liquid tends to adhere to the opposed surfaces as at 123 and this adherence tends to lessen the pulling or suctioning effect as the ensemble is shifted from a liquid-directing angled position back toward a vertical position as generally and comparatively depicted in FIGS. 70 and 71. Because of the adherence and weakened pulling effect, a relatively larger liquid volume 104 is trapped or left behind within the cavity 46. The larger the liquid volume 104, the better the cooling effect and overall better performance of the lid assembly 81.

Referencing FIG. 71, the reader will there see that the cavity 46 houses a liquid volume 104 such that the lower surfacing 61 and the upper surfacing 60 are both in contact with the liquid volume 104. This structural arrangement provides a relatively rapid heat transfer 102 from the liquid volume 104. The liquid-opposing upper surfacing 60 of the lower lid construction 83 and the liquid-opposing or pan-opposing lower surfacing 61 of the upper lid construction 82 are preferably spaced from one another so as to harness the hydrophilic properties of the liquid volume 104 so that the liquid volume adheres to both surfaces 60 and 61 for effecting enhanced heat transfers therefrom.

Recalling the substantial parallel outer wall 84 of the lower lid construction 83 relative to the inner container wall surfacing 29, it is contemplated that the opposed surfaces may also be preferably spaced from one another so as to harness the hydrophilic properties of the liquid entering that spatial region or space 85 so that the liquid volume "sticks" or adheres to the opposed surfaces as at 123 effecting enhanced heat transfers therefrom. Excellent results have been achieved when the angle of difference between the outer wall 84 is ±15° relative to the plane of the inner container wall surfacing 29.

Referencing FIG. 72A, the reader will there see a depiction of the maximum preferred angle 125 between outer wall 84 and the inner container wall surfacing 29 measured between broken projection line 124 substantially parallel to the outer wall 84. The spooning effect of lid assembly 81 is enhanced because the spacing 85 between the inner container wall surfacing 29 and the relatively large liquid-letting aperture 88 provides hydrophilic adhesion sites 123 for better guiding/directing liquid volume(s) 104 into bowl/plate-shaped, liquid-cooling/shaping cavity 46 intermediate the upper and lower lid constructions 82 and 83.

Other features of note are the preferred planar liquid-opposing portions 86 and 87 of the upper lid construction 82 and lower lid construction 83. The planar bottom or liquid-opposing portion 87 enables the user to stand the lid assembly 81 upon flat support surfaces (not specifically illustrated). Further, the flat bottom, liquid-opposing portion 87 of the lower lid construction is substantially parallel to the upper liquid surfacing as at 93, which enhances the user's ability to control liquid oscillations and prevent spillage during ensemble movement such as when the user is walking with the ensemble.

The primary or relatively larger letting aperture 88 is formed at an anterior portion of the lower lid construction 83. Opposite the letting aperture 88 are laterally offset letting apertures 89. Further, air-letting aperture 90 is formed in the upper lid construction 82 at a lateral portion thereof. Further, the upper lid construction 82 preferably comprises anterior and posterior or aperture-opposing arc length indent features as at 91 for spacing the upper lid construction 82 from the letting apertures 88 and 89 (on par with the spacing between surfacing 60 and 61) when in either the first open position as generally depicted in FIGS. 58, 60, 62, 63, and 69-72 or the second open position as generally depicted in FIGS. 66 and 67.

Some of the other secondary advantages of lid assembly 81 are briefly discussed hereinafter. The lid assembly 81 is relatively easier to assemble with a liquid container given that the dropped pan portion 118 is received within the liquid container mouth. This improves service time and accuracy for staff. Given the dropped pan construction, there is less opportunity for above rim collisions and attendant inadvertent lid removal(s) from the liquid container. In other words, when the lid assembly is outfitted upon a liquid container, it tends to be more difficult to remove it inadvertently. The upper container rim becomes more rigid and thus more difficult to "squeeze" for popping off the lid assembly. A lid assembly with a dropped pan portion requires less material than lids with upper dome portions.

Lastly, the lid assembly 81 preferably defines a radially inner groove structure as at 92, which groove structure 92 may preferably and radially outwardly press into or tightly engage the material construction of the liquid container 23 via a wall-engaging ridge 94 thereby reducing the leakage opportunities as perhaps most clearly depicted in FIG. 68A.

The groove structure 92 and wall-engaging ridge 94 further structurally contribute to forming a space-defining façade structure as at 95, which façade defines a space or air pocket 96 between the lower lid construction 83 and the inner container wall surfacing 29 of the liquid container 23. In certain embodiments groove structure may optionally receive outer peripheral edging 55 of upper lid constructions.

Together, the wall-engaging ridge 94 and space or air pocket 96 function to prevent leakage from the liquid container 23 via the junction between the lower lid construction 83 and the liquid container 23. In this regard, the air pocket 96 and wall engaging ridge minimize a vacuum effect and the attendant liquid leakage via opposed surfacing as discussed in further detail in U.S. patent application Ser. No. 14/920,850 (in connection with air pockets 30/31, for example) from which this application claims a benefit and the specifications of which are incorporated herein by reference thereto.

Referencing FIGS. 73-87, the reader will there consider a preferred lid assembly 131 according to the present invention. Lid assembly 131 is characterized by a simplification in design for the purpose of material construction cost reduction. The lid assembly 131 thus is preferably constructed from less material and comprises a relatively streamlined or low profile as compared to other lid assemblies in these specifications.

The preferred lid assembly 131 according to the present invention further departs from other lid assemblies described in these specifications by providing a simplified, planar upper lid construction or insert as at 132, and a streamlined or low-profile lower lid construction as at 133. The upper lid construction 132 preferably comprises a primary liquid outlet as at 50 and a knob-like protrusion 165 for easing manual rotation(s) thereof relative to the lower lid construction 133. Protrusion 165 is preferably outfitted with a protrusion-based air-letting aperture 141.

The lower lid construction 133 provides a minimally depressed or dropped (planar) pan portion 134 that is generally dropped or depressed (as at arrow 122) relative to the plane 120 of the lid-to-container attachment means as exemplified by an upper container rim-receiving groove construction as generally depicted and referenced at 59. The lid assembly 131 provides structural configurations excellent for directing and controlling primarily low viscosity liquids through low-profiled, hydrophilic property-harnessing structural arrangements.

In this regard, the reader is directed to upper surfacing 135 of the dropped (planar) pan portion 134 and lower surfacing 136 of the (planar) upper lid construction 132. Liquid volume-receiving and shaping cavity 46 is defined by the upper and lower surfacing 135 and 136 where lower surfacing 136 is substantially planar for shaping upper portions of the liquid volume 104, and upper surfacing 135 provides planar surfacing for shaping lower portions of the liquid volume 104.

The upper and lower surfacing 135 and 136 are spaced from one another such that the liquid volume 104 adheres to both the upper and lower surfacing 135 and 136 as generally depicted in FIG. 86. The reader will note the outer edging 137 of the liquid volume 104 is concave relative to radially outer portions of the lid assembly 131 thereby denoting the hydrophilic wetting properties of the upper and lower surfacing 135 and 136. The reader may also wish to reference FIG. 71 depicting similar concavity at the outer edging of the liquid volume 104 as provided by upper and lower surfacing 60 and 61.

The reader is further directed to the structural arrangement between the pan portion 134 and the inner container wall surfacing 29 due to the pan portion 134 being radially and centrally located relative to the inner container wall surfacing 29. The reader should note in this regard that the outer wall 137 of the lower lid construction 133 is substantially parallel to the inner container wall surfacing 29 and provides a relatively tight or narrow liquid-letting channel as at 138 for letting liquid into the cavity 46 via liquid-letting aperture 139 formed in the outer wall 137 of the lower lid construction 133. In addition, the narrow, liquid-letting channel 138 acts as a damming channel and limits the amount of liquid to pass therethrough.

Because of the relatively tight juxtaposition of the inner container wall surfacing 29 relative to the outer wall 137 opposite the liquid-letting channel 138, liquid tends to adhere (as at 142) to the opposed surfacing defining the channel 138 thereby decreasing the pulling or suctioning effect as the ensemble is shifted from a liquid-directing angled position back toward a vertical position as generally and comparatively depicted in FIGS. 85, 85A, and 86. Because of the liquid adherence 142 and weakened pulling effect, a relatively larger liquid volume 104 is trapped or left behind within the cavity 46. The larger the liquid volume 104, the better the cooling effect and overall better performance of the lid assembly 131.

Referencing FIG. 86, the reader will there see that the cavity 46 houses a liquid volume 104 such that the lower surfacing 136 and the upper surfacing 135 are both in contact with the liquid volume 104. This structural arrangement provides a relatively rapid heat transfer 102 from the liquid volume 104. The liquid-opposing upper surfacing 135 of the lower lid construction 133 and the (planar) liquid-opposing or pan-opposing lower surfacing 136 of the upper lid construction 132 are preferably spaced from one another so as to harness the hydrophilic properties of the liquid volume 104 so that the liquid volume adheres to both surfaces 135 and 136 for effecting enhanced heat transfers 102 therefrom.

Recalling that the outer wall 137 of the lower lid construction 133 is preferably and substantially parallel to the inner container wall surfacing 29, the opposed surfacing is also be preferably spaced from one another opposite channel 138 so as to harness the hydrophilic properties of the liquid entering (as at arrow 140) the channel 138 so that the liquid volume "sticks" or adheres to the opposed surfaces for further effecting enhanced heat transfers therefrom. Excellent results have been achieved when the angle of difference between the outer wall 137 is ±15° relative to the plane of the inner container wall surfacing 29. The reader may wish to refer back to FIG. 72A for an illustration depicting analogous structures.

As with lid assembly 81, the lid assembly 131 also preferably defines a radially inner (and upper) edge-receiving groove 92, which edge-receiving groove 92 may preferably and radially outwardly press into or tightly engage the material construction or inner container wall surfacing 29 of the liquid container 23 via a wall-engaging ridge 94 thereby reducing the leakage opportunities as depicted in FIGS. 83A, 83B, and 87A. As earlier indicated, the edge-receiving groove 92 and wall-engaging ridge 94 may preferably form or provide a space-defining façade as at 95, which façade structure 95 defines a space or air pocket 96 between the lower lid construction 133 and the inner container wall surfacing 29 of the liquid container 23.

Together, the wall-engaging ridge 94 and space or air pocket 96 function to prevent leakage from the liquid container 23 via the junction between the lower lid construction 133 and the liquid container 23. In this regard, the air pocket 96 and wall engaging ridge minimize a vacuum effect and the attendant liquid leakage via opposed surfacing as discussed in further detail in U.S. patent application Ser. No. 16/413,546 (in connection with air pockets 30/31, for example) from which this application claims a benefit and the specifications of which are incorporated herein by reference thereto.

In addition to the relatively slimmer profile of lid assembly 131 as compared to lid assembly 81, the reader will note that the upper lid construction 82 of the lid assembly comprises laterally-opposed, downwardly-extending arc-chord conformation sections 57, which sections 57 conform to underlying upper surfacing 60 of the liquid-opposing portion 87 such that the cavity 46 generally extends upwardly relative to the sections 57. By contrast, the lower lid construction 133 of the lid assembly 131 preferably comprises laterally opposed, upwardly-extending arc-chord conformation sections 143, which sections 143 conform to overlying surfacing 136 of the liquid-opposing or pan-opposing portion 144 such that the cavity 46 generally extends downwardly relative to the sections 143.

Referencing FIGS. 88-94A, the reader will there consider a first alternative unibody lid construction 150 according to the present invention. The first alternative unibody lid construction 150 is characterized by providing a single material construction attachable to an upper container rim 32 of a liquid container 23 via lid-to-container fastening means exemplified by a state of the art rim-receiving groove as at 59; a primary liquid outlet 151 formed in a radially inner wall or space-defining facade structure 95 of the groove 59; and a series of circumferentially spaced compartment-to-pocket, liquid-letting portals 152 as considered from bottom or inferior surfacing of the construction 150.

When viewed or considered from superior or top surfacing of the construction 150, the compartment-to-pocket, liquid-letting portals 152 may be projected as upper portal nodules 153. The portals provide gateways from the liquid-containing compartment 101 to a circumferentially extending pocket 196 defined by the façade structure 95 and the wall-engaging ridge 94. The wall-engaging ridge 94 may be considered interiorly by groove structure 92.

Referencing FIGS. 93 and 93A, the reader will there consider liquid egression 105 from the lid construction 150 while retaining compartmentalized liquid adhesion 142 within pocket 196 defined by the façade structure 95 of the lid construction 150 relative to a container wall 27 of the liquid container 23. Comparatively referencing FIG. 93B, the reader will there consider how liquid 103 enters as at 145 the pocket 196 via the compartment-to-pocket, liquid-letting portal 152 defined upwardly by a portal nodule 153. Façade structure 95 is preferably outfitted with laterally offset air-letting aperture(s) as at 154 opposite the primary liquid outlet 151 for pressure equalization purposes.

Unibody lid construction 150 thus essentially provides a liquid-cooling pocket 196. Liquid adhesion 142 within pocket 196 operates to effect a relatively rapid heat transfer 102 via the material of the lid construction 150 as generally depicted in FIGS. 93B and 94A. In this regard, the reader should further note that the façade structure 95 is preferably spaced from inner container wall surfacing 29 so as to enable liquid adhesion 142. This spacing is preferably effected by way of ridge 94 and oblique offset 155.

While the above descriptions contain much specificity, this specificity should not be construed as limitations on the scope of the invention, but rather as an exemplification of the invention. In certain alternative embodiments, the basic invention may be said to essentially teach or disclose a liquid container orifice assembly usable in combination with a liquid container or a combination liquid container assembly inclusive of the orifice assembly.

The liquid container usable in combination with the orifice assembly may preferably and essentially comprise a container wall as at 27, an upper container ridge as at element 26, and an inwardly extending peripheral flange seat as at 16. The inwardly extending peripheral flange seat preferably extends radially inwardly from the container wall in inferior adjacency to the upper container ridge, and the container wall inherently comprises outer wall surfacing as at 28.

The liquid container orifice assembly may be said to preferably comprise at least a container lid as at 11, which container lid may be said to further preferably and essentially comprise certain lid-to-container fastening means and a primary liquid outlet as at 14. The lid-to-container fastening means essentially function to removably fasten the container lid to the liquid container such that portions of said lid-to-container fastening means simultaneously engage the inwardly extending peripheral flange seat and the outer wall surfacing.

The lid-to-container fastening means thus function to seal the container lid to the liquid container at a first, flange seal site (i.e. the junction between the annulus element 25 and the peripheral flange seat 16), which seal site is essentially a horizontal, annular seal; and a second, wall seal site (i.e. the junction between the outer lid wall 35 and the outer wall surfacing 28), which seal site is essentially a vertical, annular seal. The dual action of the first and second seal sites provides optimal lid-to-container fastening means.

The liquid container orifice assembly according to the present invention may be said to further comprise in combination a damming insert as at element 10 for enabling liquid pooling and heat transfer from lid-pooled liquid prior to liquid egression. The damming insert is receivable intermediate the liquid container and the container lid and preferably and essentially comprises a liquid-pooling central portion as at 15; a liquid-letting inlet as at 13; and an outwardly extending peripheral seat flange as at 17.

The outwardly extending peripheral seat flange is seatable upon the inwardly extending peripheral flange seat for selectively positioning the liquid-letting inlet in inferior adjacency to the container lid. The damming insert thereby forms an upper liquid-cooling compartment as at 100, and a lower liquid-containing compartment as at 101 and is operable to direct liquid into the liquid-pooling central portion via the liquid-letting inlet for enabling heat transfer (as at 102) therefrom prior to outletting through the primary liquid outlet 14 of the container lid 11.

The container lid according to the present invention may be said to further preferably and essentially comprise an upper lid plane as at 107, and the inwardly extending peripheral flange seat preferably extends in a first seat plane as at 108. The outwardly extending peripheral seat flange preferably extends in a second seat plane 110, which second seat plane 110 is preferably parallel to and intermediate the first seat plane 108 and the upper lid plane 107.

The primary liquid outlet may preferably extend in an outlet plane as at 109, which outlet plane 109 is preferably parallel to and intermediate the upper lid plane 107 and the first seat plane 108, while the second seat plane 110 is preferably parallel to and intermediate the first seat plane 108 and the outlet plane 109. The outwardly extending peripheral seat flange may be either continuous or discontinuous. The liquid-letting inlet preferably extends downwardly form the discontinuous, outwardly extending peripheral seat flange, or in inferior adjacency to the continuous, outwardly extending peripheral seat flange.

The liquid-pooling central portion comprises a vertically arcuate transverse cross-section for directing and pooling liquid prior to outletting through the primary liquid outlet. The vertically arcuate transverse cross-section is preferably downwardly bowed (or concave) relative to the container lid for directing and pooling liquid centrally. The damming insert may further preferably comprise at least one air-letting inlet, which air-letting inlet is preferably formed opposite the liquid-letting inlet for enabling pressure equalization via the damming insert between the upper liquid-cooling compartment and the lower liquid-containing compartment.

The upper container ridge and the container lid may preferably comprise differing material constructions, which differing material constructions each having unique thermal expansion properties. In this regard, the lid-to-container fastening means of the container lid are operable to removably fasten the container lid to the liquid container such that portions of said fastening means resiliently and simultaneously engage the upper container ridge (as at element 26) radially inwardly (via annulus element 25) and radially outwardly (via lid wall 35) for maintaining engagement with the upper container ridge during thermal expansion events.

It is contemplated that the foregoing basically embraces or encapsulates the concepts disclosed in connection with the so-called soup on the go embodiment(s) whereby a key improvement is a lid construction as at 11 that cooperates with the state of the art liquid container 12 for minimizing leakage during liquid consumption events. The lid construction 11 is further usable in combination with the damming insert element 10, which insert is seatable upon the flange seat 16 for enabling liquid pooling within the ensemble.

That being said, it is contemplated that an alternative orifice assembly as at 20 may be provided that combines structural features of a "soup-on-the-go" type container and a damming insert construction for attachment to a more generic liquid container as at 23. In this regard, it is contemplated that the liquid container orifice structure according to the present invention primarily enables liquid pooling and heat transfer from lid-pooled liquid prior to liquid egression as at 105.

The liquid container orifice structure is receivable intermediate a liquid container and a container lid and preferably comprises a liquid-pooling central portion, a liquid-letting inlet, and a peripheral rim-engaging structure as exemplified, in part, by rim-receiving annular (aluminum) ring element 36 and annular or O-ring section or portion 21. The peripheral rim-engaging structure is engageable with an upper container rim (as t 32) of the liquid container for selectively positioning the liquid-letting inlet 33 in inferior adjacency to the container lid.

The liquid container orifice structure thereby forms an upper liquid-cooling compartment as at 100 and a lower liquid-containing compartment as at 101 and is operable to direct liquid into the liquid-pooling central portion as at 22 via the liquid-letting inlet 33 for enabling heat transfer (as at 102) from the pooled liquid prior to outletting through a primary liquid outlet of the container lid.

The peripheral rim-engaging structure may preferably comprise an upper-outer peripheral ring element (e.g. element 36) and a lower-inner peripheral flange seat (e.g. portion 21). The upper-outer peripheral ring element may preferably extend in a ring plane as at 115, while the lower-inner peripheral flange seat preferably extends in a first seat plane as at 108. Noting that the primary liquid outlet extends in an outlet plane 109 parallel to the first seat plane 108, the ring plane 115 is preferably parallel to and intermediate the first seat plane 108 and outlet plane 109.

The liquid container orifice structure as exemplified by structure 20 is usable in combination with the container lid 11 such that the upper-outer peripheral ring element and the container lid may preferably comprise differing material constructions, which differing material constructions each have unique thermal expansion properties. The container lid preferably comprises certain lid-to-container fastening means operable to removably fasten the container lid to the liquid container such that portions of said lid-to-container fastening means resiliently engage the upper-outer peripheral ring element radially inwardly and radially outwardly for maintaining engagement with the upper-outer peripheral ring element during thermal expansion events as previously discussed.

The lid-to-container fastening means may removably fasten the container lid to the liquid container such that portions of said lid-to-container fastening means further simultaneously engage the lower-inner peripheral flange seat for forming a flange seal site. Further, the lid-to-container fastening means may removably fasten the container lid to the liquid container such that portions of said lid-to-container fastening means further simultaneously engage outer wall surfacing of the liquid container for forming a wall seal site.

In certain other alternative embodiments, the basic invention may be said to essentially teach or disclose a liquid container lid assembly for enabling liquid pooling and heat transfer 102 from lid-pooled liquid prior to liquid egression as at 105. Certain alternative lid assemblies may be said to essentially and preferably comprise a lower lid construction and an upper lid construction. The lower lid constructions may preferably comprise certain lid-to-container fastening means as exemplified by a state of the art rim-receiving groove as at 59; a centralized, liquid-collecting or liquid-pooling portion as variously exemplified; and at least one (liquid- and/or air-) letting aperture as various exemplified.

The lid-to-container fastening means essentially function to removably fasten the lower lid construction to a generic liquid container as at 23. The centralized, liquid-collecting portions preferably comprise upper portion surfacing as at 60. The upper lid construction(s) are nestable or receivable atop the lower lid construction(s) and preferably comprise a centralized, liquid-opposing or pan-opposing portion and a primary liquid outlet as at 50. The liquid-opposing or pan-opposing portion(s) comprise lower portion surfacing as at 61. The upper and lower portion surfacing of the lower and upper lid constructions compartmentalize, or receive and shape a liquid volume 104 received therebetween.

In certain alternative embodiments, the liquid container lid assemblies may comprise upper and lower portion surfacing that mimic one another (e.g. lid assemblies 40, 41, 71, 81, and 131). In other words, each of the upper and lower portion surfaces may comprise surfacing-mimicking contours for similarly and simultaneously shaping the liquid volume 104 upwardly and downwardly.

More particularly, the upper and lower surfacing may be preferably spaced from one another such that liquid adherence to both the upper and lower surfacing is evidenced during liquid pooling events, which liquid adherence enhances heat transfer from the liquid volume 104. The vertical transverse cross-sections of the surface-mimicking contours may be either (a) vertically arcuate or more particularly downwardly bowed for providing a concavely shaped liquid volume relative to the upper lid constructions or (b) vertically planar.

The upper lid construction(s) are preferably rotatably nestable or receivable atop the lower lid construction(s) for enabling a user to rotate as at 112 the upper lid constructions about lid axes of rotation 111 relative to the lower lid construction(s) for selectively orienting the primary lid outlet(s) 50 in superior adjacency to at least one liquid-letting aperture, preferably formed at edging of the liquid-collecting portion(s). The upper lid constructions may optionally comprise a transparent material for enabling a user to visually perceive the liquid volume 104 collected at the centralized, liquid-collecting portion and thereby enhancing a user's ability to control liquid flows into the cavities 46.

The lower lid constructions may preferably comprise edge-receiving grooves as at radial grooves 51 and the upper lid construction comprises outer (peripheral) edging as at 55, which outer edging 55 is rotatably received in the edge-receiving groove(s) 51 for rotatably attaching the upper lid construction(s) to the lower lid construction(s). Protrusions 65 and/or 165 may aid the user to manually rotate the upper lid construction(s) relative to the lower lid construction(s).

Certain upper lid construction(s) may preferably comprise a volume-forming or volume-shaping portion, which volume-forming portions provide a liquid-receiving cavity as at 46 in inferior adjacency to the lower portion surfacing. The liquid-receiving cavities are preferably in communication with the primary lid outlet(s) 50 for outletting 105 portions of the liquid volume 104 from the liquid-receiving cavities 46.

In certain alternative embodiments, the lower lid constructions may preferably comprise an annular support seat while the upper lid constructions may preferably comprise an annular support portion. The annular support portions are preferably seatable atop the annular support seats. See for example, the embodiments illustrated in FIGS. 25-44. The volume-forming portion and liquid-receiving cavity formed thereby may preferably traverse the upper lid construction intermediate opposed portions of the annular support portion.

Certain alternative embodiment further provide upper lid constructions having an upper vertical offset while the lower lid constructions comprise a lower vertical offset. The upper vertical offsets may preferably extend orthogonally from the annular support portions and the lower vertical offsets may preferably extend orthogonally from the annular support seats. The upper and lower vertical offsets are preferably dimensioned for frictionally engaging one another and enhancing fitted relationship between the upper and lower lid constructions. The upper and lower vertical offsets may optionally comprise differently shaped geometries for frictionally and selectively engaging one another thereby enhancing the fitted relationship between the upper and lower lid constructions.

A select lid construction as selected from the group consisting of the upper lid construction and the lower lid construction may preferably comprise laterally-opposed, cavity-defining conformation sections. When formed as part of the upper lid construction, the laterally-opposed, cavity-defining conformation sections are, for example, "upper-to-lower" conformation sections for conforming to the upper portion surfacing of the lower lid constructions for eliminating space between the upper and lower lid constructions and directing the liquid volume into the liquid-receiving cavity.

Stated another way, the alternative liquid container lid assemblies according to the present invention basically function to enable liquid pooling and heat transfer from lid-pooled liquid prior to liquid egression. To achieve these primary objectives, the various alternative lid assemblies may be said to preferably and essentially comprise a lower lid construction as variously exemplified and an upper lid construction as various exemplified.

The lower lid constructions may all be said to comprise certain lid-to-container fastening means and a liquid-collecting pan portion (e.g. portions 47, 87, and 134), which liquid-collecting pan portions each preferably further comprise at least one liquid-letting aperture as various exemplified. The lid-to-container fastening means removably fasten the lower lid constructions to upper container rims as at 32 of liquid containers as at 23. The upper container rims extend in rim planes as at 120, and the liquid-collecting pan portions variously comprise upper portion surfacing.

The upper lid constructions are nestable atop and within the lower lid constructions and each preferably comprise a liquid-opposing or pan-opposing portion and a primary liquid outlet. The liquid-opposing or pan-opposing portions comprise variously exemplified lower portion surfacing. The upper and lower portion surfacing together defining a liquid-receiving cavity or compartment when the upper lid constructions are nested or received atop and within the lower lid constructions. The liquid-receiving cavities 46 receive and shape a liquid volume 104 receivable therein via the at least one liquid-letting apertures 50. The primary lid outlets 50 are orientable in superior adjacency the lower lid construction for outletting 105 portions of the liquid volume via the primary liquid outlets 50.

The upper and lower surfacing are spaced from one another such that liquid adherence to both the upper and lower surfacing is evidenced during liquid pooling events, the liquid adherence for enhancing heat transfer from the liquid volume. The lid-to-container fastening means, may, in certain embodiments, be preferably situated in superior adjacency to the liquid-collecting pan portion as is the case with embodiments 81 and 131. The liquid container lid assemblies thereby define certain upper lid-to-container fastening means juxtaposed in superior adjacency to a lower liquid-collecting pan portion.

In embodiments 81 and 131, the lid-to-container fastening means as exemplified by rim-receiving groove as at 59, and the upper container rim as at 32 are substantially coplanar in the rim plane 120. The upper lid constructions 82 and 132 may each preferably comprise an upper extent extending in an upper extent plane such that the upper extent plane is substantially parallel and inferior to the container rim plane 120.

The lower liquid-collecting pan portion may preferably comprise a downwardly extending pan wall (as at 84 or 137) and the liquid container 23 may preferably comprise a container wall as at 27. The variously exemplified pan walls and the container walls may preferably be spaced from one another such that liquid adherence to both the container wall and pan wall is evidenced during liquid directing events. This liquid adherence as at 142 enhances heat transfer and liquid direction into the liquid-receiving cavities 46. In this last regard, the pan wall and the container wall extend in opposing planes such that the angle therebetween are critically ±15° from one another and preferably substantially parallel for enhancing liquid adherence properties therebetween.

The lid-to-container fastening means may radially and uniformly extend about a first lid axis as at 116, and the lower lid construction may provide a dropped pan construction that radially and uniformly extends about a second lid axis as at 111. The second lid axis 111 is preferably parallel to and anterior to the first lid axis 116 thereby defining a pan axis of rotation as at 111 for enabling the user to rotatably open and close the liquid container lid assembly.

In certain alternative embodiments (e.g. 40, 41, and 71), the lid-to-container fastening means as exemplified by a state of the art rim-receiving groove as at 59 may preferably be situated in inferior adjacency to the liquid-collecting pan portion(s). The liquid container lid assemblies thereby define lower lid-to-container fastening means relative to upper liquid-collecting pan portions. This is the case in all domed embodiments as generally depicted at arrow 121.

Building upon these concepts, the liquid container lid construction 150 enables liquid compartmentalization and heat transfer 102 from lid-compartmentalized liquid prior to liquid egression. The lid construction 150 may be said to preferably and essentially comprise certain lid-to-container fastening means; a pocket-defining façade structure as at 95; and at least one, but preferably a series of circumferentially spaced, compartment-to-pocket liquid-letting portal as at 152.

The lid-to-container fastening means may be exemplified by a state of the art rim-receiving groove as at 59 for removably fastening the lid construction 150 to an upper container rim 32 of a liquid container 23 for forming a primary liquid-containing compartment as at 101. The radially-inner, pocket-defining façade structure 95 extends from the lid-to-container fastening means and engages a container wall as at 27 for forming a secondary liquid-containing pocket as at 196. The pocket-defining façade structure preferably comprises a primary liquid outlet as at 151.

Each compartment-to-pocket liquid-letting portal communicates the primary liquid-containing compartment 101 and the secondary liquid-containing pocket 196 for letting liquid into the secondary liquid-containing pocket 196 from the primary liquid-containing compartment 101. The pocket-defining façade structure 95 is preferably spaced from the container wall 27 for enabling liquid adherence 142 to both the façade structure 95 and container wall 27. The liquid adherence 142 enhances heat transfer 102 prior to liquid egression 105 via the primary liquid outlet 151 for consumption.

Although the inventive liquid container lids according to the present invention have been described by reference to a number of different embodiments, it is not intended that the novel combinations or assemblies be limited thereby, but that modifications thereof are intended to be included as falling within the broad scope and spirit of the foregoing disclosure, the appended drawings, and perhaps most importantly, the following claims.

What is claimed is:

1. A low-profile liquid container lid assembly for enabling liquid collection and heat transfer from lid-collected liquid prior to liquid egression, the low-profile liquid container lid assembly comprising:

a lower lid construction, the lower lid construction comprising a lower rim-receiving groove, an upper edge-receiving groove, and a liquid-collecting pan portion, the liquid-collecting pan portion comprising at least one liquid-letting aperture, the lower rim-receiving groove for removably fastening the lower lid construction to an upper container rim of a liquid container, the liquid-collecting pan portion comprising upper portion surfacing; and an upper lid construction, the upper lid construction being receivable by the lower lid construction and comprising a pan-opposing portion, an outer peripheral edge, and a primary liquid outlet, the pan-opposing portion comprising lower portion surfacing, the upper and lower portion surfacing together defining a liquid-receiving cavity when the upper lid construction is received by the lower lid construction, the liquid-receiving cavity for receiving and shaping a liquid volume receivable therein via the at least one liquid-letting aperture;

the upper lid construction being rotatably nestable atop the lower lid construction for enabling a user to rotate the upper lid construction about a lid axis of rotation relative to the lower lid construction for selectively orienting the primary liquid outlet in superior adjacency to the at least one liquid-letting aperture, the primary liquid outlet being orientable in superior adjacency to the lower lid construction for outletting a portion of the liquid volume via the primary liquid outlet;

the outer peripheral edge being rotatably received in the upper edge-receiving groove for rotatably attaching the upper lid construction to the lower lid construction, the upper edge-receiving groove radially and outwardly engaging a container wall of the liquid container via a wall-engaging ridge for reducing leakage.

2. The low-profile liquid container lid assembly of claim 1 wherein the upper and lower portion surfacing are spaced from one another for enabling liquid adherence to both the upper and lower portion surfacing when liquid is received in the liquid-receiving cavity, the liquid adherence for enhancing heat transfer from the liquid volume.

3. The low-profile liquid container lid assembly of claim 1 wherein the liquid-collecting pan portion comprises a downwardly extending pan wall and the liquid container comprises a container wall, the pan wall and the container wall being spaced from one another for enabling liquid adherence to both the container wall and the pan wall, the liquid adherence for enhancing heat transfer from the liquid.

4. The low-profile liquid container lid assembly of claim 1 wherein the upper and lower portion surfacing each comprise surfacing-mimicking contours for similarly and simultaneously shaping the liquid volume upwardly and downwardly.

5. The low-profile liquid container lid assembly of claim 1 wherein a select lid construction comprises laterally-opposed, cavity-defining conformation sections, the laterally-opposed, cavity-defining conformation sections conforming to select portion surfacing for eliminating space between the upper and lower lid constructions and directing the liquid volume into the liquid-receiving cavity, the select lid construction being selected from the group consisting of the upper and lower lid constructions and the select portion surfacing being selected from the group consisting of the upper and lower portion surfacing.

6. A low-profile liquid container lid assembly for enabling liquid collection and heat transfer from lid-collected liquid prior to liquid egression, the low-profile liquid container lid assembly comprising:

a lower lid construction, the lower lid construction comprising an upper edge-receiving groove and a liquid-collecting pan portion, the liquid-collecting pan portion comprising at least one liquid-letting aperture, the lower lid construction being attachable to an upper container rim of a liquid container, the liquid-collecting pan portion comprising upper portion surfacing; and an upper lid construction, the upper lid construction being receivable by the lower lid construction and comprising a pan-opposing portion, an outer peripheral edge and a primary liquid outlet, the pan-opposing portion comprising lower portion surfacing, the upper and lower portion surfacing together defining a liquid-receiving cavity when the upper lid construction is received by the lower lid construction, the liquid-receiving cavity for receiving and shaping a liquid volume receivable therein via the at least one liquid-letting aperture;

the upper lid construction being rotatably nestable atop the lower lid construction for enabling a user to rotate the upper lid construction about a lid axis of rotation relative to the lower lid construction for selectively orienting the primary liquid outlet in superior adjacency to the at least one liquid-letting aperture, the primary liquid outlet being orientable in superior adjacency to the lower lid construction for outletting a portion of the liquid volume via the primary liquid outlet;

the outer peripheral edge being rotatably received in the upper edge-receiving groove for rotatably attaching the upper lid construction to the lower lid construction, the upper edge-receiving groove radially and outwardly engaging a container wall of the liquid container via a wall-engaging ridge for reducing leakage.

7. The low-profile liquid container lid assembly of claim 6 wherein the upper and lower portion surfacing are spaced from one another for enabling liquid adherence to both the upper and lower portion surfacing when liquid is received in the liquid-receiving cavity, the liquid adherence for enhancing heat transfer from the liquid volume.

8. The low-profile liquid container lid assembly of claim 6 wherein the liquid-collecting pan portion comprises a downwardly extending pan wall and the liquid container comprises a container wall, the pan wall and the container wall being spaced from one another for enabling liquid adherence to both the container wall and the pan wall, the liquid adherence for enhancing heat transfer from the liquid.

9. The low-profile liquid container lid assembly of claim 6 wherein the upper and lower portion surfacing each comprise surfacing-mimicking contours for similarly and simultaneously shaping the liquid volume upwardly and downwardly.

10. The low-profile liquid container lid assembly of claim 6 wherein the upper lid construction comprises laterally-opposed, cavity-defining conformation sections, the laterally-opposed, cavity-defining conformation sections conforming to the upper portion surfacing for eliminating space between the upper and lower lid constructions and directing the liquid volume into the liquid-receiving cavity.

11. A low-profile liquid container lid assembly for enabling liquid collection and heat transfer from lid-collected liquid prior to liquid egression, the low-profile liquid container lid assembly comprising:

a lower lid formation, the lower lid formation comprising a liquid-collecting pan portion, the liquid-collecting pan portion comprising a downwardly extending pan wall and at least one liquid-letting aperture formed in the downwardly extending pan wall, the lower lid formation being attachable to an upper container rim of a liquid container, the at least one liquid-letting aperture facing a container wall of the liquid container, the liquid-collecting pan portion comprising upper portion surfacing; and an upper lid formation, the upper lid formation being receivable by the lower lid formation and comprising a pan-opposing portion and a primary liquid outlet, the pan-opposing portion comprising lower portion surfacing, the upper and lower portion surfacing together defining a liquid-receiving cavity when the upper lid formation is received by the lower lid formation, the liquid-receiving cavity for receiving and shaping a liquid volume receivable therein via the at least one liquid-letting aperture, the primary liquid outlet being orientable in superior adjacency to the lower lid formation for outletting a portion of the liquid volume via the primary liquid outlet;

the upper lid formation comprising laterally-opposed, cavity-defining conformation sections, the laterally-opposed, cavity-defining conformation sections conforming to the upper portion surfacing for eliminating space between the upper and lower lid formations and directing the liquid volume into the liquid-receiving cavity.

12. The low-profile liquid container lid assembly of claim 11 wherein upper lid formation is rotatably nestable atop the lower lid formation for enabling a user to rotate the upper lid formation about a lid axis of rotation relative to the lower lid formation for selectively orienting the primary liquid outlet in superior adjacency to the at least one liquid-letting aperture.

13. The low-profile liquid container lid assembly of claim 12 wherein the lower lid formation comprises an edge-receiving groove and the upper lid formation comprises an outer edge, the outer edge being rotatably received in the edge-receiving groove for rotatably attaching the upper lid formation to the lower lid formation, the edge-receiving groove radially and outwardly engaging the container wall via a wall-engaging ridge for reducing leakage.

* * * * *